US008043579B2

(12) United States Patent
Katoh et al.

(10) Patent No.: US 8,043,579 B2
(45) Date of Patent: Oct. 25, 2011

(54) GAS HYDRATE PRODUCTION APPARATUS AND DEWATERING UNIT

(75) Inventors: Yuichi Katoh, Ichihara (JP); Shigeru Nagamori, Ichihara (JP); Toru Iwasaki, Ichihara (JP); Takashi Arai, Tamano (JP); Kiyoshi Horiguchi, Ichihara (JP); Tetsuro Murayama, Tamano (JP); Akira Tokinosu, Tokyo (JP); Masahiro Takahashi, Ichihara (JP); Toshio Yamaki, Ichihara (JP)

(73) Assignee: Mitsui Engineering & Shipbuilding Co., Ltd., Tokyo (JP)

( * ) Notice: Subject to any disclaimer, the term of this patent is extended or adjusted under 35 U.S.C. 154(b) by 379 days.

(21) Appl. No.: 12/226,028

(22) PCT Filed: Apr. 5, 2006

(86) PCT No.: PCT/JP2006/307244

§ 371 (c)(1),
(2), (4) Date: Oct. 6, 2008

(87) PCT Pub. No.: WO2007/113912

PCT Pub. Date: Oct. 11, 2007

(65) Prior Publication Data

US 2009/0235586 A1 Sep. 24, 2009

(51) Int. Cl.

| | |
|---|---|
| ***B01J 8/08*** | (2006.01) |
| ***C07C 9/00*** | (2006.01) |
| ***C01B 3/32*** | (2006.01) |

(52) U.S. Cl. ..... 422/232; 422/233; 422/236; 422/198; 48/127.3; 585/15

(58) Field of Classification Search ..... 422/232, 422/233, 226, 198; 48/127.3; 585/15
See application file for complete search history.

(56) References Cited

U.S. PATENT DOCUMENTS

2005/0107648 A1* 5/2005 Kimura et al. ..... 585/15

FOREIGN PATENT DOCUMENTS

| | | |
|---|---|---|
| JP | 2003-073679 A | 3/2003 |
| JP | 2003-321685 A | 11/2003 |
| JP | 2005-200479 A | 7/2005 |

* cited by examiner

*Primary Examiner* — Walter Griffin
*Assistant Examiner* — Lessanework Seifu
(74) *Attorney, Agent, or Firm* — Kubovcik & Kubovcik

(57) ABSTRACT

A gas hydrate production apparatus capable of reacting a raw gas with a raw water to thereby form a slurry gas hydrate and capable of removing water from the slurry gas hydrate by means of a gravitational dewatering unit. This gravitational dewatering unit is one including a cylindrical first tower body; a cylindrical dewatering part disposed on top of the first tower body; a water receiving part disposed outside the dewatering part; and a cylindrical second tower body disposed on top of the dewatering part, wherein the cross-sectional area of the second tower body is continuously or intermittently increased upward from the bottom.

2 Claims, 34 Drawing Sheets

GAS HYDRATE PRODUCTION APPARATUS AND DEWATERING UNIT

This application is a 371 of international application PCT/JP2006/307244, filed Apr. 5, 2006, which is incorporated herein by reference.

TECHNICAL FIELD

The present invention relates to a gas hydrate production apparatus and a dewatering unit.

BACKGROUND ART

A gas hydrate is a solid hydrate having a structure in which a gas is trapped in a cage made of water molecules. The gas hydrate is stable under, for example, atmospheric pressure at a ten-several ° C. below zero. For this reason, its utilization has been studied as alternative means to transporting and storing natural gas in a form of liquefied natural gas (LNG). The gas hydrate can be produced under relatively easily achievable conditions of temperature and pressure, and can be stored stably as described above.

Accordingly, when natural gas extracted from a gas field is subjected to an acid-gas removal process, acid gas such as carbon dioxide ($CO_2$) and hydrogen sulfide ($H_2S$) is removed therefrom. Then, the natural gas is temporarily stored in a gas storage section. Thereafter, in a generating process, this natural gas is reacted with water to undergo hydration reaction, and thereby a gas hydrate is formed. This gas hydrate is in a slurry form mixed with water. In a dewatering process subsequent to the generating process, unreacted water mixed therein is removed. After undergoing a regenerating process, a cooling process and a depressurizing process, the gas hydrate is enclosed in a vessel such as a container. After that, the gas hydrate is stored in a storage unit under conditions adjusted to a predetermined temperature and pressure. As described above, the gas hydrate is in a slurry form including surplus water in the generating process. Thus, the storage or transportation of the gas hydrate without any modification requires an extra cost for that water amount. Against this problem, proposed is a natural-gas-hydrate forming method in which a slurry gas hydrate is forced to be dewatered with a screw-press dewatering system (for example, Japanese patent application Kokai publication No. 2003-105362).

Meanwhile, this screw-press dewatering system has a double structure of: an inner wall processed into a mesh form; and a case disposed outside and constituting an outer shell of the inner wall. The screw-press dewatering system removes water through the mesh-processed inner wall by forcing a slurry natural gas hydrate to move forward with a screw shaft mounted within the inner wall. Accordingly, during dewatering (condensation), a large amount of the natural gas hydrate together with water passes through the mesh holes of the inner wall, reducing the recovery rate of natural gas hydrate. Moreover, the rotating of the screw shaft in high torque incurs an additional cost. Furthermore, such high torque is developed inside the dewatering unit that is under a high pressure. Accordingly, the entire equipment is overloaded, and the screw shaft has to be sealed under conditions from high pressure to atmospheric pressure.

In order to eliminate such problems, the present inventors have proposed a gravitational dewatering method utilizing gravity, unlike the conventional forcing dewatering technique. Nevertheless, the diameters of upper and lower gravitational dewatering towers are made the same. For this reason, the following problems may occur, when there is an increase in the resistance in a dewatering zone that is above a dewatering part disposed to the gravitational dewatering tower, the dewatering part being made of a metal mesh. For example, an ejection force of the slurry pump that conveys a gas hydrate slurry to the gravitational dewatering tower is increased. Moreover, the gravitational dewatering tower is clogged by a gas hydrate. Otherwise, a liquid surface (water level) at the dewatering part is elevated, resulting in an insufficient dewatering. These problems, in some cases, make a stable operation impossible with a constant dewatering rate being maintained. Furthermore, various gas hydrate production apparatuses have been proposed so far. One of the gas hydrate production apparatuses has a double structure of an inner cylindrical container and an outer cylindrical container. The space between these containers is made as a conveying path for a formed gas hydrate (see Japanese patent application Kokai publication No. 2004-10686).

Nevertheless, in this apparatus, the outer cylindrical container is required to have a pressure-tolerable structure that does not contribute to gas hydrate formation. As a result, the size of the equipment is increased, and the cost is also increased. Moreover, the gap between the outer cylindrical container and the inner cylindrical container is filled with a gas, and problems occurs that it is difficult to remove heat of the inner cylindrical container caused by the formation of a gas hydrate, and that it is difficult to achieve efficient cooling from the outside. When the gas hydrate thus formed has a high adhesive property dependent on the degree of a percentage of water adhered to the gas hydrate, or the like, another problem occurs that the gas hydrate cannot be conveyed smoothly because the gas hydrate is stuck to a wall surface of the container.

Additionally, in FIG. 5 of the above publication, proposed is an apparatus provided with: a vertical screw conveyor formed as squeezing the top of a gas hydrate formation container; and a horizontal screw conveyor. The apparatus is to convey a formed gas hydrate. Nonetheless, this apparatus also has a problem that the gas hydrate thus formed cannot be discharged smoothly because the gas hydrate is stuck to the inner surface of the formation container.

On the other hand, according to a gas-hydrate dewatering method described in Japanese patent application Kokai publication No. 2001-342473 (Patent Document 3), firstly, a gas hydrate slurry extracted from a formation container is guided to a pressure dewatering device such as a screw press to conduct physical dewatering. Then, the gas hydrate slurry thus physically dewatered is guided and transferred to a screw conveyor, and a raw gas is incorporated thereinto. Thereby, the raw gas and water adhered to the gas hydrate are reacted with each other, and hydration dewatering is conducted. As a result, a gas hydrate having a less amount of water adhered thereto is obtained. In such a hydration dewatering method as described in Patent Document 3, a physically dewatered gas hydrate is stirred with the screw to thereby react a raw gas with water adhered to the gas hydrate, and the gas hydrate is dewatered. Nevertheless, the method has a limitation in the contacting efficiency between the water and the raw gas. Accordingly, a high dewatering rate cannot be obtained.

In contrast, considered is a fluidized-bed dewatering method. In this method, a raw gas is blown to a gas hydrate that has been subjected to physical dewatering to form a fluidized-bed. The raw gas and water adhered to the fluidized gas hydrate are reacted with each other, so that hydration dewatering is conducted. According to this method, the contacting efficiency between the water and the raw gas is high, and thereby a high dewatering rate can be obtained.

A dewatering rate hardly matters when the hydration dewatering is conducted by mechanically stirring a gas hydrate slurry that has been subjected to physical dewatering as in Patent Document 3. Nevertheless, when, for example, fluidized-bed dewatering is conducted, it is necessary to increase a dewatering rate after the physical dewatering in order to guarantee a predetermined fluid state. However, in the conventional physical dewatering, a sufficient dewatering rate cannot be obtained. As a result, there is a problem that options for hydration dewatering in a later process are limited.

DISCLOSURE OF THE INVENTION

A first object of the present invention is to reduce resistance to gas-hydrate movement during gravitational dewatering to thereby carry out a stable operation of a gravitational dewatering tower, and carry out an operation at a constant dewatering rate. A second object of the present invention is to provide a gas hydrate production apparatus including a discharging mechanism for simplifying equipment and reducing cost, and also for smoothly discharging a formed gas hydrate while removing water adhered to the gas hydrate. Moreover, a third object of the present invention is to improve a dewatering rate of a gas hydrate slurry in screw-press type physical dewatering.

Next, means for achieving the objects of the present invention will be described.

1) A gas hydrate production apparatus of the present invention is for reacting a raw gas with a raw water to thereby form a slurry gas hydrate and for removing water from the slurry gas hydrate by means of a gravitational dewatering unit. The gas hydrate production apparatus is characterized in that the gravitational dewatering unit includes: a cylindrical first tower body; a cylindrical dewatering part disposed on top of the first tower body; a water receiving part disposed outside the dewatering part; and a cylindrical second tower body disposed on top of the dewatering part, and that the cross-sectional area of the second tower body is continuously or intermittently increased upward from the bottom.

According to this, in comparison with a conventional case where the inner diameter of the second tower body is constant, resistance to gas-hydrate movement after dewatering is significantly reduced. Thereby, it becomes possible to suppress problems such as the increase in an ejection pressure of a slurry pump that conveys a gas hydrate slurry to the dewatering unit, the clogging of the dewatering tower unit by a gas-hydrate particle layer, or an insufficient dewatering due to elevation of a liquid surface.

Moreover, according to the present invention, the cross-sectional areas of the dewatering part and the second tower body are continuously or intermittently increased upward from the bottom of the dewatering part to the second tower body. Thereby, it becomes possible to reduce resistance to force movement of a gas hydrate on an upper side of the second tower body and the dewatering part. In this respect, it is preferable that the cross-sectional area of at least one of the dewatering part and the second tower body be continuously or intermittently increased upward from the bottom, and that its opening angle $\theta$ be 1° to 30°. Furthermore, it is preferable that the cross-sectional area of at least one of the dewatering part and the second tower body be intermittently increased upward from the bottom, and that $a=(1/5 \text{ to } 1/100)\times d$ and $b/a=2$ to 120 be satisfied, where a is the width of its stepped portion, b is the height of the stepped portion, and d is the diameter of the lowest portion of the tower.

2) A gas hydrate production apparatus of the present invention is for reacting a raw gas with a raw water to thereby form a slurry gas hydrate and for removing water from the slurry gas hydrate by means of a gravitational dewatering unit. The gas hydrate production apparatus is characterized in that the gravitational dewatering unit includes: a cylindrical first tower body; a cylindrical dewatering part disposed on top of the first tower body; a water receiving part disposed outside the dewatering part; and a cylindrical second tower body disposed on top of the dewatering part, and that the dewatering part is provided with an innumerable number of any one of through holes and slits.

This makes it possible to reduce resistance to movement of a gas hydrate slurry in the dewatering part, in comparison with a conventional case where a metal mesh has been used as a dewatering part. Accordingly, it becomes possible to carry out a stable operation of a slurry pump that sends a gas hydrate slurry to the dewatering unit at a constant flow rate and a constant ejection pressure. Moreover, the constant speed of moving a gas hydrate layer enables a stable operation of the dewatering unit. Furthermore, because of the smooth movement of the gas hydrate layer, a constant dewatering rate is obtained, thereby allowing a gas hydrate having a uniform quality in a regular amount to be supplied to the subsequent step of the dewatering unit.

Additionally, according to the present invention, the through holes provided in the dewatering part are characterized in that the hole diameters thereof are enlarged continuously or step-by-step upward from the bottom of the dewatering part. Accordingly, it becomes possible to significantly reduce resistance to movement of a gas hydrate slurry in the dewatering part, in comparison with a conventional case where a metal mesh has been used as a dewatering part. Thus, it becomes possible to carry out a stable operation of the slurry pump that sends a gas hydrate slurry to the dewatering unit, at a constant flow rate and a constant ejection pressure. Moreover, the constant speed of moving a gas hydrate layer enables a stable operation of the dewatering unit. Furthermore, a constant dewatering rate is obtained because of the smooth movement of the gas hydrate layer, thereby allowing a gas hydrate having a uniform quality in a regular amount to be supplied to the subsequent step of the dewatering unit.

In this respect, the through holes are preferably arranged in the dewatering part in a zigzag or grid form. Moreover, it is preferable that the minimum hole diameter of the through holes be from 0.1 mm to 5 mm, and that the maximum hole diameter of the through holes be from 0.5 mm to 10.0 mm.

In addition, in the present invention, the through hole is inclined such that an outlet thereof is positioned lower than an inlet. Thereby, dewatering is smoothly conducted, and it becomes possible to significantly reduce resistance to movement of a gas hydrate slurry in the dewatering part, in comparison with a conventional case where a metal mesh has been used as a dewatering part. Thus, it becomes possible to carry out a stable operation of the slurry pump that sends a gas hydrate slurry to the dewatering unit at a constant flow rate and a constant ejection pressure. Moreover, the constant speed of moving a gas hydrate layer enables a stable operation of the dewatering unit. Furthermore, because of the smooth movement of the gas hydrate layer, a constant dewatering rate is obtained, thereby allowing a gas hydrate having a uniform quality in a regular amount to be supplied to the subsequent step of the dewatering unit.

In this respect, the hole diameter of the through hole is preferably from 0.1 mm to 10.0 mm. Moreover, the dewatering part is preferably provided with multiple linear bodies each having a wedged lateral cross section, the linear bodies being aligned in a circumferential direction, and being separated from each other at predetermined intervals. Furthermore, it is preferable that the width of each linear body or the interval between the slits be from 1.0 mm to 5.0 mm, and that the interval between the linear bodies or the width of each slit be from 0.1 mm to 5.0 mm.

3) A gas hydrate production apparatus of the present invention is for reacting a raw gas with a raw water to thereby form a slurry gas hydrate and for removing water from the slurry gas hydrate by means of a gravitational dewatering unit. The gas hydrate production apparatus is characterized as follows. A dewatering part of the gravitational dewatering unit is provided with a first opening part of any form such as a slit and a rhombus. An outer cylinder for controlling the dewatering part is fitted onto the outer side of the dewatering part, the outer cylinder having a second opening part facing to the first opening part. The degree of opening of the first opening part is changed by displacement of the outer cylinder for controlling the dewatering part.

This enables a fine operation in accordance with the clogging of the dewatering part and the like. As a result, it becomes possible to stably operate the gas hydrate production apparatus, and to carry out an operation at a constant dewatering rate. In this respect, it is preferable that a gear be provided along an outer periphery of the outer cylinder for controlling the dewatering part, and that the outer cylinder for controlling the dewatering part rotate with the cylindrical dewatering part as an axis by the front and back movements of a rack engaging with the gear. Moreover, it is preferable that a rack in a longitudinal direction be provided to a side surface of the outer cylinder for controlling the dewatering part, and that a gear engaging with the rack be rotated to slide the cylinder for controlling the dewatering part in upward and downward directions with the cylindrical dewatering part as an axis.

4) A gas hydrate production apparatus of the present invention is for expelling a gas hydrate dewatered by means of a gravitational dewatering unit with an expelling unit disposed on a top portion of the gravitational dewatering unit. The gas hydrate production apparatus is characterized in that the expelling unit includes: a crusher section positioned on the top portion of the dewatering tower; and a transfer section positioned behind the crusher section. This enables a dewatered gas-hydrate layer to be smoothly expelled toward an outlet of the transfer section by the transfer section positioned behind the crusher section and to be crushed by the crusher section positioned immediately above the dewatering tower at the same time.

Moreover, according to the present invention, the expelling unit includes: the crusher section positioned on the top part of the dewatering tower; and the transfer section positioned behind the crusher section. In the crusher section, multiple hammer-type crushers are arranged dispersedly in a circumferential direction and an axial direction of a rotation shaft. This enables a dewatered gas-hydrate layer to be smoothly expelled toward an outlet on an upper edge of the dewatering tower. Particularly, in this invention, the hammer-type crushers are arranged dispersedly in the circumferential direction and the axial direction of the rotation shaft in the crusher section corresponding to the outlet on the upper edge of the dewatering tower. Thus, it becomes possible to smoothly expel a dewatered gas-hydrate layer while crushing the dewatered gas-hydrate layer.

Furthermore, according to the present invention, each of the hammer-type crushers is formed of: a supporting bar standing upright in a radial direction of the rotation shaft; and a hammer body swingably disposed to the supporting bar with a joint part. Thereby, it becomes possible to more smoothly expel a dewatered gas-hydrate layer while crushing the dewatered gas-hydrate layer. Additionally, according to the present invention, the hammer body is inclined from a shaft center of a rotation body at only a predetermined angle in an expelling direction. Thereby, it becomes possible to certainly expel a gas hydrate. Moreover, according to the present invention, the expelling means includes: the crusher section positioned immediately above the dewatering tower; and the transfer section positioned behind the crusher section. In the crusher section, screw blades are arranged at predetermined intervals in the expelling direction. Thereby, it becomes possible to obtain the same effect. Still furthermore, according to the present invention, the expelling means includes: the crusher section positioned immediately above the dewatering tower; and the transfer section positioned behind the crusher section. In the crusher section, a comb-shaped crushing blade and a fan-shaped expelling blade are arranged. Thereby, it becomes possible to obtain the same effect.

5) A gas hydrate production apparatus of the present invention is for reacting a raw gas with a raw water to thereby form a slurry gas hydrate and for removing water from the slurry gas hydrate by means of a gravitational dewatering unit. The gas hydrate production apparatus is characterized as follows. The gravitational dewatering unit includes: an introducing part from which a gas hydrate slurry is introduced; a dewatering part that removes unreacted water in the gas hydrate slurry; a cylindrical main body formed of an exhausting part that leads out the gas hydrate dewatered by the dewatering part; and a water receiving part that receives a filtrate separated from the gas hydrate by the dewatering part. The dewatering part is washed by raising and lowering a liquid surface in the water receiving part. This makes it possible to prevent in advance the clogging of a metal mesh or porous plate constituting the dewatering part. As a result, it becomes possible to stably operate the dewatering unit, and to carry out an operation at a constant dewatering rate.

6) A gas hydrate production apparatus of the present invention is for reacting a raw gas with a raw water to thereby form a slurry gas hydrate and for removing water from the slurry gas hydrate by means of a gravitational dewatering unit. The gas hydrate production apparatus is characterized as follows. The gravitational dewatering unit includes: an introducing part from which a gas hydrate slurry is introduced; a dewatering part that removes unreacted water in the gas hydrate slurry; a cylindrical main body formed of an exhausting part that leads out the gas hydrate dewatered by the dewatering part; and a water receiving part that receives a filtrate separated from the gas hydrate by the dewatering part. By filling the water receiving part with clear water, the contact between the dewatering part and a raw gas is blocked.

This makes it possible to avoid a problem that water (filtrate) filtrated by the dewatering part reacts is caused to react with a raw gas to form a gas hydrate at a portion of a metal mesh or porous plate constituting the dewatering part. Thus, less clogging occurs at the metal mesh or porous plate of the dewatering part, the clogging being due to the deposition of the gas hydrate at the portion of the metal mesh or porous plate constituting the dewatering part. As a result, it becomes possible to stably operate the dewatering unit, and to carry out an operation at a constant dewatering rate.

Moreover, according to the present invention, a weir whose height is comparable to that of the dewatering part is provided in the removed-water collecting part, and clear water is supplied between the weir and the dewatering part to submerge the dewatering part always below a liquid surface. Thereby, it becomes possible to prevent the clogging at the portion of the metal mesh or porous plate constituting the dewatering part in a relatively simple way. Furthermore, according to the present invention, the removed-water collecting part is provided with a liquid-surface sensor to control a supply amount of clear water so that the dewatering part can be submerged under a liquid surface always or when the dewatering part is clogged. Thereby, it becomes possible to prevent the clogging at the portion of the metal mesh or porous plate constituting the dewatering part, and to suppress a usage amount of clear water. As a result, it becomes possible to suppress the operation cost.

7) A gas hydrate production apparatus of the present invention is for reacting a raw gas with a raw water to thereby form a slurry gas hydrate and for removing water from the slurry gas hydrate by means of a gravitational dewatering unit. The gas hydrate production apparatus is characterized as follows. The gravitational dewatering unit includes: an introducing part from which a gas hydrate slurry is introduced; a dewatering part that removes unreacted water in the gas hydrate slurry; a cylindrical main body formed of an exhausting part that leads out the gas hydrate dewatered by the dewatering part; and a water receiving part that receives a filtrate separated from the gas hydrate by the dewatering part. The inside of the water receiving part is heated to a predetermined temperature to prevent the clogging of the dewatering part.

This makes it possible to prevent in advance the clogging of a metal mesh or porous plate constituting the dewatering part. Thereby, it becomes possible to stably operate the dewatering unit, and to carry out an operation at a constant dewatering rate. In this respect, the temperature inside the water receiving part is preferably higher than the equilibrium temperature of the gas hydrate.

8) A gas hydrate production apparatus of the present invention includes: a pressure-tolerable container; and a stirring blade at an inner lower portion of the pressure-tolerable container, and is for supplying a hydrate-forming gas in an bubble form to water in the pressure-tolerable container to thereby form a gas hydrate. The gas hydrate production apparatus is characterized as follows. The gas hydrate production apparatus includes: a upward-conveying unit which conveys the formed gas hydrate upward while bringing the gas hydrate into contact with a side surface of the pressure-tolerable container; and a discharging unit that has a discharge path whose one end is opened at an inner surface of the pressure-tolerable container, and a discharging feeder installed in the discharge path. The gas hydrate production apparatus further includes a discharging blade which introduces the gas hydrate conveyed by the upward-conveying unit into the discharge path. The upward-conveying unit rotates a convey path formed of a belt-like spiral body along the inner surface of the pressure-tolerable container with a vertical direction in the pressure-tolerable container serving as a rotation shaft direction.

According to this, the gas hydrate formation apparatus includes the pressure-tolerable container and the stirring blade at the inner lower portion of the pressure-tolerable container, and is for supplying a hydrate-forming gas in an bubble form to water, with the inside of the pressure-tolerable container being under predetermined pressure and temperature conditions, and thereby a gas hydrate if formed. The gas hydrate formation apparatus includes: the upward-conveying unit which conveys the formed gas hydrate upward while bringing the gas hydrate into contact with and along the inner surface of the pressure-tolerable container; and the discharging unit that has the discharge path whose one end is opened at the inner surface of the pressure-tolerable container, and the discharging feeder installed in the discharge path. The gas hydrate production apparatus further includes the discharging blade which introduces the gas hydrate conveyed by the upward-conveying unit into the discharge path, and which rotates with the vertical direction serving as the rotation shaft direction. The upward-conveying unit rotates the convey path formed of the belt-like spiral body along the inner surface of the pressure-tolerable container with the vertical direction in the pressure-tolerable container serving as the rotation shaft direction. An outer cylindrical container is no longer necessary, and a gas hydrate can be formed and discharged with the single pressure-tolerable container. The equipment is simplified, accomplishing significant cost reduction.

Moreover, the formed gas hydrate is conveyed upward along, while being brought into contact with, the inner surface of the pressure-tolerable container by the convey path formed of the belt-like spiral body. Accordingly, the gas hydrate is not firmly adhered on the inner surface of the pressure-tolerable container, and can be smoothly discharged, while the gravity during the conveying causes adhered water to fall to conduct dewatering. Moreover, the gas hydrate conveyed upward is introduced toward the opening part of the discharge path at the inner surface by the rotating discharging blade, and can be discharged smoothly by the discharging feeder in the discharge path. In this respect, it is preferable to dispose, above the discharging blade, a regulator that regulates the upward movement of the gas hydrate while having the air permeability. Moreover, the regulator is preferably a rotating disk fixed to a rotation shaft of the discharging blade. Furthermore, the discharge path is preferably provided in multiple.

9) A gas hydrate production apparatus of the present invention is for reacting a raw gas with water in a pressure-tolerable container to thereby form a gas hydrate. The gas hydrate production apparatus is characterized in that gas-hydrate scraping means is rotatably disposed in the pressure-tolerable container, and that, in the gas-hydrate scraping means, a ribbon-form scraping blade is spirally provided along an inner wall surface of pressure-tolerable container. According to this, the gas hydrate can be smoothly transferred upward in the pressure-tolerable container, while being mounted on the ribbon-form scraping blade. Moreover, according to this invention, when the gas hydrate is scooped by the ribbon-form scraping blade, water that exists among gas-hydrate particles flows down along the ribbon-form scraping blade. Thereby, a gas hydrate having a low water content is obtained.

Additionally, in this invention, a flexible spatulate body is mounted on the scraping blade. This makes it easy to the scooping of the gas hydrate on the ribbon-form scraping blade. A gas hydrate has a property to adhere on the inner wall surface of the container, and thus it is easy to scrape off the gas hydrate onto the blade. Moreover, in this invention, a gas-hydrate turning part facing to an upper edge part of the scraping blade is provided inside the pressure-tolerable container. Thereby, the gas-hydrate turning part makes it possible to certainly expel the gas hydrate on the scraping blade. Furthermore, in this invention, a gas-hydrate expelling opening which corresponds to the gas-hydrate turning part, is provided to a side surface of the pressure-tolerable container. Thereby, it is made possible to certainly discharge the gas hydrate expelled by the gas-hydrate turning part, through the gas-hydrate expelling opening In addition, in this invention, a degassing pipe is provided in the pressure-tolerable container, and a raw gas that exists within gaps of the gas hydrate is discharged outside the pressure-tolerable container through the degassing pipe. Thus, a smaller amount of the raw gas exists within the gaps of the gas hydrate, and thereby it becomes possible to transfer the gas hydrate having a higher density. Moreover, in this invention, a dewatering part is provided to a side surface of the pressure-tolerable container, making it possible to dewater the gas hydrate from the dewatering part, also, and to further reduce the water content of the gas hydrate. Furthermore, in this invention, fine grooves in a longitudinal direction are provided in the inner wall surface of the pressure-tolerable container. This makes it possible to prevent the adherence of the gas hydrate, since the raw gas flows along the fine grooves. Still furthermore, in this invention, the pressure-tolerable container and the gas hydrate scraping means are tapered such that their diameters are gradually made smaller toward the top. Thereby, the gas hydrate mounted on the ribbon-form scraping blade is pushed to the pressure-tolerable container, enabling the gas hydrate to have a higher density.

10) A gravitational-dewatering type dewatering unit of the present invention is for introducing a gas hydrate formed by reacting a gas with water into a dewatering tower together with unreacted water, for elevating the gas hydrate upward from the bottom of the dewatering tower, and for causing the unreacted water to flow, during the elevation, outside the dewatering tower through a filtration part provided to a side wall surface of the tower. The gravitational-dewatering type dewatering unit is characterized as follows. The dewatering tower is a dewatering tower having a double cylindrical structure formed of two cylindrical bodies of: an inner cylinder and an outer cylinder. Filtration bodies for dewatering are provided to both side wall surfaces of the inner cylinder and the outer cylinder, respectively, and the unreacted water flows outside the tower through the two filtration bodies of the filtration body provided to the inner cylinder and the filtration body provided to the outer cylinder.

According to this, even if a cross-sectional area A of the dewatering tower of the present invention is the same as a cross-sectional area A of a conventional cylindrical dewatering tower, an interval W between the two inner and outer cylinders of the dewatering tower is $(D_0-D_1)/2$ in the present invention. The interval W between the two inner and outer cylinders of the dewatering tower is significantly reduced in comparison with that in the conventional technique (see FIG. 42). For example, suppose a plant of 2.4 T/D, and concurrently suppose that: the diameter $D_0$ of the outer cylinder is 14.04 (m). In this case, the diameter $D_1$ of the inner cylinder becomes 7.02 (m), and the interval W $(=(D_0-D_1)/2)$ between the two inner and outer cylinders of the dewatering tower is approximately 3.5 (m).

Thus, while the diameter. D of the conventional cylindrical dewatering tower is approximately 12 (m), the interval W between the inner cylinder and the outer cylinder of the dewatering tower having the double cylindrical structure in the present invention is approximately 3.5 (m). Accordingly, the dewatering tower having the double cylindrical structure in the present invention is for smooth dewatering in comparison with the conventional cylindrical dewatering tower. As a result, it becomes possible to suppress the height of the cylinder constituting the dewatering tower to thereby attempt to reduce the construction cost, running cost, and the like, while maintaining the level of treatment amount of the dewatering tower to be that of the conventional dewatering tower.

Moreover, this gravitational-dewatering type dewatering unit is for introducing a gas hydrate formed by reacting a gas with water into a dewatering tower together with unreacted water, for elevating the gas hydrate upward from the bottom of the dewatering tower, and for causing the unreacted water to flow, during the elevation, outside the dewatering tower through a filtration part provided to a side wall surface of the tower. The dewatering tower having a double cylindrical structure in which filtration bodies for dewatering are provided to both side wall surfaces of inner and outer cylinders, respectively, is built in a pressure-tolerable container. A cylindrical gas-hydrate input part is provided in a cavity in the center of the dewatering tower, and a drainage tank is formed between the gas-hydrate input part and the pressure-tolerable container. Furthermore, a crushing unit for crushing a gas hydrate is provided in the gas-hydrate input part. A gas-hydrate discharging unit is provided below the gas-hydrate input part. A scraper is rotatably provided above the dewatering tower. Furthermore, a slurry-supplying pipe is provided to a lower portion of the dewatering tower. A drainage pipe is provided to the drainage tank. Thereby, in addition to the already-described effects, it becomes possible to smoothly send the gas hydrate after dewatering with use of the scraper above the dewatering tower and the gas-hydrate discharging unit below the gas-hydrate input part.

Moreover, in this invention, the crushing unit and the scraper are attached to the common rotation shaft. Thereby, the number of components can be reduced. Furthermore, in this invention, a screw feeder is employed as the gas-hydrate discharging unit. Thereby, it becomes possible to smoothly transfer the gas hydrate after dewatering.

11) A gas-hydrate dewatering unit of the present invention includes: a outer cylinder; a cylindrical dewatering screen provided inside the outer cylinder; a cylindrical container extending to one end of the dewatering screen; a rotation shaft inserted into the dewatering screen and the cylindrical container; a screw blade provided to an outer periphery of the rotation shaft in the dewatering screen; a blade provided to an outer periphery of the rotation shaft in the cylindrical container; a gas-hydrate-slurry supplying inlet inserted into the other end of the dewatering screen; a water-discharging outlet provided to the outer cylinder; a gas-supplying inlet through which a raw gas of a gas hydrate is supplied into the cylindrical container; a gas-hydrate-discharging outlet provided to the other end of the cylindrical container; and a flow path through which a cooling medium to cool the gas hydrate and the raw gas in the cylindrical container, flows back.

According to this, a gas hydrate slurry introduced through the supplying inlet, firstly, passes through a groove space of the screw blade by rotating the rotation shaft, and conveyed in an axial direction. At the same time, the gas hydrate slurry is compressed, and this compression causes its water to effectively pass through the dewatering screen, and thus the water is separated. This separated water flows from the dewatering screen to the outer cylinder side, and discharged from the discharging outlet. Subsequently, the gas hydrate introduced into the cylindrical container is stirred in the container by the rotation of the blade, and the raw gas introduced through the gas-supplying inlet comes into contact with water adhered to the gas hydrate to cause hydration reaction to proceed, and dewatering is conducted. In this respect, although the hydration reaction releases heat, the temperature range suited for the hydration reaction in the cylindrical container is maintained because the heat recovery is conducted by the cooling medium flowing through the flow path.

Specifically, according to the present invention, since the gas hydrate slurry after physical dewatering is continuously subjected to hydration dewatering, the dewatering rate can be increased in comparison with the conventional physical dewatering. Thereby, a wider option for hydration dewatering becomes available. Thus, for example, the fluidized-bed dewatering in the subsequent step can be conducted without any trouble, and a high dewatering rate can be obtained. In this case, a gap between the inner peripheral surface of the dewatering screen and the rotation shaft is preferably formed to be smaller toward a transfer direction of the gas hydrate. According to this, the gas hydrate slurry can be further compressed while being conveyed in the axial direction. Therefore, the physical dewatering efficiency can be improved. Moreover, the blade in the cylindrical container for the hydration reaction is formed into a gate form, and leg parts thereof are attached in the axial direction of the rotation shaft. Thereby, functions as the stirring blade and the like can be exerted. Thus, according to the present invention, the dewatering rate of the gas hydrate slurry by the screw-press type physical dewatering can be improved. In this respect, the gap between the inner peripheral surface of the dewatering screen and the rotation shaft is preferably formed to be smaller toward the transfer direction of the gas hydrate. Furthermore, it is preferable that the blade be formed into a gate form, and that leg parts thereof be attached in the axial direction of the rotation shaft.

BEST MODES FOR CARRYING OUT THE INVENTION

Hereinafter, embodiments of the present invention will be described by use of drawings.

1) First Embodiment

In this invention, description will be given of a case where the cross-sectional area of a second tower body is continuously or intermittently increased upward from the bottom.

Nevertheless, the same effect is obtained even when the cross-sectional areas of a dewatering part and the second tower body are continuously or intermittently increased upward from the bottom. Furthermore, the same effect is obtained even when the cross-sectional area of the dewatering part is continuously or intermittently increased upward from the bottom.

Figure 1:
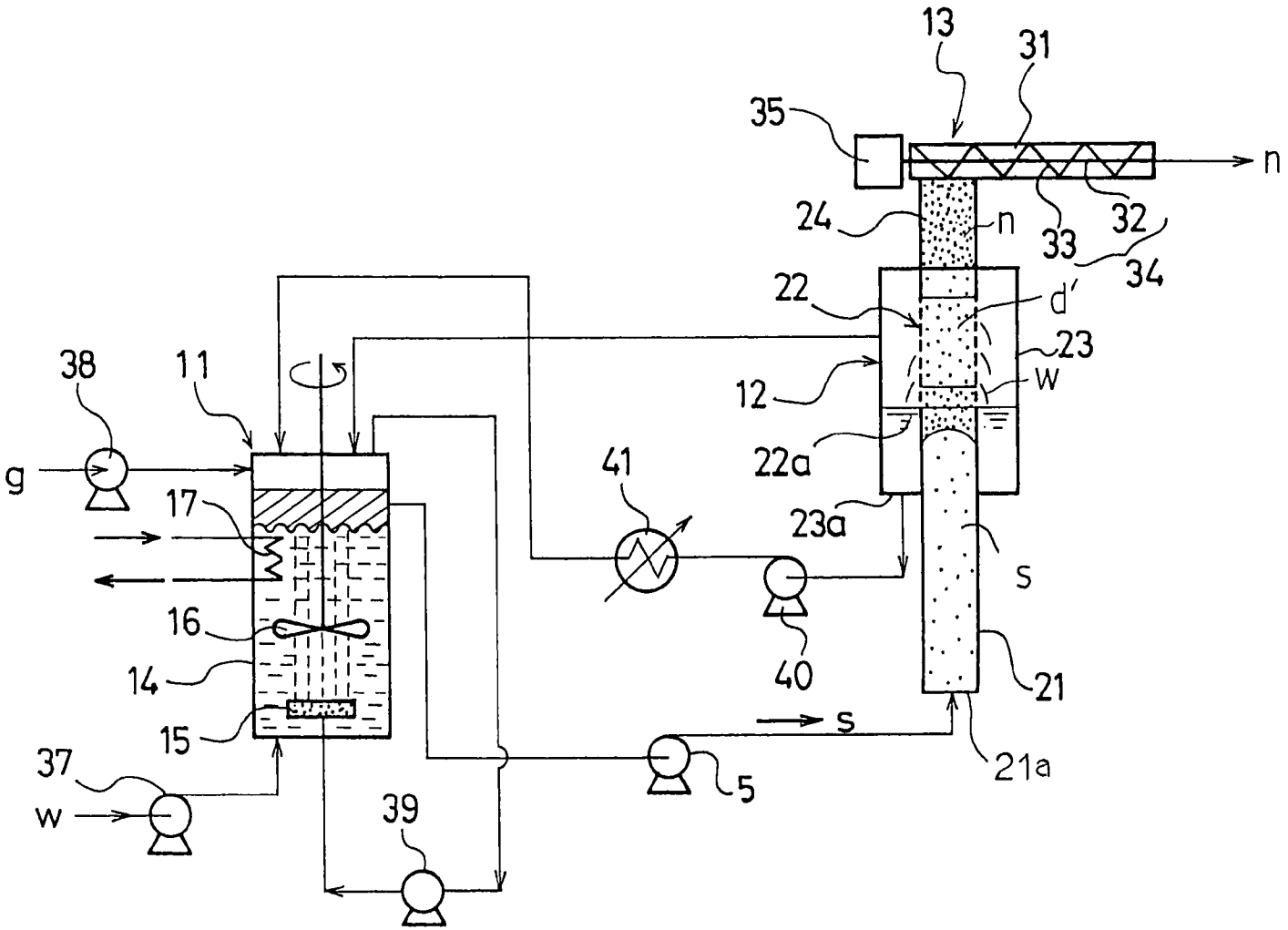
FIG. 1 is a schematic block diagram of a first embodiment of a gas hydrate production apparatus according to the present invention.

In FIG. 1, reference symbol 11 denotes a natural gas hydrate generator (hereinafter, referred to as a gas hydrate generator); reference symbol 12 denotes a gravitational dewatering tower that dewaters a slurry natural gas hydrate (hereinafter, referred to as a gas hydrate) formed in the gas hydrate generator 11; and reference symbol 13 denotes a gas-hydrate conveying unit that laterally transfers, to the subsequent step (unillustrated), the gas hydrate almost dewatered in the gravitational dewatering tower 12. The gas hydrate generator 11 includes: a pressure-tolerable container 14; a gas-jetting nozzle 15 that jets natural gas in a form of fine bubbles; a stirrer 16 that stirs objects to be treated, namely natural gas g, water w, additionally a gas hydrate, and the like, in the pressure-tolerable container 14; and a reaction-heat-removing heat-transfer part 17.

The gravitational dewatering tower 12 is formed of: a cylindrical first tower body 21; a cylindrical dewatering part 22 disposed on top of the first tower body 21 and having innumerable minute holes; a racket-like water receiving part 23 disposed outside the dewatering part 22; and a cylindrical second tower body 24 disposed on top of the dewatering part 22. A bottom part 23*a* of the water receiving part 23 is disposed below a lower edge part 22*a* of the dewatering part 22, and is to discharge water (unreacted water) that is removed by the dewatering part 22. It is only necessary for the dewatering part 22 to separate a gas hydrate and water (untreated water) from each other, and the dewatering part 22 is not particularly limited. However, the dewatering part 22 preferably used is a metal mesh or a cylinder with holes. The diameter of the holes of the metal mesh or the cylinder is preferably in a range from 0.1 mm to 5.0 mm. When the hole of the metal mesh is less than 0.1 mm, clogging is likely to occur. Meanwhile, when the diameter of the hole of the metal mesh or the cylinder with holes is more than 5 mm, a gas hydrate is likely to flow out from the holes of the metal mesh, and accordingly the yield is lowered.

Figure 2:
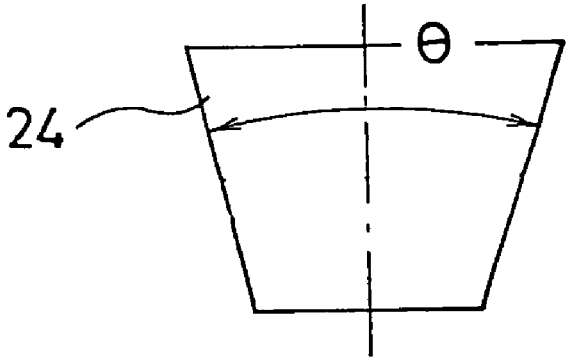
FIG. 2 is a cross-sectional view of a second tower body of an inverted conical form.

In this invention, the second tower body 24 disposed on top of the dewatering part 22 has an inverted conical form. To put it another way, the cross-sectional area of the second tower body 24 is continuously increased upward from the bottom, and thus the resistance to gas-hydrate movement after dewatering is attempted to be reduced. In this respect, the opening angle θ of the second tower body 24 is preferably in a range from 1° to 30°, particularly 2° to 20° (see FIG. 2). When the opening angle θ is less than 1°, there is resistance to gas-hydrate movement, causing the following problems. Specifically, the ejection pressure of a slurry pump 5 that conveys a gas hydrate slurry to the dewatering unit 12 is caused to increase; the dewatering unit 12 is clogged by a gas-hydrate particle layer; or, the liquid surface is caused to elevate, resulting in an insufficient dewatering. In contrast to this, when the opening angle θ is more than 30°, the pushing force of a gas-hydrate particle layer is decreased, making it difficult to transfer the gas-hydrate particle layer.

Figure 3:
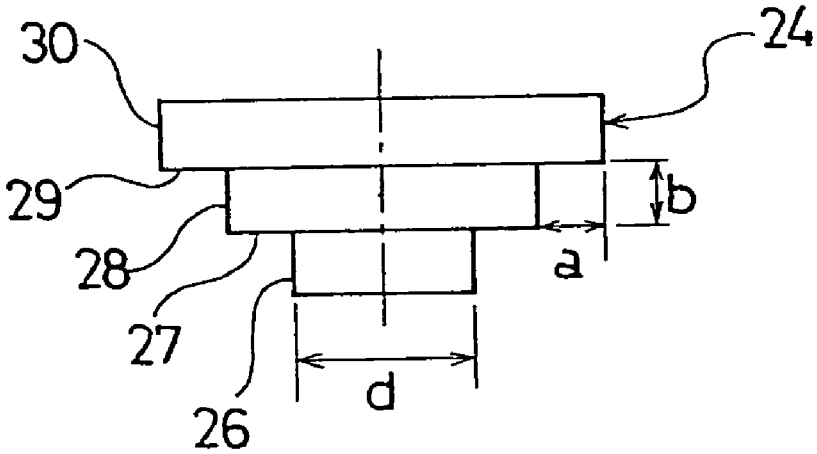
FIG. 3 is a cross-sectional view of the second tower body of a stepped form.

Even if the second tower body 24 has a stepped form (stairway form) as shown in FIG. 3, instead of the inverted conical form, this makes no difference. In other words, the cross-sectional area of the second tower body 24 is set to be intermittently increased upward from the bottom, and a=(⅕ to 1/100) and b/a=2 to 120 are set to be satisfied, where a is the width of the stepped portion, b is the height of the stepped portion, and d is the diameter of the lowest portion of the tower.

To describe more specifically, the second tower body 24 is formed of: a first circle 26 whose diameter is the same as that of the first tower body 21; a first ring part 27 fixed on the upper edge of the first circle 26; a second circle 28 standing upright on the outer peripheral surface of the ring part 27; a second ring part 29 fixed on the upper edge of the second circle 28; and a third circle 30 standing upright on the outer peripheral surface of the ring part 29. The gas-hydrate conveying unit 13 is formed of: a lateral cylindrical body 31; and a screw-form transfer body 34 that has a spirally protruded part 33 on the side surface of an axial body 32. The gas-hydrate conveying unit 13 is to rotate the axial body 32 by a motor 35. In the drawing, reference symbol 37 denotes a raw-water supplying pump; reference symbol 38 denotes a raw-gas (natural gas) supplying pump; reference symbol 39 denotes a circulating-gas blower; reference symbol 40 denotes a circulating-water pump; and reference symbol 41 denotes a circulating-water cooling unit.

Next, an operation of the gas hydrate production apparatus will be described. A raw water (water) w supplied into the pressure-tolerable container 14 by the raw-water supplying pump 37 is cooled to a predetermined temperature (for example, 1° C. to 3° C.) by a coolant supplied to the reaction-heat-removing heat-transfer part 17. Subsequently, while the raw water w in the pressure-tolerable container 14 is being stirred by driving the stirrer 16, a raw gas (natural gas) g of a predetermined pressure (for example, 5 MPa) is supplied thereto by the raw-gas supplying pump 38. Then, the natural gas g rises up as fine bubbles from the gas-jetting nozzle 15, and reacts with the water w before reaching the water surface. Thereby, a gas hydrate is formed.

The gas hydrate in the pressure-tolerable container 14 is in a slurry form under the water surface (the concentration of the gas hydrate at this point is approximately 20%). Thus, the gas hydrate is supplied to the gravitational dewatering tower 12 by the slurry pump 5. The gas hydrate slurry s supplied to a bottom part 21*a* of the first tower body 21 in the gravitational dewatering tower 12 elevates within the first tower body 21, and water w flows out of the metal mesh constituting the dewatering part 22. When the water w flows out of the dewatering part 22, a gas hydrate n is left on top of the tower. The gas hydrate n also accumulates to a portion of the dewatering part 22, forming a hydrate layer bed d'. Then, when passing through the hydrate layer bed d', water (water that accompanies a gas hydrate) pushes the hydrate layer bed d' upward. Thereby, it is possible to continuously take out the dewatered hydrate layer bed d' from the top part of the tower (second tower part 24). The concentration of the gas hydrate at this time is approximately 50%.

The gas hydrate n that has reached the second tower part 24 is continuously transferred to the unillustrated subsequent step by the screw-form transfer body 34 in the gas-hydrate transferring unit 13. The separated unreacted water in the jacket-like water receiving part 23 returns to the pressure-tolerable container 14 by the circulating-water pump 40. At this point, the returned water w is cooled to a predetermined temperature by the circulating-water cooling unit 41.

2) Second Embodiment

Figure 4:
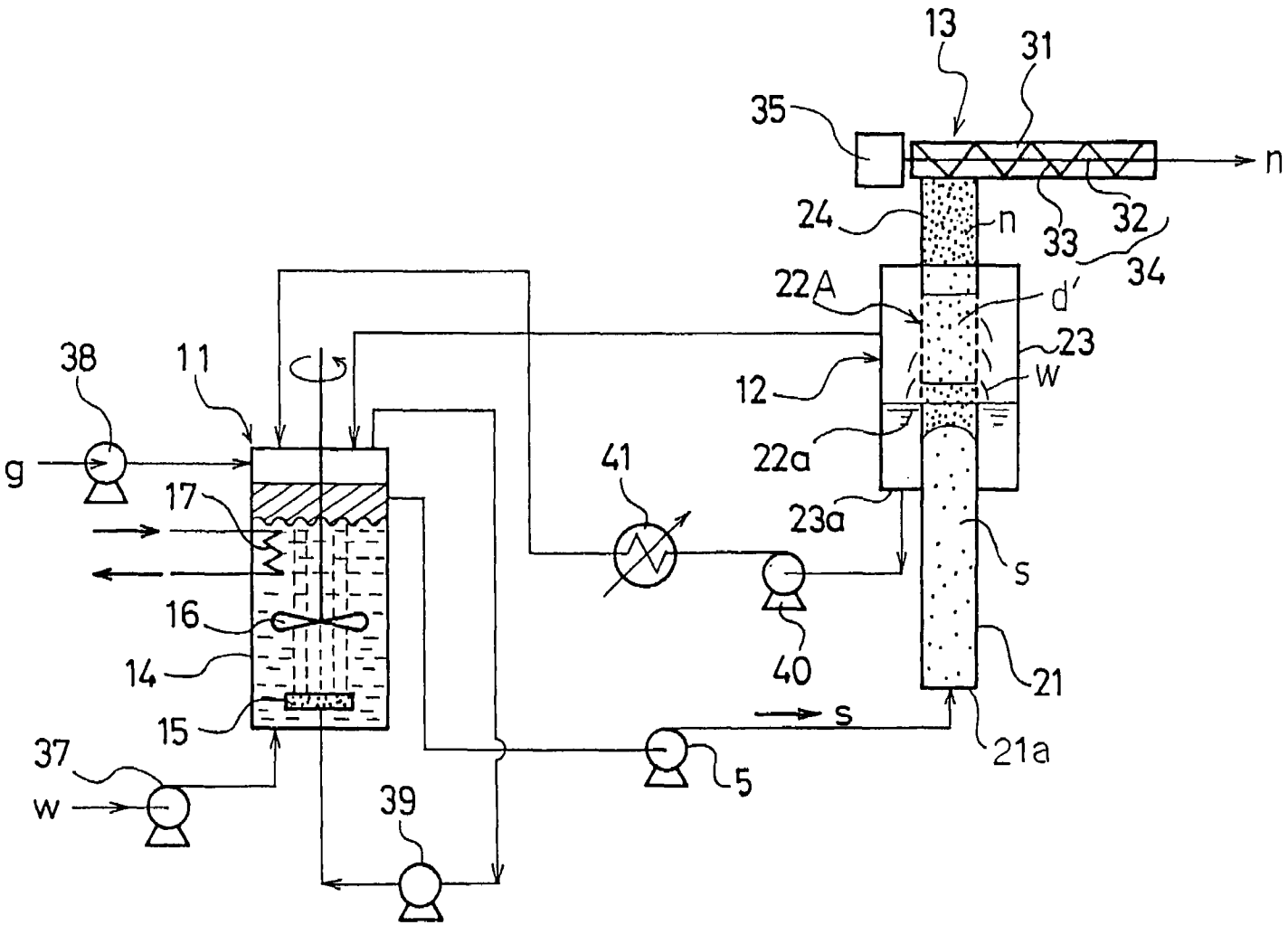
FIG. 4 is a schematic block diagram of a second embodiment of the gas hydrate production apparatus according to the present invention.

In FIG. 4, reference symbol 11 denotes a natural gas hydrate generator (hereinafter, referred to as a gas hydrate generator); reference symbol 12 denotes a gravitational dewatering tower that dewaters a slurry natural gas hydrate (hereinafter, referred to as a gas hydrate) formed in the gas hydrate generator 11; and reference symbol 13 denotes a gas-hydrate conveying unit that laterally transfers, to the subsequent step (unillustrated), the gas hydrate almost dewatered in the gravitational dewatering tower 12. The gas hydrate generator 11 includes: a pressure-tolerable container 14; a gas-jetting nozzle 15 that jets natural gas in a form of fine bubbles; a stirrer 16 that stirs objects to be treated, namely natural gas g, water w, additionally a gas hydrate, and the like, in the pressure-tolerable container 14; and a reaction-heat-removing heat-transfer part 17.

Figure 5:
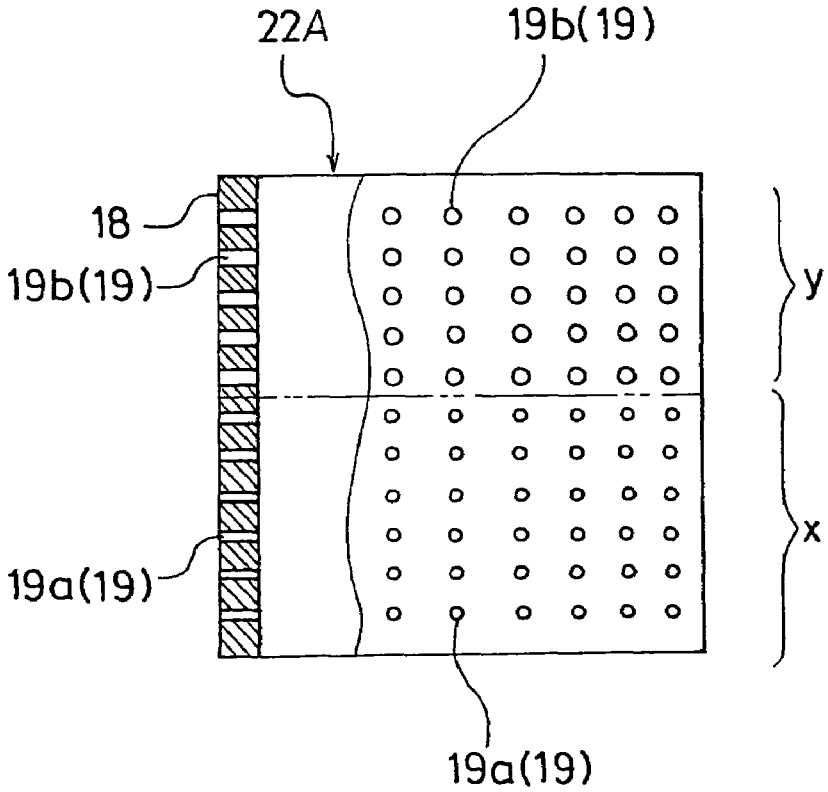
FIG. 5 is a side view including a partial cross section of a dewatering part.

The gravitational dewatering tower 12 is formed of: a cylindrical first tower body 21; a cylindrical dewatering part 22A disposed on top of the first tower body 21 and having innumerable minute holes; a jacket-like water receiving part 23 disposed outside the dewatering part 22A; and a cylindrical second tower body 24 disposed on top of the dewatering part 22A. A bottom part 23*a* of the water receiving part 23 is disposed below a lower edge part 22*a* of the dewatering part 22A, and, is to discharge water (unreacted water) that is removed by the dewatering part 22A. As shown in FIG. 5, the dewatering part 22A is formed of a cylindrical body 18 having a smooth inner surface with no irregularity, the cylindrical body 18 being provided with through holes 19 in a grid form.

In this case, the cylindrical body 18 is divided into two zones: upper and lower zones. The lower zone x is provided with a through hole 19*a* having a hole diameter of 0.1 mm to 5.0 mm taking the particle diameter of a gas hydrate into consideration. The upper zone y is provided with a through hole 19*b* having a hole diameter of 0.5 mm to 10.0 mm which is somewhat larger than that of the through hole 19*a*. Thereby, the friction in gas-hydrate movement is held substantially constant, although the water content of the gas hydrate is gradually lowered due to dewatering. In this respect, the number of zones to which the through holes 19 is provided is not limited to two as in the above case, and the number of zones may be more than two. Meanwhile, the hole diameters of the through holes 19 may be continuously enlarged upward from the bottom of the cylindrical body 18, as an alternative way of changing the hole diameters of the through holes 19 in the respective zones. Meanwhile, the through holes 19 may be arranged in, for example, a zigzag form instead of arranging the through holes 19 in a grid form. Meanwhile, the pitch of the through holes 19*a* in the lower zone x is preferably from approximately 1.0 mm to 10.0 mm, and the pitch of the through holes 19*b* in the upper zone y is preferably from approximately 2.0 mm to 20.0 mm.

The gas-hydrate conveying unit 13 is formed of: a lateral cylindrical body 31; and a screw-form transfer body 34 that has a spirally protruded part 33 on the side surface of an axial body 32. The gas-hydrate conveying unit 13 is to rotate the axial body 32 by a motor 35. In the drawing, reference symbol 37 denotes a raw-water supplying pump; reference symbol 38 denotes a raw-gas (natural gas) supplying pump; reference symbol 39 denotes a circulating-gas blower; reference symbol 40 denotes a circulating-water pump; and reference symbol 41 denotes a circulating-water cooling unit.

Next, an operation of the gas hydrate production apparatus will be described. A raw water (water) w supplied into the pressure-tolerable container 14 by the raw-water supplying pump 37 is cooled to a predetermined temperature (for example, 1° C. to 3° C.) by a coolant supplied to the reaction-heat-removing heat-transfer part 17. Subsequently, while the raw water w in the pressure-tolerable container 14 is being stirred by driving the stirrer 16, a raw gas (natural gas) g of a predetermined pressure (for example, 5 MPa) is supplied thereto by the raw-gas supplying pump 38. Then, the natural gas g rises up as fine bubbles from the gas-jetting nozzle 15, and reacts with the water w before reaching the water surface. Thereby, a solid gas hydrate is formed.

The gas hydrate in the pressure-tolerable container 14 is in a slurry form under the water surface (the concentration of the gas hydrate at this point is approximately 20%). Thus, the gas hydrate is supplied to the gravitational dewatering tower 12 by the slurry pump 5. The gas hydrate slurry s supplied to a bottom part 21*a* of the first tower body 21 in the gravitational dewatering tower 12 elevates within the first tower body 21, and only water w flows out of the through holes 19*a* and 19*b* of the cylinder body 18 constituting the dewatering part 22. When the water w flows out of the dewatering part 22A, a gas hydrate n is left on top of the tower. The gas hydrate n also accumulates to a portion of the dewatering part 22A, forming a gas hydrate layer d'. Then, when passing through the gas hydrate layer d', water (water that accompanies a gas hydrate) pushes the gas hydrate layer d' upward. Thereby, it is possible to continuously take out the deliquified gas hydrate layer d' from the top part of the tower (second tower part 24). The concentration of the gas hydrate at this time is approximately 50%.

The gas hydrate n that has reached the second tower part 24 is continuously transferred to the unillustrated subsequent step by the screw-form transfer body 34 in the gas-hydrate transferring unit 13. Unreacted water w is separated at the jacket-like removed-water collecting part 23, and returns to the pressure-tolerable container 14 by the circulating-water pump 40. At this point, the returned water w is cooled to a predetermined temperature by the circulating-water cooling unit 41.

Figure 6:
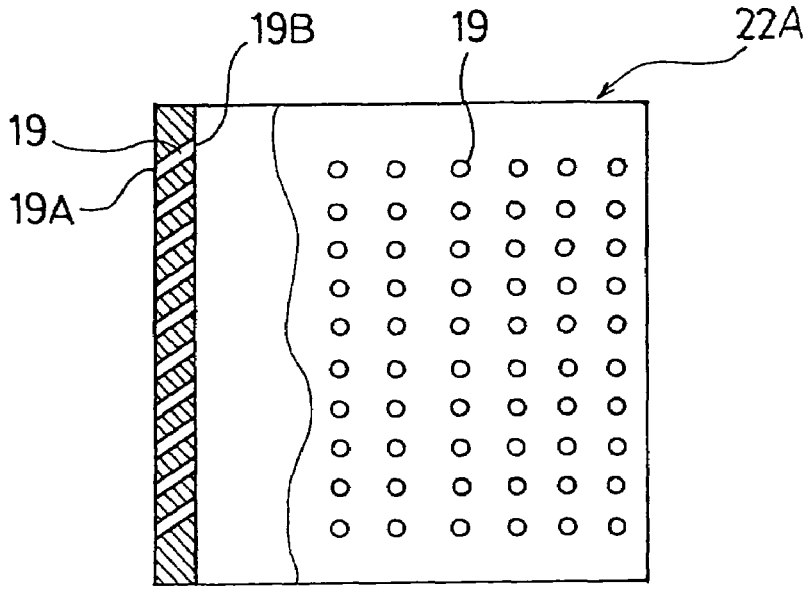
FIG. 6 is a side view including a partial cross section of a second dewatering part.

In the above description, described has been the case where the hole diameters of the through holes 19 provided to the dewatering part 22A are changed. Nevertheless, the same effect can be obtained even when the through hole 19 of the dewatering part 22A is inclined, as shown in FIG. 6, such that an outlet 19A thereof is positioned lower than an inlet 19B. In this case, it is preferable that the hole diameter of the through hole 10 be from approximately 0.1 mm to 10.0 mm, and that the pitch of the through holes 19 be from approximately 2.0 mm to 20.0 mm. The arrangement of the through holes 19 may be either in a zigzag or grid form.

Figure 7:
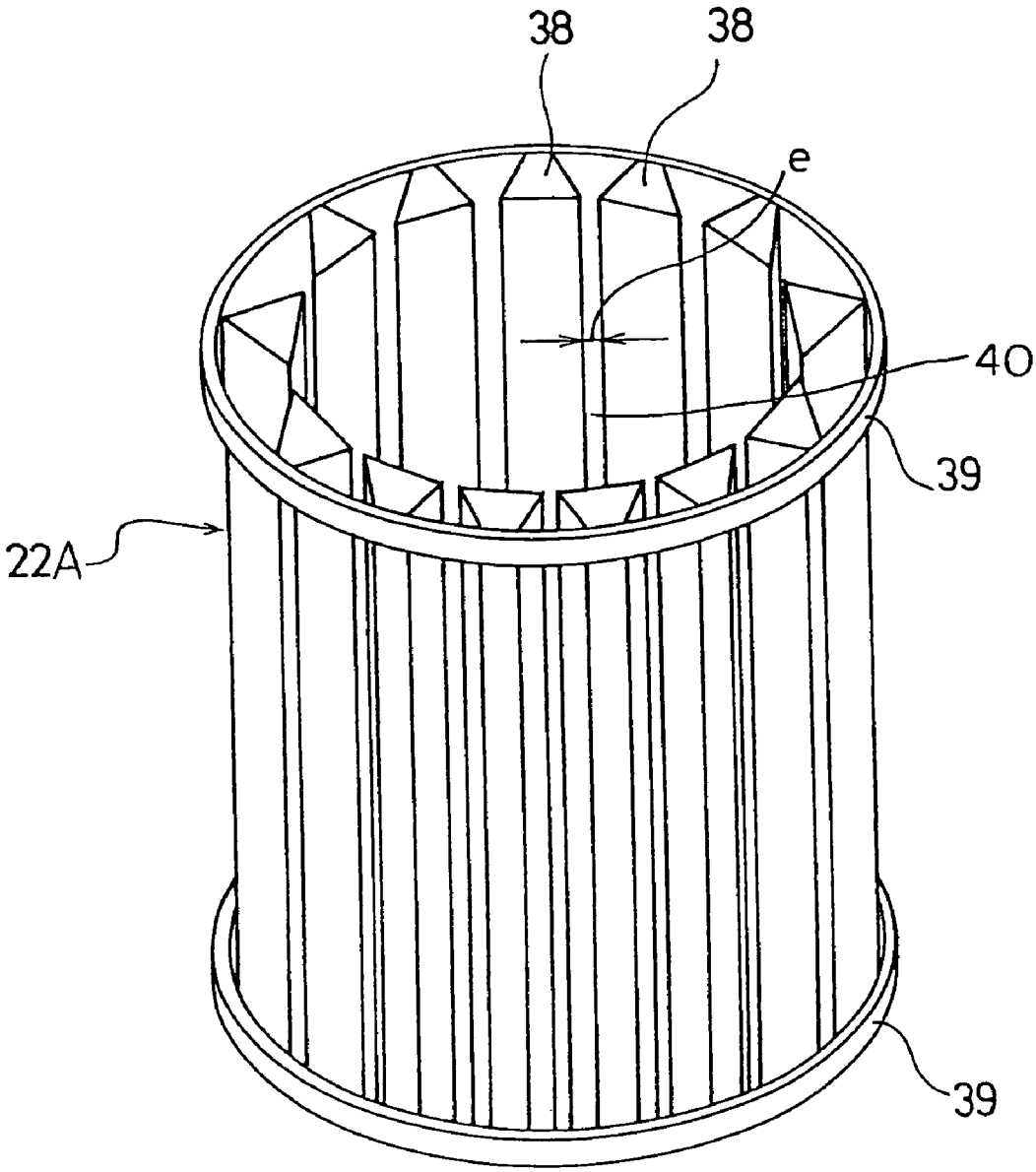
FIG. 7 is a perspective view of a third dewatering part.

On the other hand, it is possible to obtain the same effect even when the dewatering part 22A is provided with: linear bodies 38 each having a wedged lateral cross section aligned in a circumferential direction at predetermined intervals e; and slits 40 formed between the adjacent linear bodies 38, as shown in FIG. 7. In this case, the linear bodies 38 are welded to a ring-shaped supporter 39, and do not fall apart. Meanwhile, the dewatering part 22A can be formed by providing innumerable slits to a cylindrical body having a smooth inner surface with no irregularity. In this respect, the gap (slit interval) between the linear bodies 38 is preferably from 0.1 mm to 5.0 mm. Moreover, the width (interval between the slits) of the linear body 38 is preferably from 1.0 mm to 5.0 mm.

3) Third Embodiment

Figure 8:
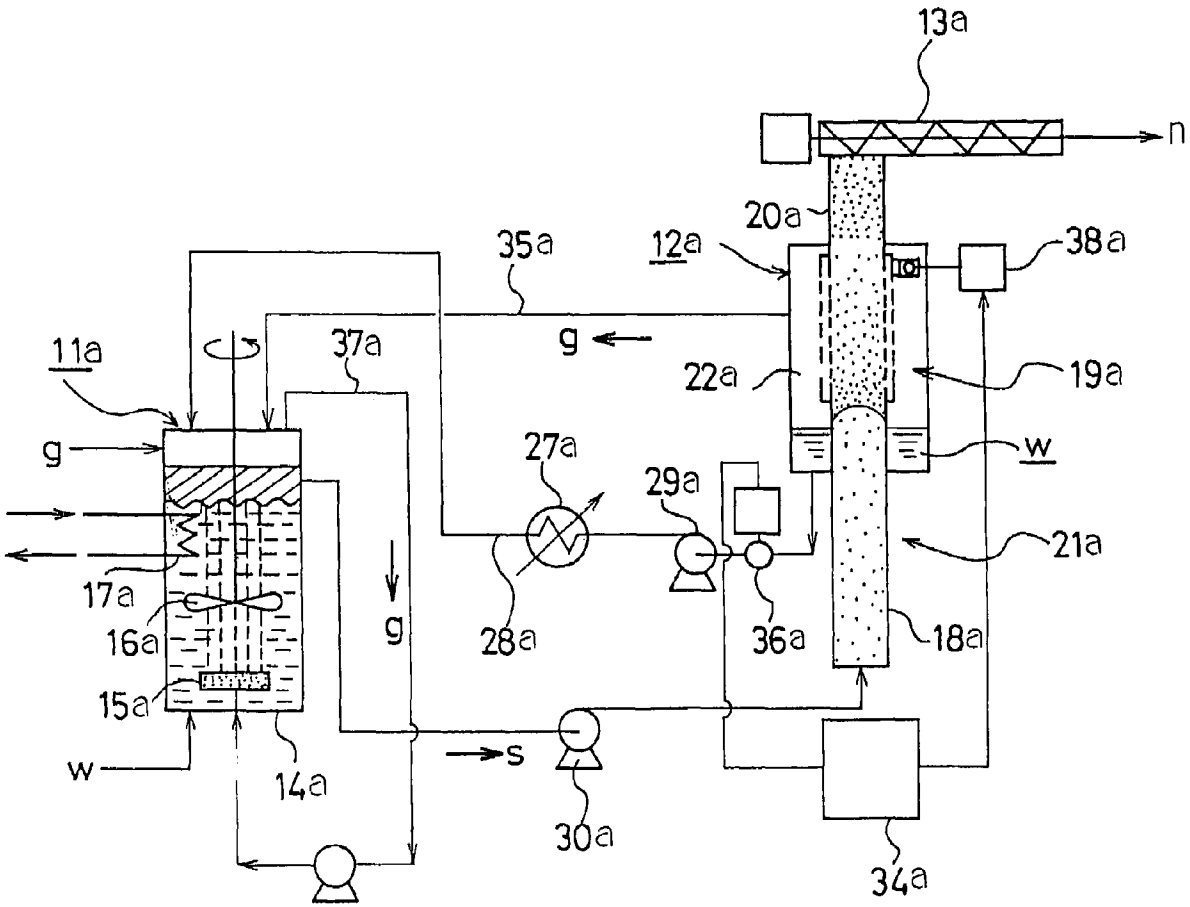
FIG. 8 is a schematic block diagram of a third embodiment of the gas hydrate production apparatus according to the present invention.

In FIG. 8, reference symbol 11*a* denotes a gas hydrate generator; reference symbol 12*a* denotes a gravitational dewatering tower that dewaters a slurry gas hydrate n formed in the gas hydrate generator 11*a*; and reference symbol 13*a* denotes a gas-hydrate conveying unit that laterally transfers, to the subsequent step (unillustrated), the gas hydrate n almost dewatered in the dewatering unit 12*a*. The gas hydrate generator 11*a* includes: a pressure-tolerable container 14*a*; a sparger 15*a* that jets natural gas g, which is a raw gas, in a form of bubbles; a stirrer 16*a* that stirs inside the pressure-tolerable container 14*a*; and a cooling unit 17*a*. The gravitational dewatering tower 12*a* is formed of: an introducing part 18*a* from which a gas hydrate slurry is introduced; a dewatering part 19*a* that removes water w in the gas hydrate slurry; a longitudinal cylindrical main body 21*a* constituted of an exhausting part 20*a* that leads out the gas hydrate n dewatered by the dewatering part 19*a*; and a removed-water collecting part 22*a* to which water (filtrate) w filtered by the dewatering part 19*a* is collected.

Figure 9:
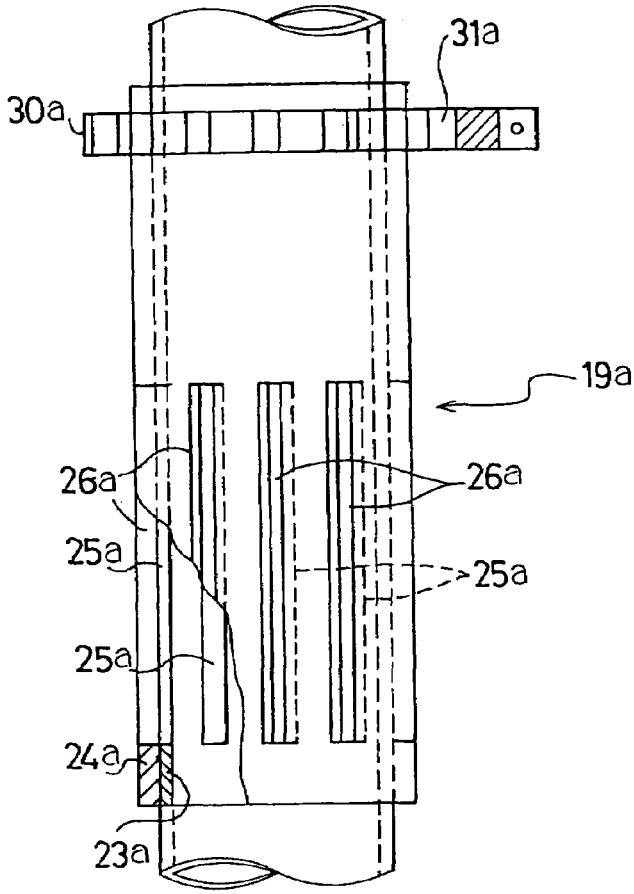
FIG. 9 is a side view including a partial cross section of a dewatering part.
Figure 10:
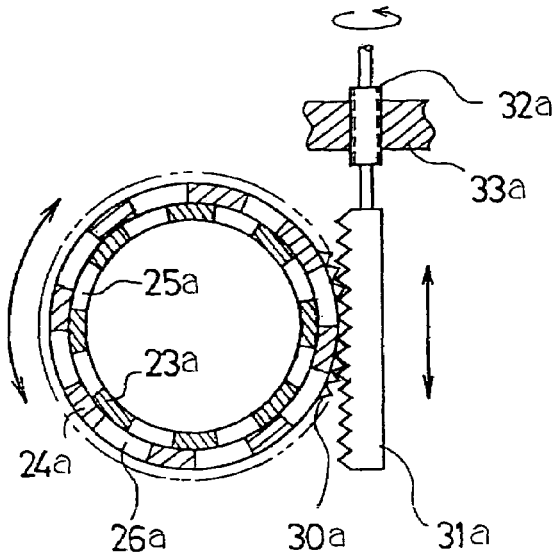
FIG. 10 is a cross-sectional view of a chief part of the dewatering part.
Figure 11:
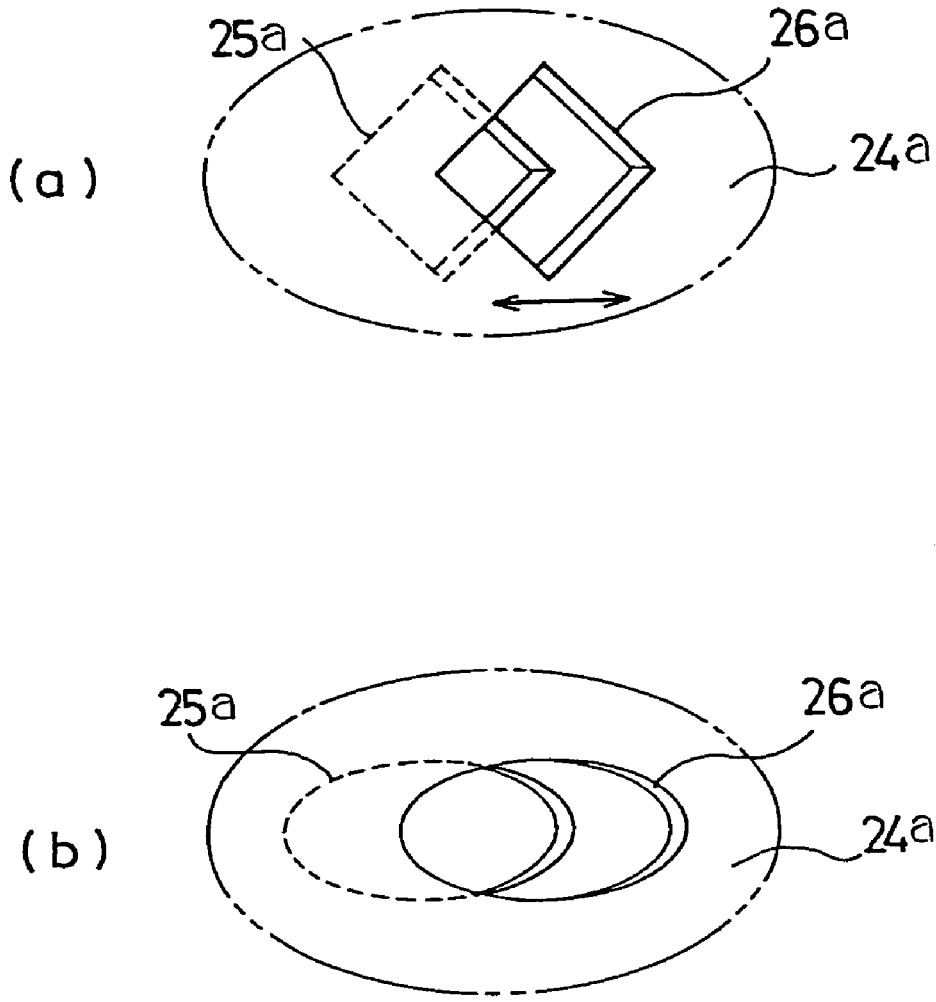
FIG. 11(*a*) is a front view of a rhomboidal opening, and FIG. 11(*b*) is a front view of an elliptic opening.

As apparent from FIGS. 9 and 10, the dewatering part 19*a* has a double structure of an inner cylindrical part 23*a* and an outer cylindrical part 24*a*. The inner cylindrical part 24*a* is provided with longitudinally long slits (first opening parts) 25*a* at equal intervals. Meanwhile, the outer cylindrical part 24*a* is provided with longitudinally long slits (second opening parts) 26*a* that correspond to the slits 25*a* of the inner cylindrical part 23*a*. The width of the slit 25*a* of the inner cylindrical part 23*a* is preferably from, for example, 5 mm to 50 mm. Meanwhile, the width of the slit 26*a* of the outer cylindrical part 24*a* is preferably from, for example, 10 mm to 60 mm. Examples of the form of the opening parts include a rhombus as shown in FIG. 11(*a*), an ellipse as shown in FIG. 11(*b*), and so on.

The outer cylindrical part 24*a* is provided with a gear 30*a* along its outer periphery, and rotates in a circumferential direction with the inner cylindrical part 23*a* as an axis by the front and back movements of a rack 31*a* that engages with the gear 30*a*. The rack 31*a* is caused to move front and back by rotating, with an unillustrated handle, a screw shaft 32*a* attached to the rack 31*a*, as shown in FIG. 10. In this case, the screw shaft 32*a* screws a fixed internal thread part 33*a*. The removed-water collecting part 22*a* is disposed outside the dewatering part 19*a* so that the removed-water collecting part 22*a* can be concentric with the longitudinal cylindrical main body 21*a*.

Furthermore, a gas hydrate formed in the gas hydrate generator 11*a* is supplied to the gravitational dewatering tower 12*a* in a modified slurry form. Unreacted water (filtrate) w filtered by the dewatering part 19*a* is returned to the gas hydrate generator 11*a* via a return line 28*a* provided with a pump 29*a* and a cooling unit 27*a*. A raw gas g in the removed-water collecting part 22*a* is returned to the gas hydrate generator 11*a* via a return line 35*a*. A raw gas g in the gas hydrate generator 11*a* is returned to the sparger 15*a* via a circulation line 37*a*. Moreover, a flowmeter 36*a* is provided just in front of the pump 29*a* of the return line 28*a*, and measures a returned amount of unreacted water (filtrate) w. The returned amount of this unreacted water (filtrate) w is inputted into a control unit 34*a*. When a water amount falls below a reference value, a motor 38*a* is controlled according to the degree of the fall. Thereby, the outer cylindrical part 24*a* is rotated, thus widening the opening width of the slits 25*a* provided to the inner cylindrical part 23*a*.

Next, a gas hydrate production method will be described. As shown in FIG. 8, a gas hydrate n formed in the gas hydrate generator 11*a* is in a slurry form, having a gas-hydrate concentration of approximately 20%. This gas hydrate slurry is supplied into the introducing part 18*a* by the slurry pump 30*a*, the introducing part 18*a* being the lower edge part of the gravitational dewatering tower 12*a*. Then, the gas hydrate slurry s is dewatered by the dewatering part 19*a* of the dewatering unit 12*a*. A gas hydrate n that comes to have a water content of approximately 50% is transferred to the subsequent step via the exhausting part 20*a* by the gas hydrate discharging unit 13*a*.

Water (filtrate) w removed by the dewatering part 19*a* of the dewatering unit 12*a* is returned to the gas hydrate generator 11*a* via the return line 28*a*. When a returned amount of the unreacted water (filtrate) w returning via the return line 28*a* falls below a set value, the controller 34*a* determines that the dewatering part 19*a* has been clogged. According to the degree of the clogging, the motor 38*a* is controlled. Thereby, the outer cylindrical part 24*a* is rotated, widening the opening width of the slits 25*a* provided to the inner cylindrical part 23*a*.

Figure 12:
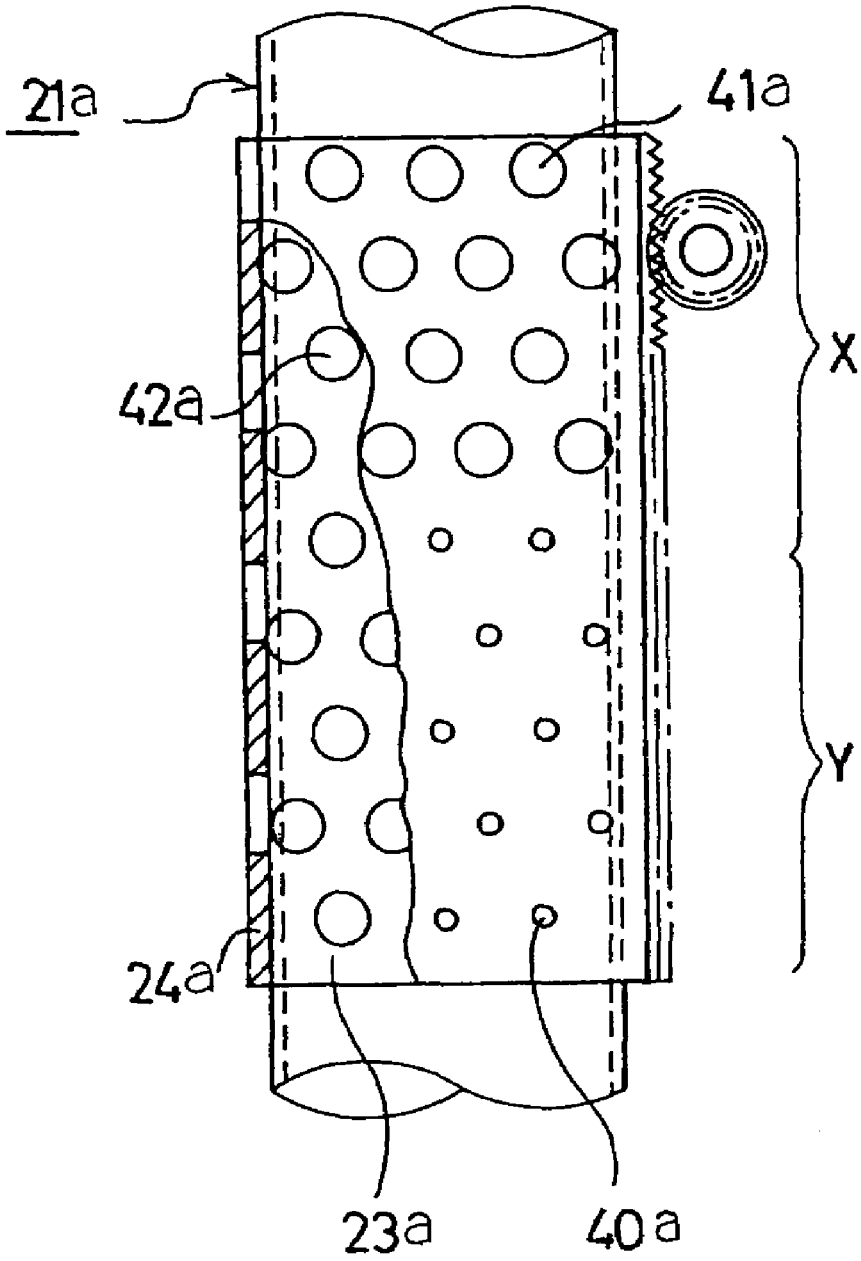
FIG. 12 is a side view including a partial cross section of another embodiment of the dewatering part.

An embodied dewatering part of the present invention and its periphery are shown in FIG. 12. In this example, the outer cylindrical part 24*a* is set to move up and down along the inner cylindrical part 23*a*. In the movement of the outer cylindrical part 24*a*, the rack-and-pinion method is adopted. In this case, the outer cylindrical part 24*a* has: a small-diameter zone Y in which an opening 40*a* has a smaller hole diameter; and a large-diameter zone X in which an opening 41*a* has a hole diameter larger than that of the opening 40*a*. Meanwhile, the inner cylindrical part 23*a* has openings 42*a* that correspond to the small opening 40*a* and the large opening 41*a* provided in the outer cylindrical part 24*a*; however, the hole diameter of any opening 42*a* is substantially identical.

4) Fourth Embodiment

Figure 13:
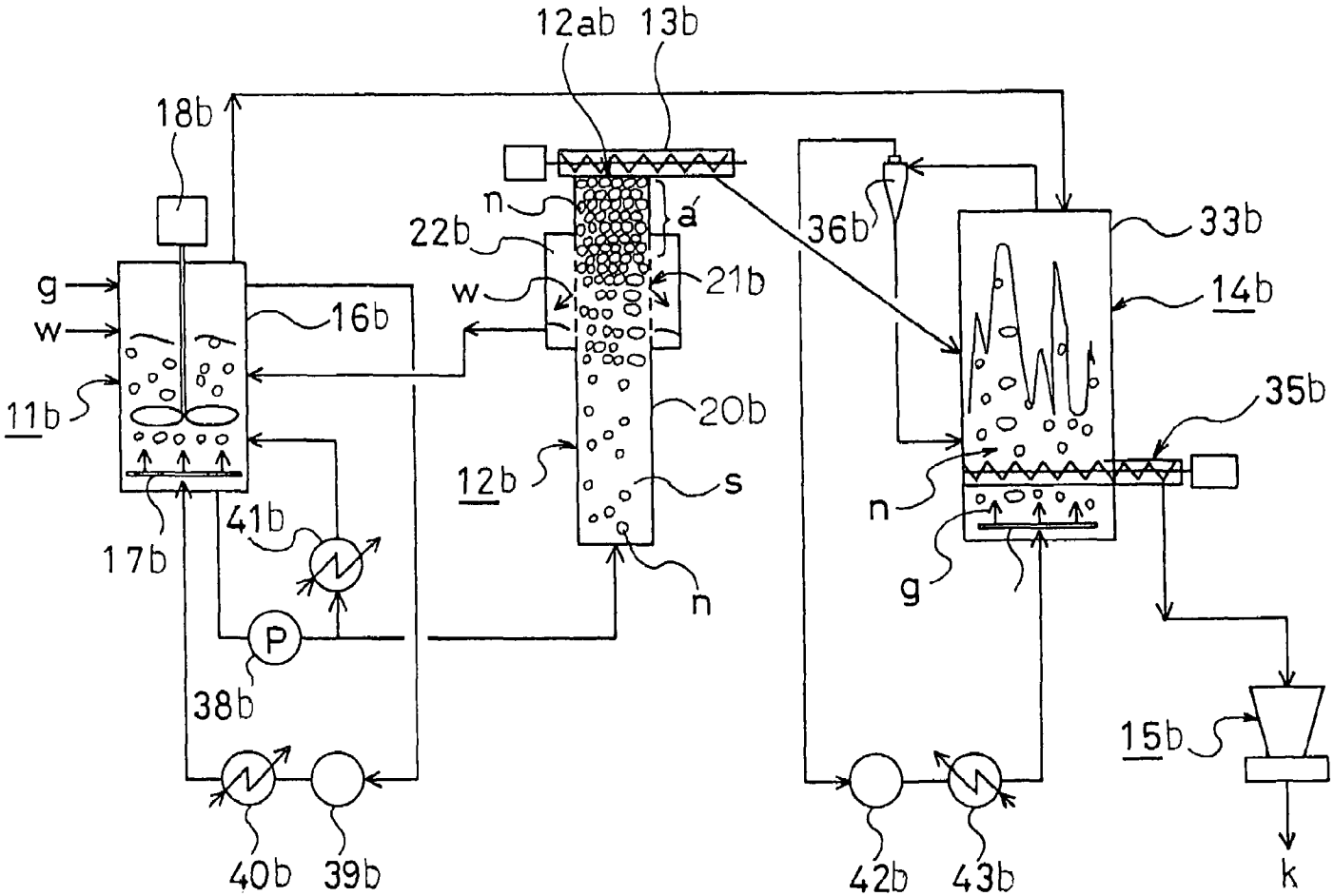
FIG. 13 is a schematic block diagram of a fourth embodiment of the gas hydrate production apparatus according to the present invention.

In FIG. 13, reference symbol 11*b* denotes a first generator; reference symbol 12*b* denotes a gravitational dewatering tower; reference symbol 13*b* denotes an expelling unit; reference numeral 14*b* denotes a second generator; and reference numeral 15*b* denotes a granulation unit. The first generator 11*b* includes: a pressure-tolerable container 16*b*; a gas-jetting nozzle 17*b*; and a stirrer 18*b*. The gravitational dewatering tower 12*b* is formed of: a cylindrical tower body 20*b*; a cylindrical dewatering part 21*b* disposed in an intermediate portion of the tower body 20*b*; and a jacket-like water receiving part 22*b* disposed outside the dewatering part 21*b*. The dewatering part 21*b* is to separate a gas hydrate and water from each other. The dewatering part 21*b* to be used is a metal mesh formed into a cylindrical form, a cylinder with holes, or the like.

Figure 14:
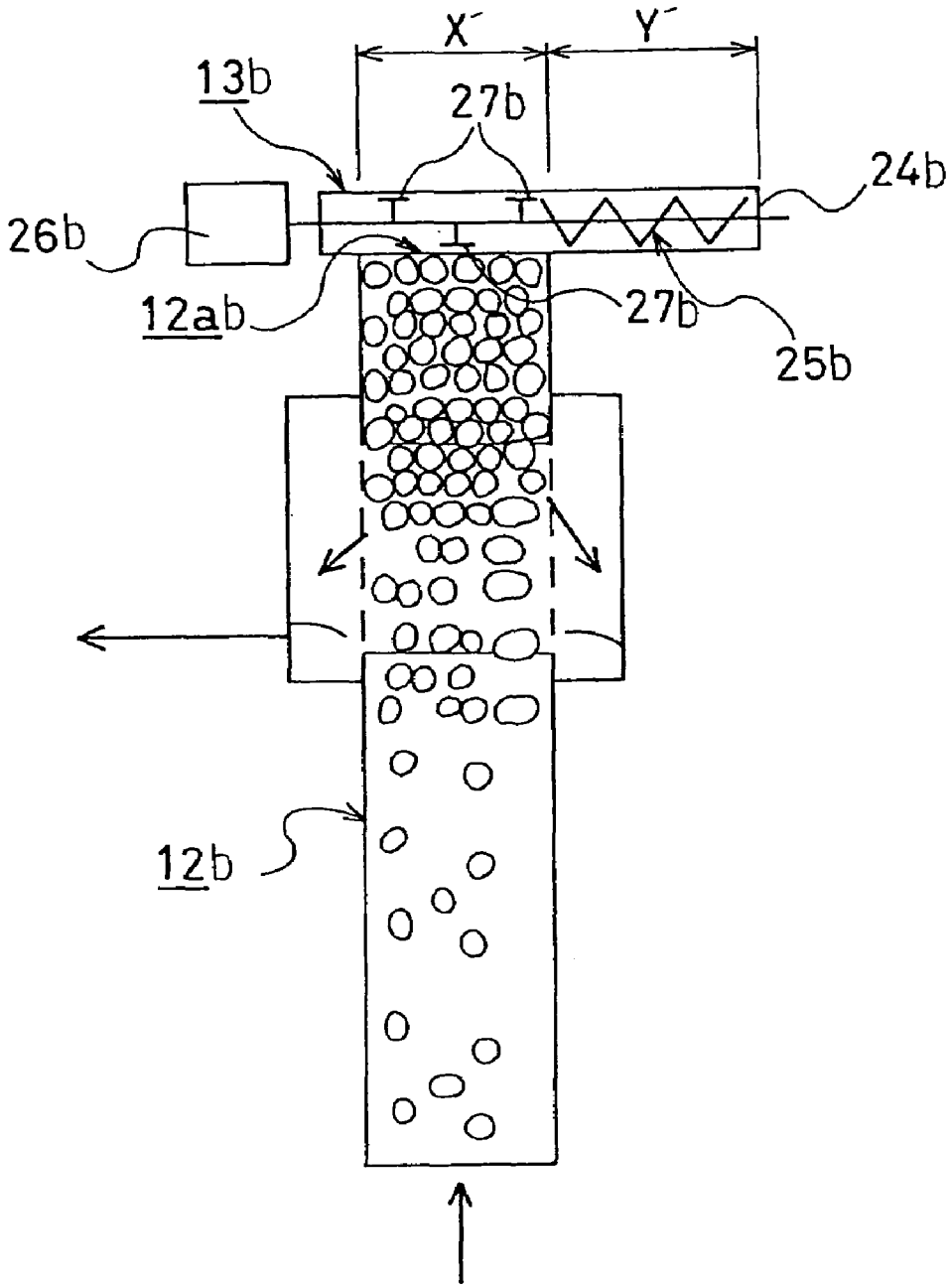
FIG. 14 is an enlarged view of a dewatering tower.
Figure 15:
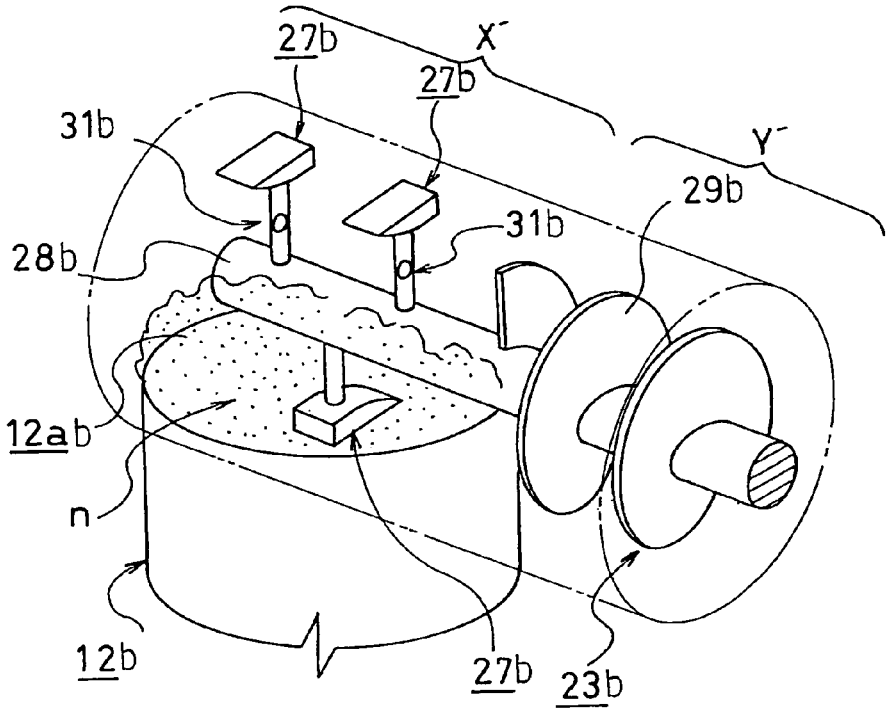
FIG. 15 is a perspective view of a first expelling unit.

The expelling unit 13*b* is attached substantially horizontally to the upper edge to the gravitational dewatering tower 12*b*. As shown in FIG. 14, the expelling unit 13*b* is formed of: a lateral cylindrical body 24*b*; and expelling means 25*b* disposed in the cylindrical body 24*b*. The expelling means 25*b* is rotated by a motor 26*b*. The expelling means 25*b* is formed of: a crusher section X' that corresponds to an outlet 12*ab* on the upper edge of the dewatering tower; and a transfer section Y' that is positioned behind the crusher section X'. As shown in FIG. 15, the crusher section X' is formed by arranging hammer-type crushers 27*b* spirally, that is, dispersing the hammer-type crushers 27*b* in a circumferential direction and an axial direction of a rotation shaft 28*b*. The transfer section Y' is formed by attaching a spiral blade 29*b* around the rotation shaft 28*b*. Thus, this transfer section Y' is a so-called screw conveyor 23*b*.

Figure 16:
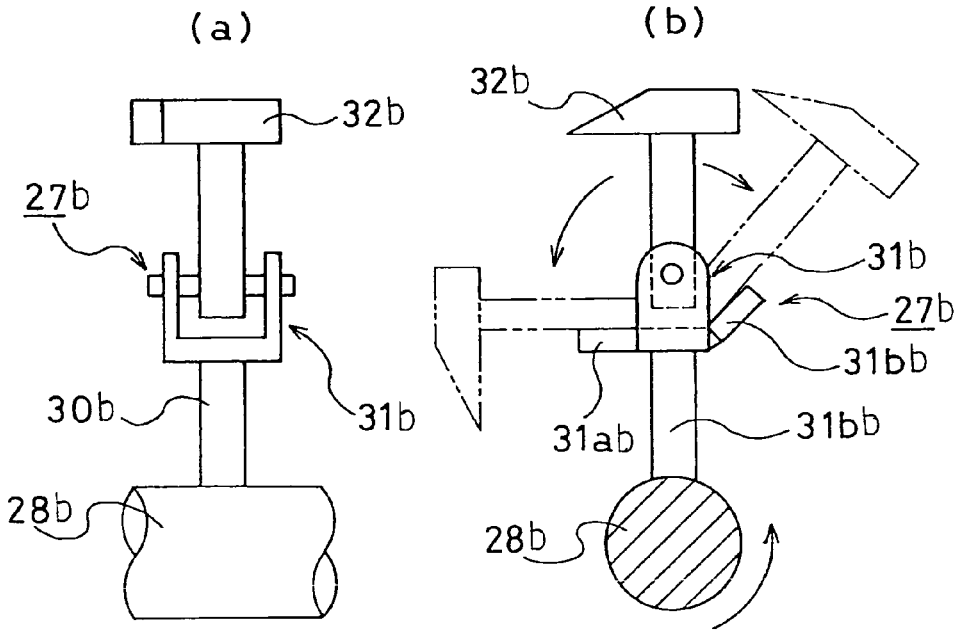
FIG. 16(*a*) is a front view of a hammer-type crusher, and FIG. 16(*b*) is a side view of the hammer-type crusher.
Figure 17:
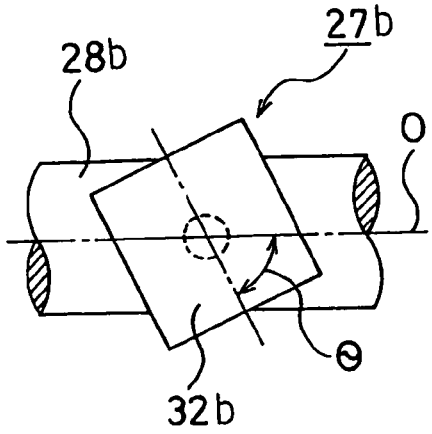
FIG. 17 is a plan view of the hammer-type crusher.

As shown in FIG. 16(*a*) and FIG. 16(*b*), each of the hammer-type crushers 27*b* is formed of: a supporting bar 30*b* standing upright in a radial direction of the rotation shaft 28*b*; and a hammer body 32*b* swingably disposed to the supporting bar 30*b* with a joint part 31*b*. The hammer body 32*b* is to swivel back and forth around the joint part 31*b*. In order to restrict the swivel movement of the hammer body 32*b*, stoppers 31*ab*, 31*bb* are provided in front and back of the joint part 31*b*. Moreover, as shown in FIG. 17, the hammer body 32*b* of the hammer-type crusher 27*b* is inclined from a shaft center O of the rotation shaft 28*b* at only a predetermined angle θ in an expelling direction. The hammer body 32*b* has two functions of crushing a gas hydrate and laterally sending the gas hydrate. As shown in FIG. 13, the second generator 14*b* includes: a pressure-tolerable container 33*b*; a gas-jetting nozzle 34*b*; a constant-amount expelling unit 35*b*; and a cyclone 36*b*.

Next, an operation of the gas hydrate production apparatus will be described. As shown in FIG. 13, a raw gas (for example, natural gas) g and water w supplied to the pressure-tolerable container 16*b* are subjected to hydration reaction within the pressure-tolerable container 16*b* to thereby form a gas hydrate. This gas hydrate together with water w is supplied to the gravitational dewatering tower 12*b* by the slurry pump 38*b*. The gas hydrate slurry s supplied to the gravitational dewatering tower 12*b* elevates within the tower body 20*b*. When the gas hydrate slurry s reaches the dewatering part 21*b*, water (slurry mother liquor) w flows out of the dewatering part 21*b*, and the gas hydrate n accumulates in a layer form. This gas hydrate layer a' is pushed upward, when the water (slurry mother liquor) w that accompanies the gas hydrate n passes through the gas hydrate layer a'. The gas hydrate layer a' reaches the outlet 12*ab* on the upper edge of the dewatering tower 12*b*.

The gas hydrate n that has reached the outlet 12*ab* on the upper edge of the dewatering tower 12*b* is, as shown in FIG. 15, sent to the screw conveyor 23*b* side while being finely crushed by the hammer-type crusher 27*b*. At this time, the hammer body 32*b* of the hammer-type crusher 27*b* never hinders the gas hydrate layers from elevating, since the hammer body 32*b* is for the swivel movement in the forward and backward directions owing to the joint part 31*b* (see FIG. 16(*a*) and FIG. 16(*b*)). The screw conveyor 23*b* transfers the gas hydrate n to the second generator 14*b*. The powdered gas hydrate n introduced into the second generator 14*b* is supplied to the granulation unit 15*b* by the constant-amount expelling unit 35*b*, while being fluidized by a raw gas g jetted from the gas-jetting nozzle 34*b*. Thereby, a granular product is formed.

Here, the first generator 11*b* supplies a raw gas g therein to the second generator 14*b*. The first generator 11*b* also supplies a raw gas g to the gas-jetting nozzle 17*b*, after increasing the pressure with a compressor 39*b* and cooling the gas with a cooling unit 40*b*. Furthermore, a part of the gas hydrate slurry s that has been sent by the slurry pump 39*b* is cooled with a cooling unit 41*b*, and returned to the first generator 11*b*. Moreover, water w removed by the dewatering tower 12*b* is returned to the first generator 11*b*. In the second generator 14*b*, the pressure of a raw gas g for the second generator 14*b* is increased with a compressor 42*b*, and then the raw gas g is cooled with a cooling unit 43*b*, and supplied to the gas-jetting nozzle 34*b*. At this point, the gas hydrate spilled therefrom is collected with the cyclone 36*b*, and then returned to the second generator 14*b*.

Figure 18:
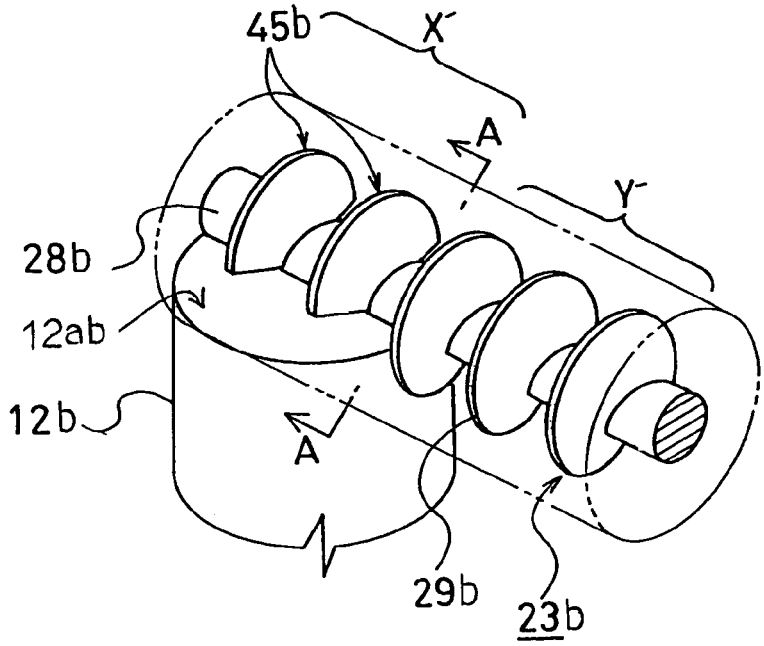
FIG. 18 is a perspective view of a second expelling unit.
Figure 19:
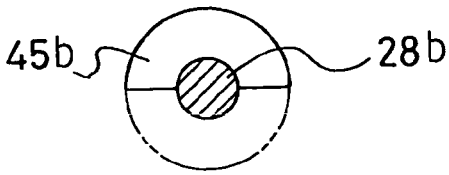
FIG. 19 is a cross-sectional view taken along A-A of FIG. 18.
Figure 20:
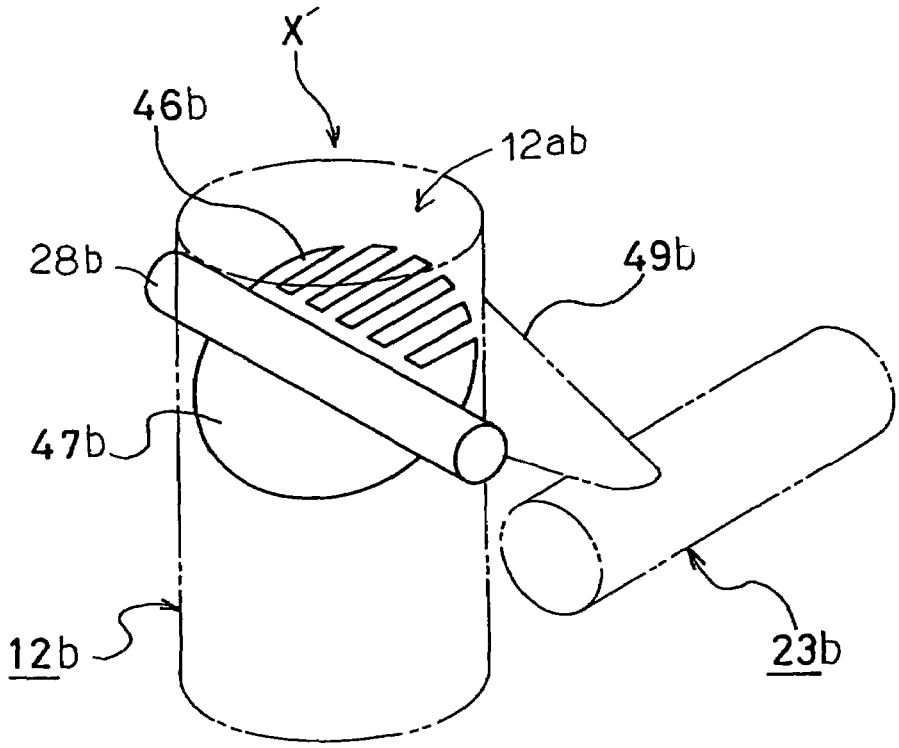
FIG. 20 is a perspective view of a third expelling unit.
Figure 21:
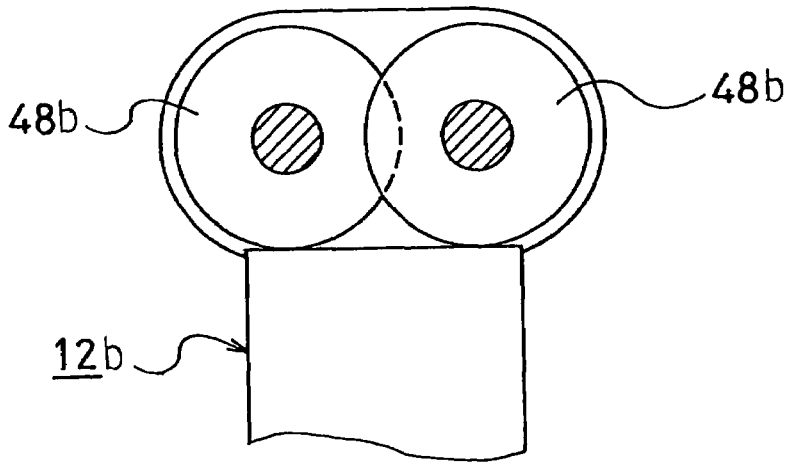
FIG. 21 is a cross-sectional view of a fourth expelling unit.

In the above description, described has been the case where the hammer-type crushers 27*b* are spirally provided to the crusher section X' corresponding to the outlet 12*ab* on the upper edge of the dewatering tower. Nevertheless, the same effect can be obtained, for example, as shown in FIG. 18, even when fan-shaped screw blades 45*b* (see FIG. 19) are arranged at predetermined intervals in an expelling direction on the rotation shaft 28*b* in the crusher section X' corresponding to the outlet 12*ab* on the upper edge of the dewatering tower. Moreover, the same effect can be obtained, for example, as shown in FIG. 20, even when a comb-shaped crushing blade 46*b* and a fan-shaped expelling blade 47*b* are arranged on the rotation shaft 28*b* in the crusher section X' corresponding to the outlet 12*ab* on the upper edge of the dewatering tower. In this example, a gas hydrate n is supplied to the screw conveyor 23*b* via a shooter 49*b* disposed to the dewatering tower 12*b*. Furthermore, the same effect can be obtained, for example, as shown in FIG. 21, even when multiple screw conveyors 48*b* are arranged in parallel with each other in the crusher section X' corresponding to the outlet 12*ab* on the upper edge of the dewatering tower. Meanwhile, the expelling unit can be widely used as a general device for expelling powders in addition to a gas hydrate having a high adhesive property.

5) Fifth Embodiment

Figure 22:
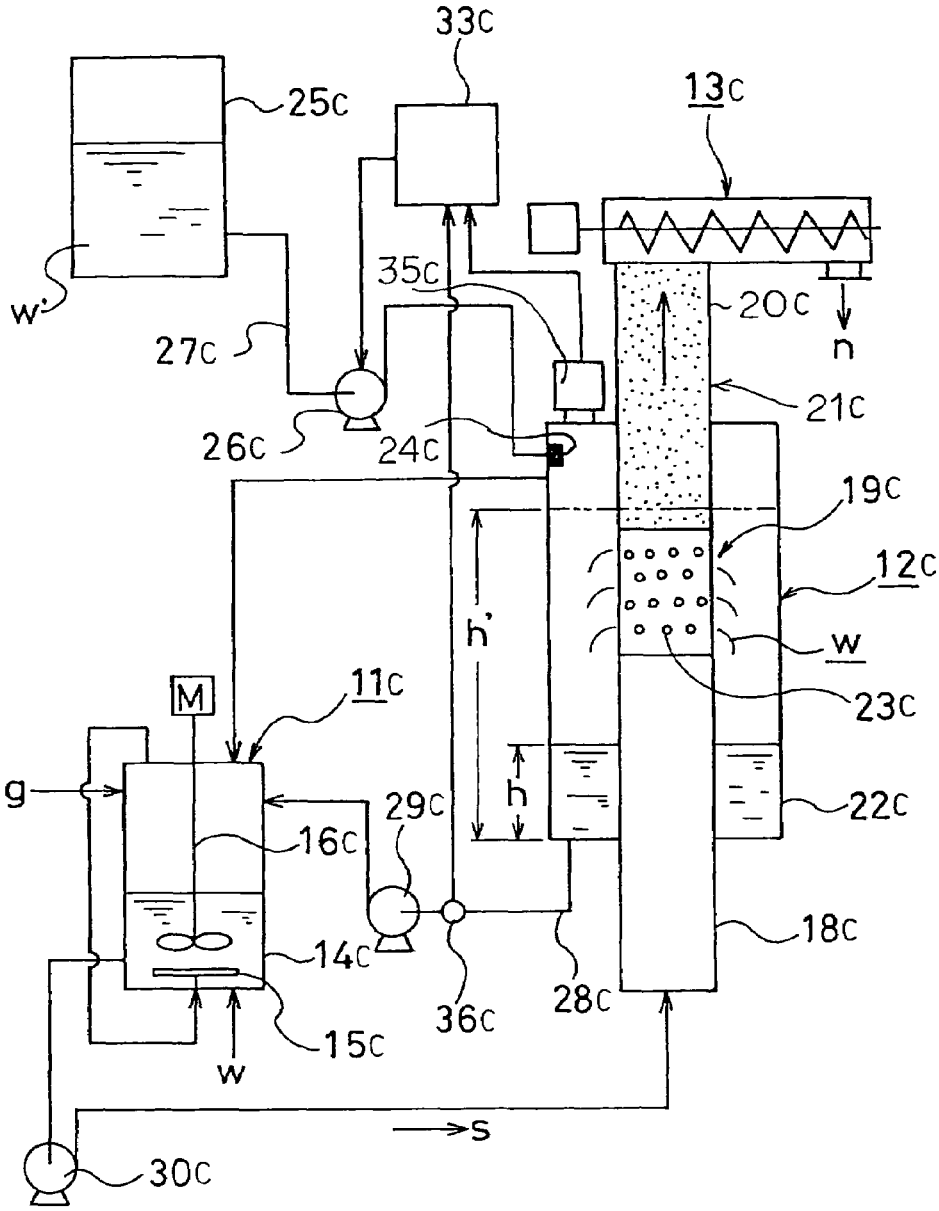
FIG. 22 is a schematic block diagram of a fifth embodiment of the gas hydrate production apparatus according to the present invention.

In FIG. 22, reference symbol 11*c* denotes a gas hydrate generator; reference symbol 12*c* denotes a gravitational dewatering tower that dewaters a slurry gas hydrate formed in the gas hydrate generator 11*c*; and reference symbol 13*c* denotes a gas-hydrate conveying unit that laterally transfers, to the subsequent step (unillustrated), the gas hydrate n almost dewatered in the gravitational dewatering tower 12*c*. The gas hydrate generator 11*c* includes: a pressure-tolerable container 14*c*; a gas-jetting nozzle 15*c* that jets natural gas g, which is a raw gas, in a form of bubbles; and a stirrer 16*c* that stirs inside the pressure-tolerable container 14*c*. It is possible to utilize, as the raw gas: natural gas which is a mixed gas of methane, ethane, propane, butane, and the like; as well as a gas such as carbonic acid gas and chlorofluorocarbon (flon) gas, each of which forms a gas hydrate.

The gravitational dewatering tower 12*c* is formed of: an introducing part 18*c* from which a gas hydrate slurry is introduced; a dewatering part 19*c* that removes water w in the gas hydrate slurry; a longitudinal cylindrical main body 21*c* constituted of an exhausting part 20*c* that leads out the gas hydrate n dewatered by the dewatering part 19*c*; and a water receiving part 22*c* that collects water (filtrate) w filtered by the dewatering part 19*c*. The dewatering part 19*c* is a metal mesh or porous plate formed into a cylindrical form. A small hole 23*c* thereof is formed to have a hole diameter of 0.1 mm to 5 mm. When the hole diameter of the small hole 23*c* is less than 0.1 mm, clogging is likely to occur. In contrast, when the diameter is more than 5 mm, the amount of gas hydrate flowing out is increased, and accordingly the recovery rate of the gas hydrate is lowered.

The water receiving part 22*c* is disposed outside the dewatering part 19*c* so that the water receiving part 22*c* can be concentric with the longitudinal cylindrical main body 21*c*. On top of the water receiving part 22*c*, a liquid-surface sensor 35*c* such as an ultrasonic sensor is provided, and measures a liquid-surface height h in the removed-water collecting part 22*c*. Furthermore, unreacted water (filtrate) w filtered by the dewatering part 19*c* is returned to the gas hydrate generator 11*c* via a return line 28*c* provided with a pump 29*c*. Meanwhile, a flowmeter 36*c* is provided just in front of the pump 29*c*, and measures a returned amount of unreacted water (filtrate) w. In the drawing, reference symbol 33*c* denotes a controller. When the liquid-surface height h in the removed-water collecting part 22*c* is lowered below a set value, and concurrently when the returned amount of the unreacted water (filtrate) w returning via the return line 28*c* falls below a set value, the controller 33*c* determines that the dewatering part 19*c* has been clogged. Thereby, clear water w' is supplied into the removed-water collecting part 22*c* from a water-jetting nozzle 24*c* that will be described below. On top of the water receiving part 22*c*, the water-supplying nozzle 24*c* is provided. The water-supplying nozzle 24*c*, a clear-water tank 25*c* and a water-feeding pump 26*c* are connected to each other with a water-feeding line 27*c*. Thus, clear water (fresh water) w' in the clear-water tank 25*c* is supplied to the water-jetting nozzle 24*c* by the water-feeding pump 26*c*.

Next, an operation of the above-described apparatus will be described. A gas hydrate n formed in the gas hydrate generator 11*c* is in a slurry form, having a gas-hydrate concentration of approximately 20%. This gas hydrate slurry is supplied into the introducing part 18*c* on the lower edge of the dewatering unit by a slurry pump 30*c*. Then, when the liquid surface reaches above the dewatering part 19*c*, unreacted water w in the gas hydrate slurry s flows into the removed-water collecting part 22*c* through the small holes 23*c* of the dewatering part 19*c*. The gas hydrate n thus having a water content of approximately 50% elevates in the removed-water collecting part 12*c*, and reaches the exhausting part 20*c*. Then, the gas hydrate n is transferred to the subsequent step by the gas hydrate discharging unit 13*c*.

During this period, when the liquid-surface height h in the removed-water collecting part 22*c* is lowered below the set value, and concurrently when the returned amount of the unreacted water (filtrate) w returning via the return line 28*c* falls below the set value, the controller 33*c* determines that the dewatering part 19*c* has been clogged. Then, clear water w' is supplied into the removed-water collecting part 22*c* from the water-jetting nozzle 24*c* by driving the pump 26*c*. In this manner, the liquid-surface height h in the removed-water collecting part 22*c* is raised to a height h' where the dewatering part 19*c* is submerged. Thereafter, by intermittently driving the pump 26*c*, the liquid-surface height in the removed-water collecting part 22*c* is caused to vary between the liquid-surface height h and the liquid-surface height h'. Thus, the dewatering part 19*c* is washed with the filtrate w itself.

6) Sixth and Seventh Embodiments

Figure 23:
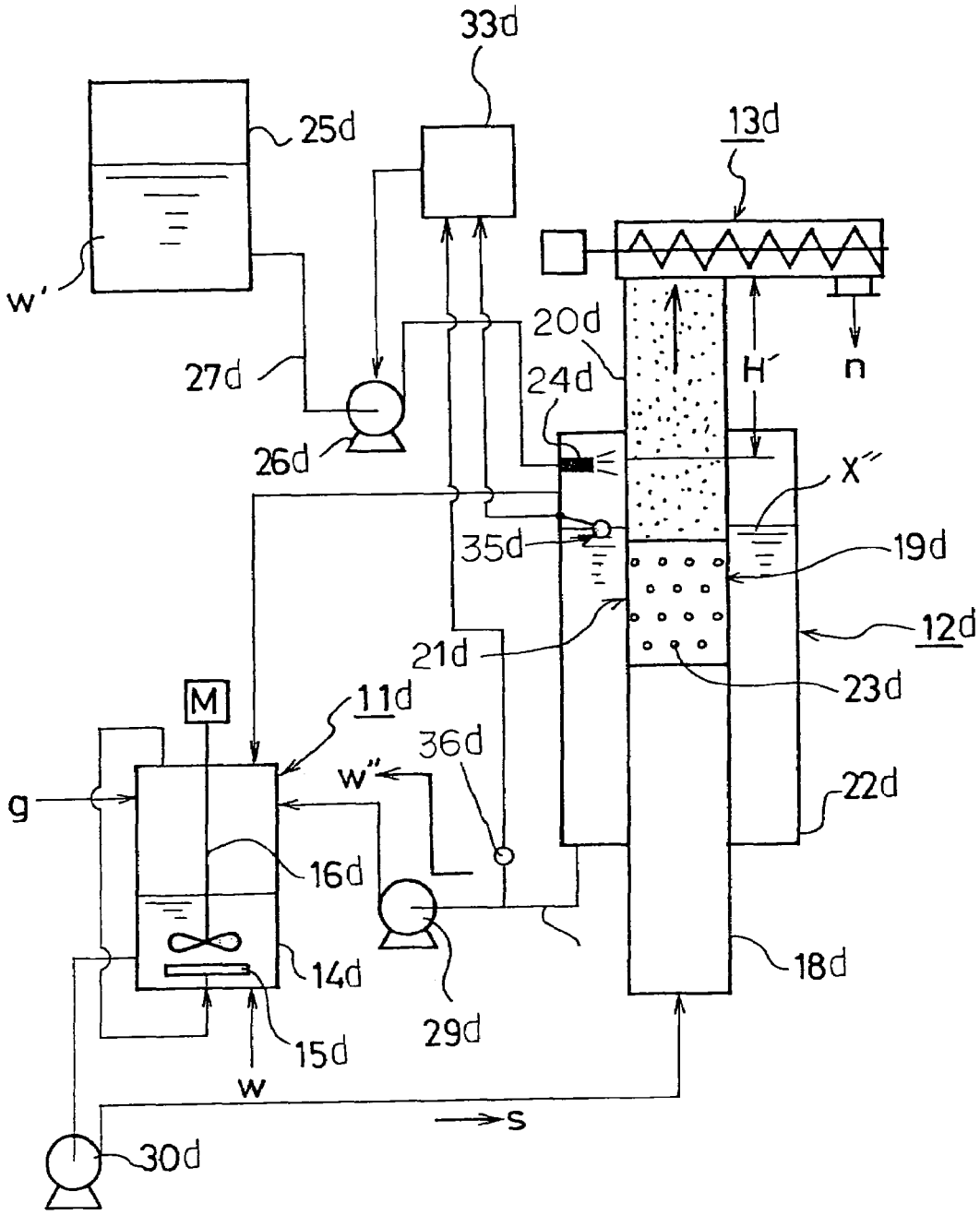
FIG. 23 is a schematic block diagram of a sixth embodiment of the gas hydrate production apparatus according to the present invention.

In FIG. 23, reference symbol 11*d* denotes a gas hydrate generator; reference symbol 12*d* denotes a gravitational dewatering tower that dewaters a slurry gas hydrate s formed in the gas hydrate generator 11*d*; and reference symbol 13*d* denotes a gas-hydrate conveying unit that laterally transfers, to the subsequent step (unillustrated), the gas hydrate n almost dewatered in the gravitational dewatering tower 12*d*. The gas hydrate generator 11*d* includes: a pressure-tolerable container 14*d*; a gas-jetting nozzle 15*d* that jets natural gas g, which is a raw gas, in a form of bubbles; and a stirrer 16*d* that stirs inside the pressure-tolerable container 14*d*. It is possible to utilize, as the raw gas: natural gas which is a mixed gas of methane, ethane, propane, butane, and the like; as well as a gas such as carbonic acid gas and chlorofluorocarbon (flon) gas, each of which forms a gas hydrate.

The gravitational dewatering tower 12*d* includes: an introducing part 18*d* from which a gas hydrate slurry s is introduced; a dewatering part 19*d* that removes water w in the gas hydrate slurry; a longitudinal cylindrical main body 21*d* constituted of an exhausting part 20*d* that leads out the gas hydrate n dewatered by the dewatering part 19*d*; and a water receiving part 22*d* that collects water (filtrate) w separated from the gas hydrate n by the dewatering part 19*d*. The dewatering part 19*d* is a metal mesh or porous plate formed into a cylindrical form. A small hole 23*d* thereof is formed to have a hole diameter of 0.1 mm to 5 mm. When the hole diameter of the small hole 23*d* is less than 0.1 mm, clogging is likely to occur. In contrast, when the diameter is more than 5 mm, the gas hydrate is likely to flow out, and accordingly the recovery rate is lowered. Moreover, on top of the water receiving part 22*d*, a water-supplying nozzle 24*d* is provided. The water-supplying nozzle 24*d*, a clear-water tank 25*d* and a water-feeding pump 26*d* are connected to each other with a water-feeding line 27*d*. Thus, clear water (fresh water) w' in the clear-water tank 25*d* is supplied to the water-jetting nozzle 24*d* by the water-feeding pump 26*d* to thereby submerge the dewatering part 20*d* always below a liquid surface X".

For this purpose, the water receiving part 22*d* is provided with a liquid-surface sensor 35*d* to control the water-feeding pump 26*d* so that the liquid surface X" can be maintained at a set water level. Moreover, mixed water w" obtained by mixing clear water with unreacted water (filtrate) filtered by the dewatering part 19*d* is returned to the gas hydrate generator 11*d* via a return line 28*d* provided with a pump 29*d*. In this respect, the dewatering unit 12*d* is required to have a height H' for discharging water, that is, a difference between the upper edge of the longitudinal cylindrical main body 21*d* and the upper edge of the liquid surface of a gas hydrate slurry in this longitudinal cylindrical main body 21*d*. In the drawing, reference symbol 33*d* denotes a controller. In the meanwhile, normally an operation is carried out so that the liquid surface X" can be in a position below the dewatering part 19*d*. The dewatering part 19*d* may be submerged below the liquid surface X", only when a measurement value detected by a flowmeter 36*d* provided to the return line 28*d* falls below a set value.

Next, an operation of this gas hydrate production apparatus will be described. A gas hydrate n formed in the gas hydrate generator 11*d* is in a slurry form, having a gas-hydrate concentration of approximately 20%. This gas hydrate slurry is supplied into the introducing part 18*d* on the lower edge of the dewatering unit by a slurry pump 30. Then, when the liquid surface reaches above the dewatering part 19*d*, unreacted water in the gas hydrate slurry s flows into the water receiving part 22*d* through the small holes 23*d* of the dewatering part 19*d*. The gas hydrate n thus having a water content of approximately 50% elevates in the gravitational dewatering unit 12, and reaches the exhausting part 20*d*. Then, the gas hydrate n is transferred to the subsequent step by the gas hydrate discharging unit 13*d*. As described above, this dewatering part 19*d* is positioned below the liquid surface X" of clear water injected into the water receiving part 22*d*, and accordingly the contact with a raw gas g is blocked. Thereby, the clogging due to gas hydrate formation does not occur.

Figure 24:
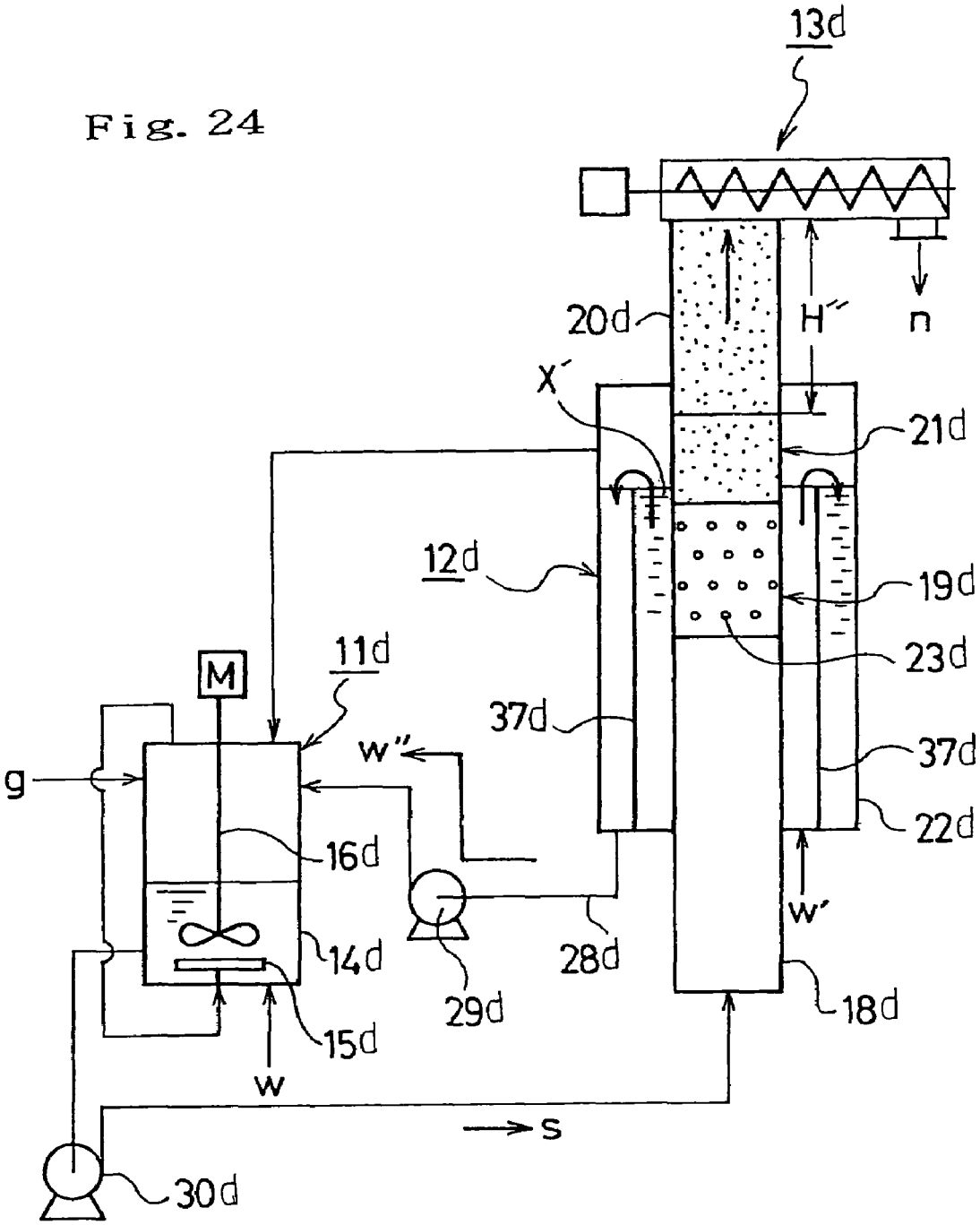
FIG. 24 is a schematic block diagram of a seventh embodiment of the gas hydrate production apparatus according to the present invention.

FIG. 24 shows another embodiment (a seventh embodiment) of the gas hydrate production apparatus according to the present invention. The same members as those in FIG. 23 are denoted by the same reference symbols, and the specific description will be omitted. In this invention, as shown in FIG. 24, a weir 37*d* is provided in the removed-water collecting part 22*d*. The height of the weir 37*d* is comparable to that of the dewatering part 19*d*. Clear water w' is supplied between the weir 37*d* and the dewatering part 19*d* to submerge the dewatering part 19*d* always below the liquid surface X". Thereby, it is possible to prevent the clogging of the portion of the metal mesh or porous plate constituting the dewatering part 19*d* in a relatively simple way.

7) Eighth Embodiment

Figure 25:
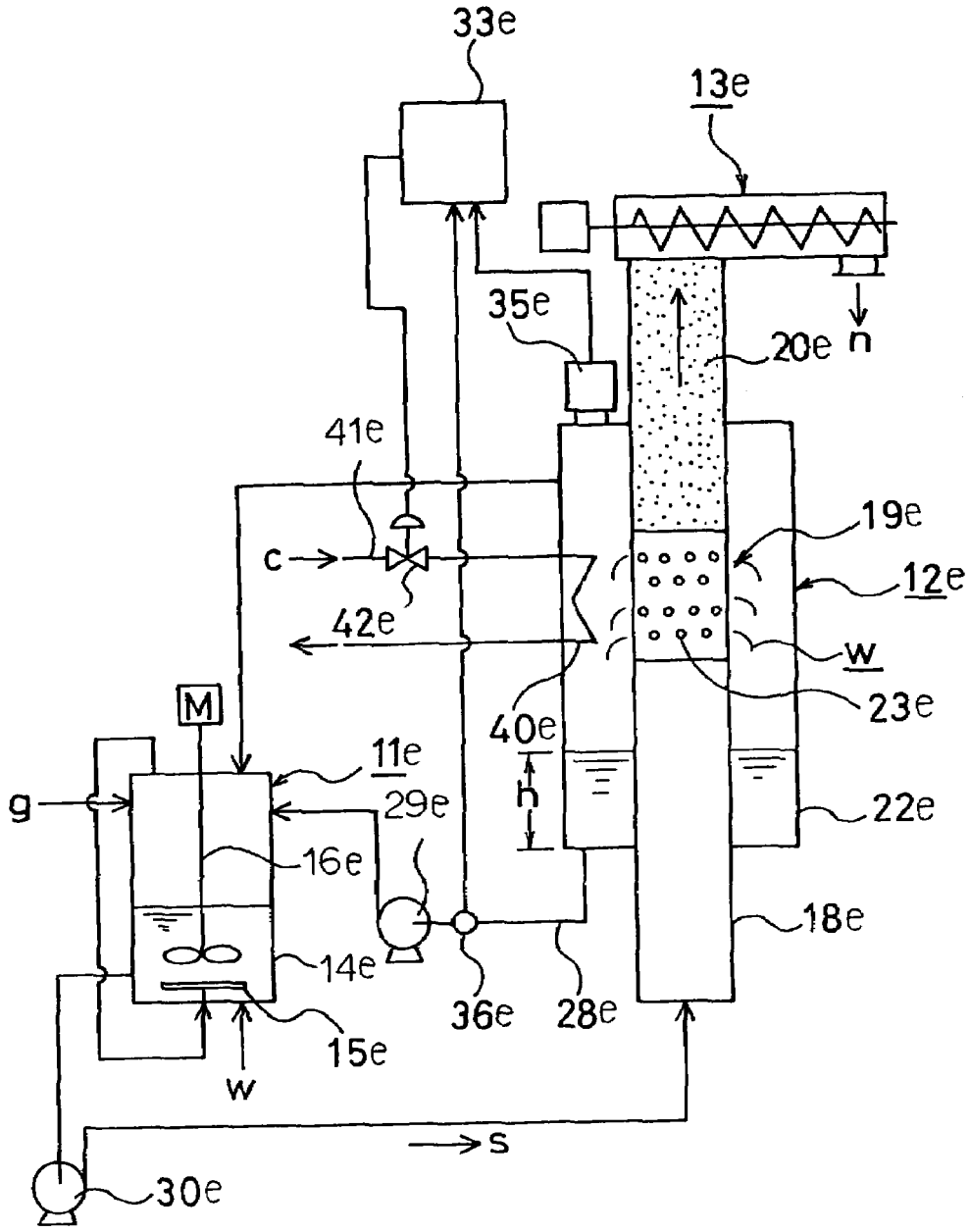
FIG. 25 is a schematic block diagram of an eighth embodiment of the gas hydrate production apparatus according to the present invention.

In FIG. 25, reference symbol 11*e* denotes a gas hydrate generator; reference symbol 12*e* denotes a gravitational dewatering tower that dewaters a slurry gas hydrate n formed in the gas hydrate generator 11*e*; and reference symbol 13*e* denotes a gas-hydrate conveying unit that laterally transfers, to the subsequent step (unillustrated), the gas hydrate n almost dewatered in the gravitational dewatering tower 12*e*. The gas hydrate generator 11*e* includes: a pressure-tolerable container 14*e*; a gas-jetting nozzle 15*e* that jets natural gas g, which is a raw gas, in a form of bubbles; and a stirrer 16*e* that stirs inside the pressure-tolerable container 14*e*. It is possible to utilize, as the raw gas: natural gas which is a mixed gas of methane, ethane, propane, butane, and the like; as well as a gas such as carbonic acid gas and chlorofluorocarbon (flon) gas, each of which forms a gas hydrate.

The gravitational dewatering tower 12*e* is formed of: an introducing part 18*e* from which a gas hydrate slurry s is introduced; a dewatering part 19*e* that removes water w in the gas hydrate slurry; a longitudinal cylindrical main body 21*e* constituted of an exhausting part 20*e* that leads out the gas hydrate n dewatered by the dewatering part 19*e*; and a water receiving part 22*e* that collects water (filtrate) w filtered by the dewatering part 19*e*. The dewatering part 19*e* is a metal mesh or porous plate formed into a cylindrical form. A small hole 23*e* thereof is formed to have a hole diameter of 0.1 mm to 5 mm. When the hole diameter of the small hole 23*e* is less than 0.1 mm, clogging is likely to occur. In contrast, when the diameter is more than 5 mm, the amount of gas hydrate flowing out is increased, and accordingly the recovery rate of the gas hydrate is lowered.

The water receiving part 22*e* is disposed outside the dewatering part 19*e* so that the water receiving part 22*e* can be concentric with the longitudinal cylindrical main body 21*e*. On top of the water receiving part 22*c*, a liquid-surface sensor 35*e* such as an ultrasonic sensor is provided, and measures a liquid-surface height h in the removed-water collecting part 22*e*. Furthermore, unreacted water (filtrate) w filtered by the dewatering part 19*e* is returned to the gas hydrate generator 11*e* via a return line 28*e* provided with a pump 29*e*. Meanwhile, a flowmeter 36*e* is provided just in front of the pump 29*e*, and measures a returned amount of unreacted water (filtrate) w. In the drawing, reference symbol 33*e* denotes a control unit. When the liquid-surface height h in the removed-water collecting part 22*e* is lowered below a set value, and concurrently when the returned amount of the unreacted water (filtrate) w returning via the return line 28*e* falls below a set value, the controller 33*e* determines that the dewatering part 19*e* has been clogged. Thereby, hot water c is supplied to a heat-transfer part 40*e* which serves as heating means, and which is provided in the removed-water collecting part 22*e*. A hot-water supplying line 41*e* is provided with a valve 42*e*, and the turning on/off thereof is controlled by the control unit 33*e*.

Next, an operation of this gas hydrate production apparatus will be described. A gas hydrate n formed in the gas hydrate generator 11*e* is in a slurry form, having a gas-hydrate concentration of approximately 20%. This gas hydrate slurry s is supplied into the introducing part 18*e* on the lower edge of the gravitational dewatering tower by a slurry pump 30. Then, when the liquid surface reaches above the dewatering part 19*e*, unreacted water w in the gas hydrate slurry s flows into the water receiving part 22*e* through the small holes 23*e* of the dewatering part 19*e*. The gas hydrate n thus having a water content of approximately 50% elevates in the gravitational dewatering tower 12*e*, and reaches the exhausting part 20*e*. Then, the gas hydrate n is transferred from here to the subsequent step by the gas hydrate discharging unit 13*e*.

During this period, when the liquid-surface height h in the water receiving part 22*e* is lowered below the set value, and concurrently when the returned amount of the unreacted water (filtrate) w returning via the return line 28*e* falls below the set value, the control unit 33*e* determines that the dewatering part 19*e* has been clogged. Then, by opening the valve 42*e*, hot water c is supplied to the heat-transfer part 40*e*, and the inside of the removed-water collecting part 22*e* is heated to a predetermined temperature, that is, a temperature higher than the equilibrium temperature of the gas hydrate by 2° C. to 3° C. As a result, the gas hydrate adhered to the surface of the dewatering part 19*e* is decomposed, and thereby the clogging of the dewatering part 19*e* is eliminated. Note that, in order not to decompose a gas hydrate elevating inside the dewatering part 19*e*, it is possible to further increase the temperature if the material and the thickness of the dewatering part 19*e* are adjusted in a way to suppress the heat transfer from the surface of the dewatering part.

In the above description, described has been the case where the heat-transfer part 40*e* to which the hot water c is supplied, is provided in the removed-water collecting part 22*e*. However, this embodiment is not limited to this. Other methods may be adopted. For example, a raw gas (such as methane) heated to a predetermined temperature may be supplied into the removed-water collecting part 22*e*. Alternatively, the inside of the removed-water collecting part 22 may be heated with light.

8) Ninth Embodiment

Figure 26:
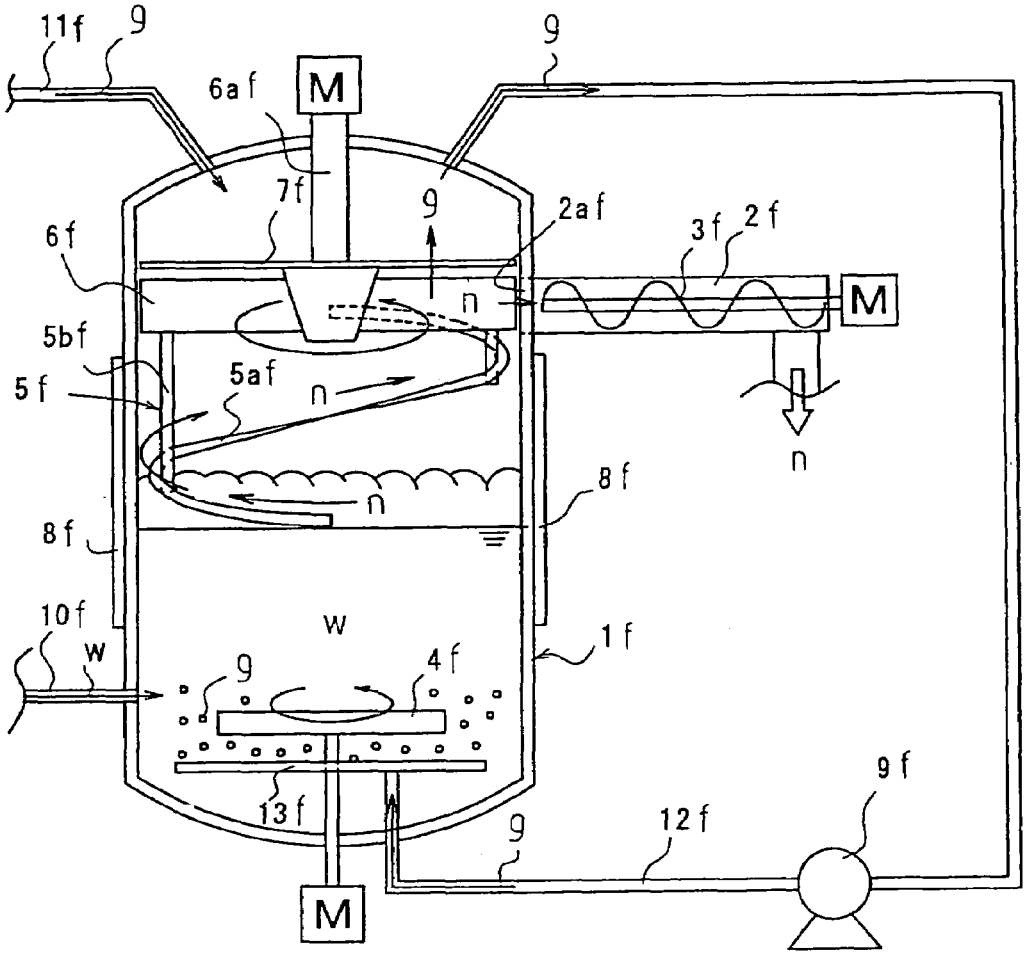
FIG. 26 is a schematic block diagram of a ninth embodiment of the gas hydrate production apparatus according to the present invention.

FIG. 26 shows the entire scheme of a gas hydrate formation apparatus. A cylindrical pressure-tolerable container 1*f* is connected to: a water-supplying path 10*f* through which cooled water w is supplied; and a gas-supplying path 11*f* through which a hydrate-forming gas g (methane gas, natural gas, and the like) is supplied. The hydrate-forming gas g is circulated through a gas-circulation path 12*f* provided with a blower 9*f*. The hydrate-forming gas g is discharged from the top of the pressure-tolerable container 1*f*, and again supplied to the pressure-tolerable container 1*f* from the bottom thereof. A cooling jacket 8*f*, as illustrated, may be provided on an outer peripheral side surface of the pressure-tolerable container 1*f*. In the pressure-tolerable container 1*f*, a stirring blade 4*f* is provided at a lower portion of the pressure-tolerable container 1*f*. The stirring blade 4*f* rotates a liquid inside the pressure-tolerable container 1*f* with a drive motor M. An upward-conveying unit 5*f* is provided above this stirring blade 4*f*, and conveys a formed gas hydrate n upward. The structure of this upward-conveying unit 5*f* is as follows. A convey path 5*af* that is a belt-like spiral body is disposed therein as extending in a vertical direction along an inner surface of the pressure-tolerable container 1*f*, and is rotatable, along the inner surface, in the pressure-tolerable container 1*f*. The specific description will be given later.

In the pressure-tolerable container if, discharging blades 6*f* are disposed at an upper portion of the pressure-tolerable container if. The discharging blades 6*f* extend in a vertical direction, and are fixed to a rotation shaft 6*af* that is rotated by the drive motor M. As the blade form in a plane direction of the discharging blades 6*f*, forms such as a straight blade, curved blade, and the like, which are radially extending around the rotation shaft 6*af*, may be adopted as appropriate to efficiently discharge a gas hydrate n to a discharge path 2*f*. The number of blades is also determined, as appropriate, while taking the discharging efficiency and the like of a gas hydrate n into consideration.

Figure 28:
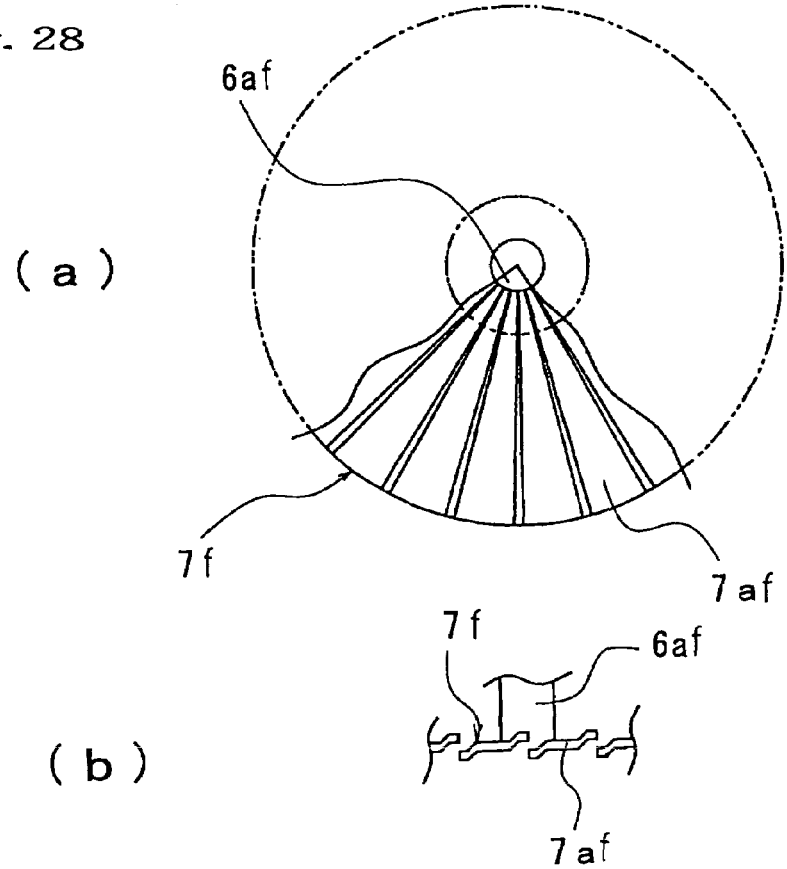
FIG. 28 is an explanatory drawing for showing an example of a regulator according to the present invention.

An opening part 2*af* of the discharge path 2*f* is provided in the inner surface of the pressure-tolerable container 1*f* at the height that is almost the same as that of the discharging blade 6*f*. In the discharge path 2*f*, a discharging feeder 3*f* is installed, and is activated by the drive motor M. In order to smoothly introduce a gas hydrate n into the discharge path 2*f*, the opening part 2*af* can be a bell-mouth form. Above the discharging blade 6*f*, a rotating disk 7*f* with an airway part is disposed and fixed to the rotation shaft 6*af* as similar to the discharging blade 6*f*. An example of this rotating disk 7*f* is shown in FIG. 28*f*. In a plane direction as shown in FIG. 28(*a*), multiple divided pieces 7*af* are radially disposed, and one end thereof is fixed to the rotation shaft 6*af*. Interspaces are provided between the divided pieces 7*af* as viewed in a side surface direction in FIG. 28(*b*) so that the air permeability can be guaranteed. An end part of each divided piece 7*af* is bent into a key form not to hinder the circulation of the hydrate-forming gas g, and simultaneously to restrict the upward movement of the formed gas hydrate n.

Figure 27:
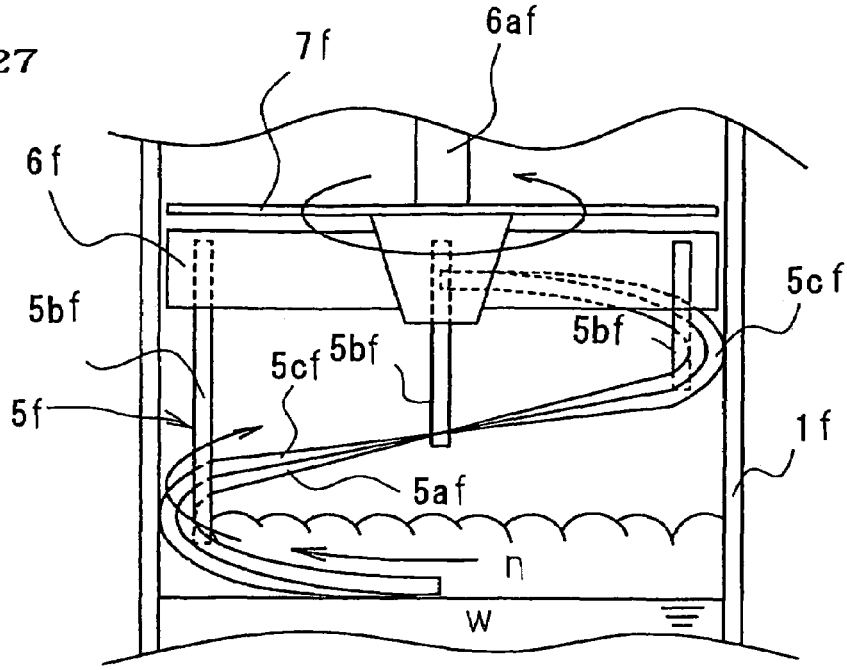
FIG. 27 is an explanatory drawing for exemplifying an upward-conveying unit according to the present invention.

The structure of the upward-conveying unit 5*f* will be described on the basis of FIG. 27. The convey path 5*af* that is formed of a belt-like spiral body is fixed to predetermined positions of holding columns 5*bf* that extend in a vertical direction, and upper edges of the holding columns 5*bf* are fixed to the discharging blades 6*f*. The convey path 5*af* are rotatable together with the discharging blade 6*f* while keeping the spiral shape. The holding of the convey path 5*af* having the belt-like spiral body is not limited to this structure. For example, by projecting the rotation shaft 6*af* downward to extend the holding column 5*bf* radially in a plane surface from the rotation shaft 6*af* to the convey path 5*af*, the convey path 5*af* can be rotated while being held in a spiral form. Moreover, the convey path 5*af* may be rotated by a rotation shaft that is different from the discharging blade 6*f*.

The width of the convey path 5*af* is determined as appropriate while considering the conveying efficiency, the number of rotation, the spiral pitch, and the like. Nevertheless, by providing a space that is a hollow in the central part of the rotation, the water adhered to a gas hydrate n falls due to the gravity. Thus, the gas hydrate n is dewatered, while being conveyed upward through this space. Meanwhile, an upper-surface member 5*cf* that is made of rubber, rubber mixtures, and the like, may be disposed on the upper surface of the convey path 5*af* so as to expand outward, and to thus come into or almost come into contact with an inner surface of the pressure-tolerable container 1*f*. Thereby, it becomes possible to convey a gas hydrate n upward as scraping the gas hydrate n adhered on the inner surface of the pressure-tolerable container 1*f*, and it is possible to reduce the amount of gas hydrate n left adhered on the inner surface of the pressure-tolerable container 1*f*. Next, generating and discharging processes of a gas hydrate n with this formation apparatus will be described on the basis of FIG. 26. A hydrate-forming gas g in a bubble form is supplied, from a sparger 13*f* that is fixed at a lower portion of the pressure-tolerable container 1*f*, to water w cooled to a predetermined temperature inside the pressure-tolerable container 1*f*. At this point, by stirring the stirring blade 4*f*, the water w and the hydrate-forming gas g are repeatedly brought into contact with each other, thus forming a gas hydrate n. This stirring can improve the generation rate.

The formed gas hydrate n floats on the water surface, and forms a gas hydrate layer. The thickness of the layer is gradually increased, and the layer stays inside the pressure-tolerable container 1*f*. Thus, unless the layers are sequentially conveyed upward and continuously discharged outside the pressure-tolerable container 1*f*, the water w and the hydrate-forming gas g are inhibited from contacting each other. As a result, the generation rate of a gas hydrate n may be reduced in some cases. Moreover, a formed gas hydrate n may have a property such that it is likely to be firmly adhered on the inner surface of the pressure-tolerable container 1 depending on the degree of an adhered water content or the like. For this reason, it is urged that the formed gas hydrate n be conveyed upward with the upward-conveying unit 5*f*. A lower edge part of the convey path 5*af* is disposed to be near the boundary between the layer of a gas hydrate n and the layer of water w.

By rotating the convey path 5*af*, the gas hydrate n is mounted on the upper surface of the convey path 5*af*, and conveyed upward along the inner surface of the pressure-tolerable container 1*f* while contacting the inner surface. Moreover, since conveyed along the inner surface, the gas hydrate n can be prevented from being firmly adhered on the inner surface. The gravity causes the adhered water content to fall from the convey path 5*af* during the conveying, and thus a dewatering effect on the gas hydrate n is also generated. The gas hydrate n conveyed upward is pushed toward the inner surface of the pressure-tolerable container 1*f* by the rotating discharging blades 6*f*, and guided to the discharge path 2*f* that has the opening to the inner surface of the pressure-tolerable container 1*f*. Here, since the rotating disk 7*f* is disposed above the discharging blade 6*f*, further upward movement of the gas hydrate n is restricted by the rotating disk 7, and the gas hydrate n can be introduced into the discharge path 2*f* smoothly. Particularly, in this formation apparatus, the circulating flow of a hydrate-forming gas g would cause a gas hydrate n to further move upward. Nevertheless, the rotating disk 7*f* restricts the upward movement of the gas hydrate n, and the interspaces thereof guarantee the permeability of the hydrate-forming gas g in a vertical direction. Accordingly, the circulation of the hydrate-forming gas g is never hindered, and the formation of a gas hydrate n does not suffer from an adverse influence.

In this embodiment, the rotating disk 7*f* formed of the multiple divided piece 7*af* is adopted as a regulator of the upward movement of the gas hydrate n. However, the regulator is not limited to this, and may be a rotating disk having multiple through holes. The regulator may be disposed while protruding from the inner surface of the pressure-tolerable container 1*f*. The gas hydrate n introduced through the opening part 2*af* is conveyed to the subsequent step through the discharge path 2*f* by the discharging feeder 3*f* that is driven by the drive motor M. As the discharging feeder 3*f*, a ribbon feeder, a screw feeder, or the like, is used.

Figure 29:
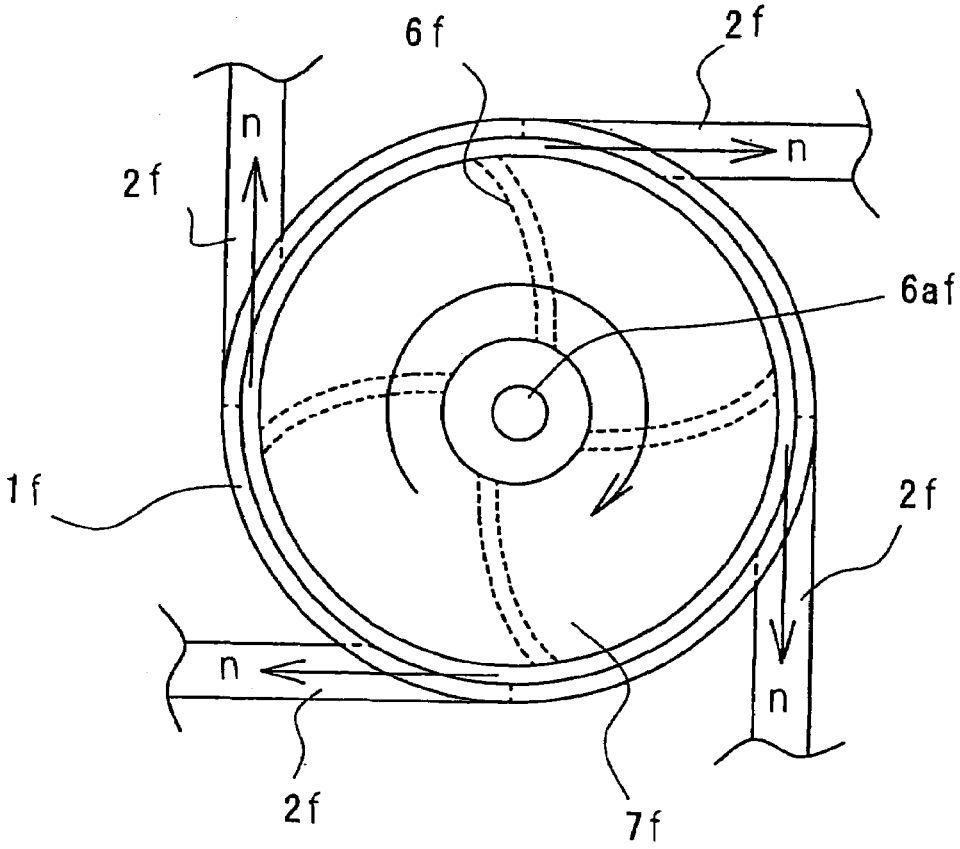
FIG. 29 is an explanatory drawing for showing an example of where a discharge path according to the present invention is disposed in a plane direction.

By providing, as shown in FIG. 29, the multiple discharge paths 2*f* in accordance with a formed amount of the gas hydrate n, the discharging efficiency can be improved. At this point, as viewed in a plane direction, the discharge paths 2*f* are preferably provided to the pressure-tolerable container 1*f* at equal intervals in a circumferential direction. The direction in which the discharge paths 2*f* are disposed is not limited to the circumferential direction, and the discharge paths 2*f* may be disposed in a radial direction.

As described above, in the gas hydrate formation apparatus of the present invention, an outer cylindrical container is no longer necessary for the pressure-tolerable container 1*f*, and the equipment is simplified, accomplishing the cost reduction. Moreover, it becomes possible to prevent a formed gas hydrate n from being firmly adhered on the inner surface of the pressure-tolerable container 1*f*, and to smoothly discharge a gas hydrate n while removing adhered water. Particularly, in a formation apparatus which continuously form a gas hydrate n, a gas hydrate can be formed and discharged efficiently and continuously.

9) Tenth to Twelfth Embodiments

Figure 30:
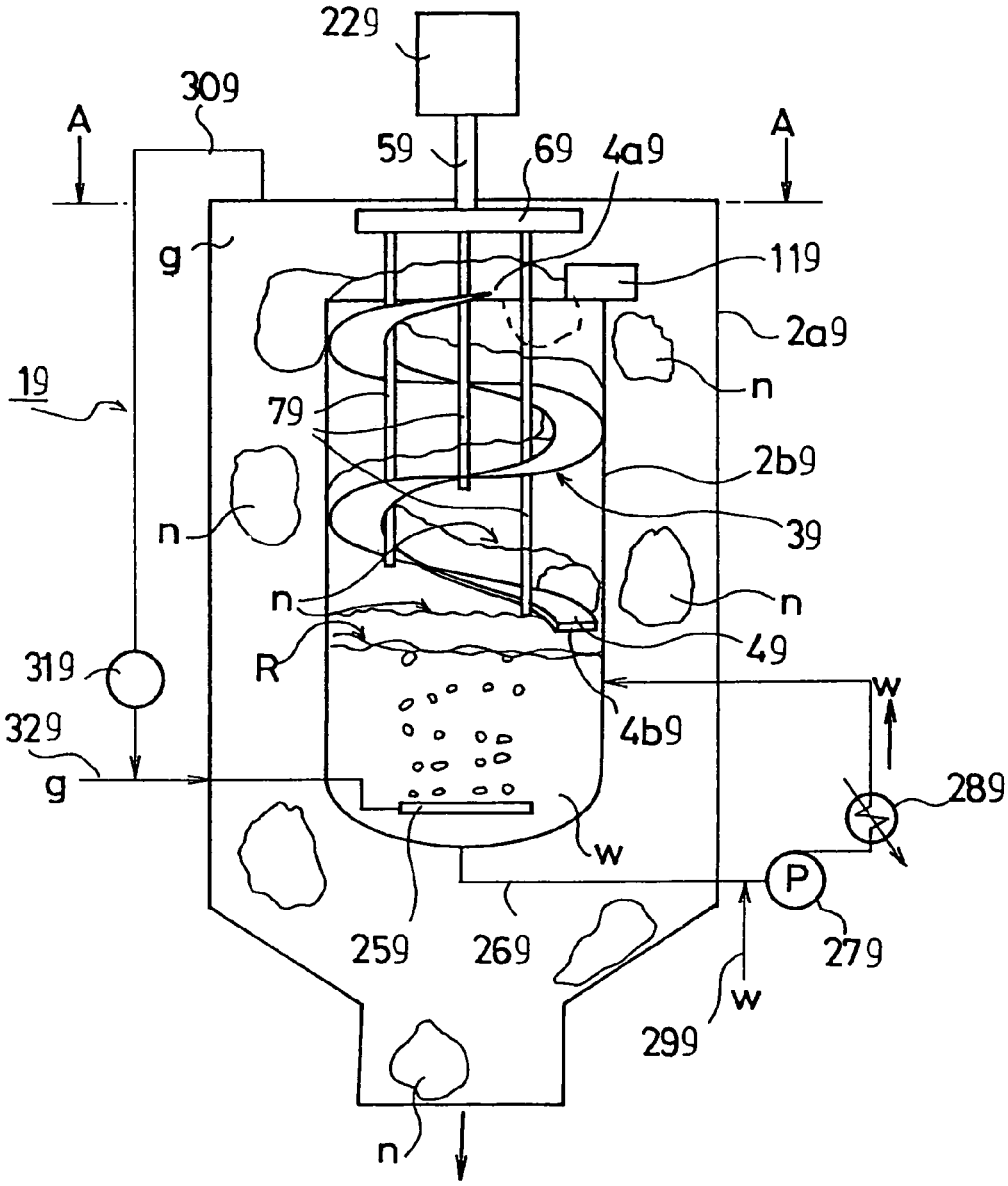
FIG. 30 is a schematic block diagram of a tenth embodiment of the gas hydrate production apparatus according to the present invention.
Figure 31:
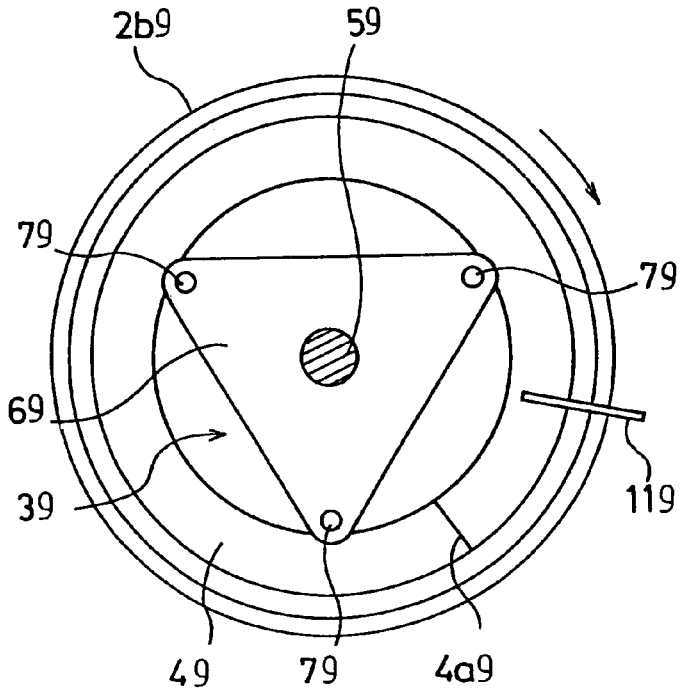
FIG. 31 is a cross-sectional view taken along A-A of FIG. 30.

Firstly, a tenth embodiment will be described. In FIG. 30 and FIG. 31, reference symbol 1*g* denotes a gas hydrate formation apparatus that includes two longitudinally long containers: an outer container 2*ag* and an inner container 2*bg*. In the inner container 2*bg*, gas-hydrate scraping means 3*g* is rotatably disposed. The outer container 2*ag* is a pressure-tolerable container. In the structure of the gas-hydrate scraping means 3*g*, a ribbon-form scraping blade 4*g* is spirally provided along an inner wall surface of the inner container 2*bg*. To describe more specifically, the gas-hydrate scraping means 3g includes: a rotation shaft 5g; a top plate 6g fixed to the rotation shaft 5g; multiple columns 7g disposed below the top plate 6g so that the columns 7g can be positioned on a concentric circle (unillustrated) with the rotation shaft 5g as a shaft center; and the ribbon-form scraping blade 4g spirally attached outside these columns 7g. The rotation shaft 5g is rotated by an electric motor 22g.

A tip end part (lower edge part) 4bg of the ribbon-form scraping blade 4g is positioned near a liquid surface R of gas-hydrate forming water, and a rear end part (upper edge part) 4ag thereof is positioned in substantially the same horizontal plane as the upper edge surface of the inner container 2bg. An upper edge of the inner container 2bg is provided with a flat-plate gas-hydrate turning part 11g facing in a radial direction so that the gas-hydrate turning part 11g can protrude into the container. Furthermore, the inner container 2bg includes a sparger 25g therein. Moreover, water w in the inner container 2bg is circulated by a pump 27g provided to a circulation path 26g, and cooled to a predetermined temperature by a cooling unit 28g. A shortage of water w is replenished by supplying water through a replenishing pipe 29g.

Figure 32:
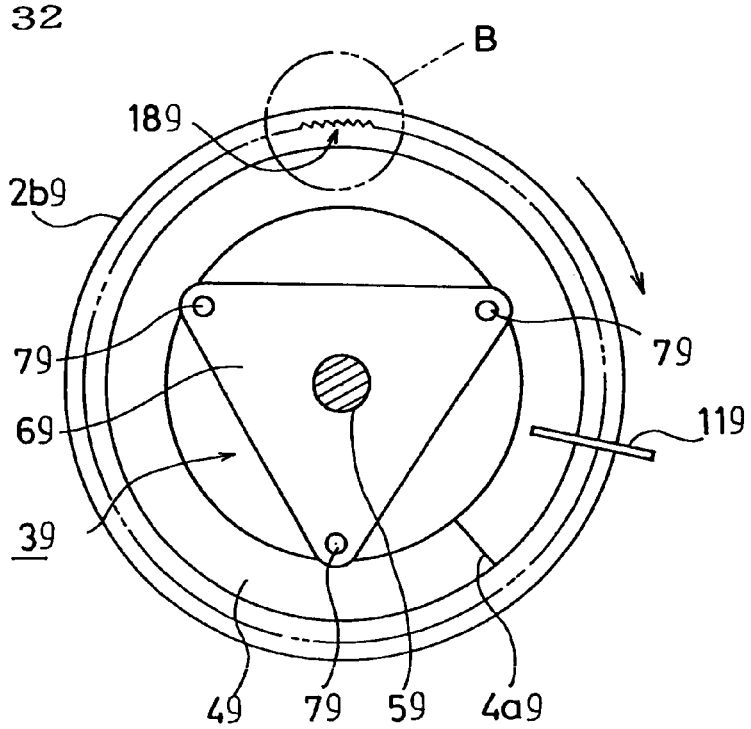
FIG. 32 is a plan view for showing a second example of an inner container.
Figure 33:
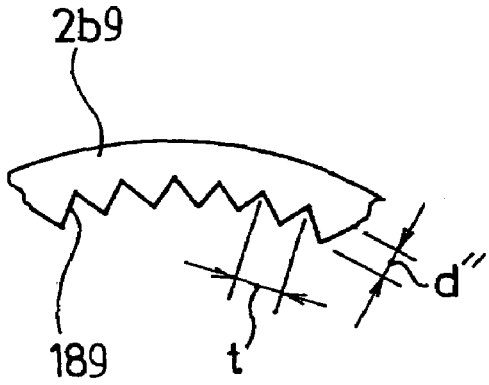
FIG. 33 is an enlarged view of a section B of FIG. 32.

In the meanwhile, a raw gas g in the pressure-tolerable container 2ag is circulated by a blower 31g provided to a circulation path 30g, but is released as an bubble form from the sparger 25g into water w. A shortage of a raw gas g is replenished from a replenishing pipe 32g. Note that, in order to prevent adherence of a gas hydrate, fine grooves 18g in a longitudinal direction should be provided across the perimeter of the inner wall surface of the inner container 2bg as shown in FIG. 32. The groove width t of this V-shaped fine groove 18g (see FIG. 33) is desirably in a range from, for example, 0.5 mm to 5 mm. Moreover, the groove depth d" is desirably in a range from, for example, 0.2 mm to 5 mm. Additionally, the V-shaped fine grooves 18f may be provided sparsely while maintaining their predetermined intervals.

Figure 34:
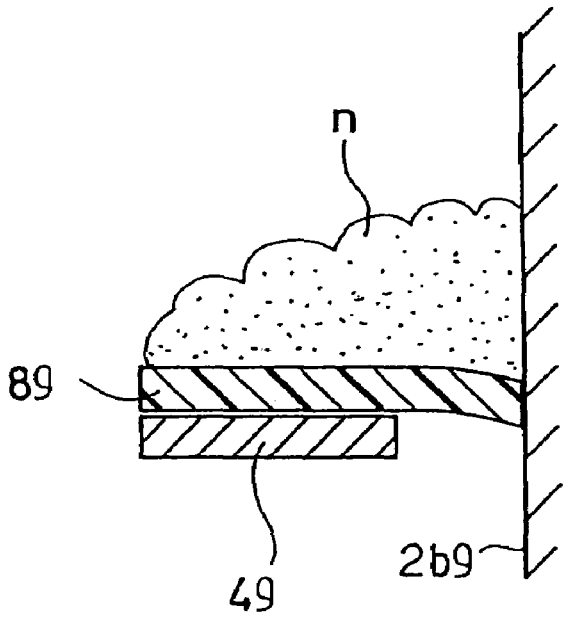
FIG. 34 is a cross-sectional view of a spatulate body disposed on a scraping blade.

Furthermore, in order to make the scraping of a gas hydrate easy, a flexible ribbon-form spatulate body 8g made of rubber, soft synthetic resins, and the like, should be mounted on the ribbon-form scraping blade 4g as shown in FIG. 34. Moreover, the upper surface of the spatulate body 8g may be roughened to prevent the sliding and falling of a gas hydrate.

Next, an operation of the above gas hydrate formation apparatus will be described. When a raw gas g of a predetermined pressure in an bubble form is released from the sparger 25g into a low-temperature water w injected in the inner container 2bg, the raw gas g reacts with the water w to thereby form a gas hydrate n that is an ice-like solid substance.

Since being lighter than the water w in terms of a specific weight, this gas hydrate n floats and forms a gas hydrate layer on a liquid surface R. Accordingly, when the gas-hydrate scraping means 3g is rotated, the layered gas hydrate n is continuously scooped by the tip end part 4bg of the ribbon-form scraping blade 4g. At this point, the water w contained in the gas hydrate n flows down along the ribbon-form scraping blade 4g. Thus, a gas hydrate having a low water content is obtained.

The gas hydrate n mounted on the ribbon-form scraping blade 4g is in a semi-cylindrical-like form, and is continuously pushed upward along the ribbon-form scraping blade 4g by later-coming gas hydrates n. Then, when the gas hydrate n reaches the upper edge part 4ag of the ribbon-form scraping blade 4g, the gas hydrate n is guided to the gas-hydrate turning part 11g protruding in the inner container 2bg, and expelled outside the inner container 2bg. The gas hydrate n expelled from the inner container 2bg goes through between the outer and inner containers 2ag and 2bg, and is discharged to the subsequent step from the lower portion of the outer container 2ag. The turning part 11g may be provided in multiple.

Figure 35:
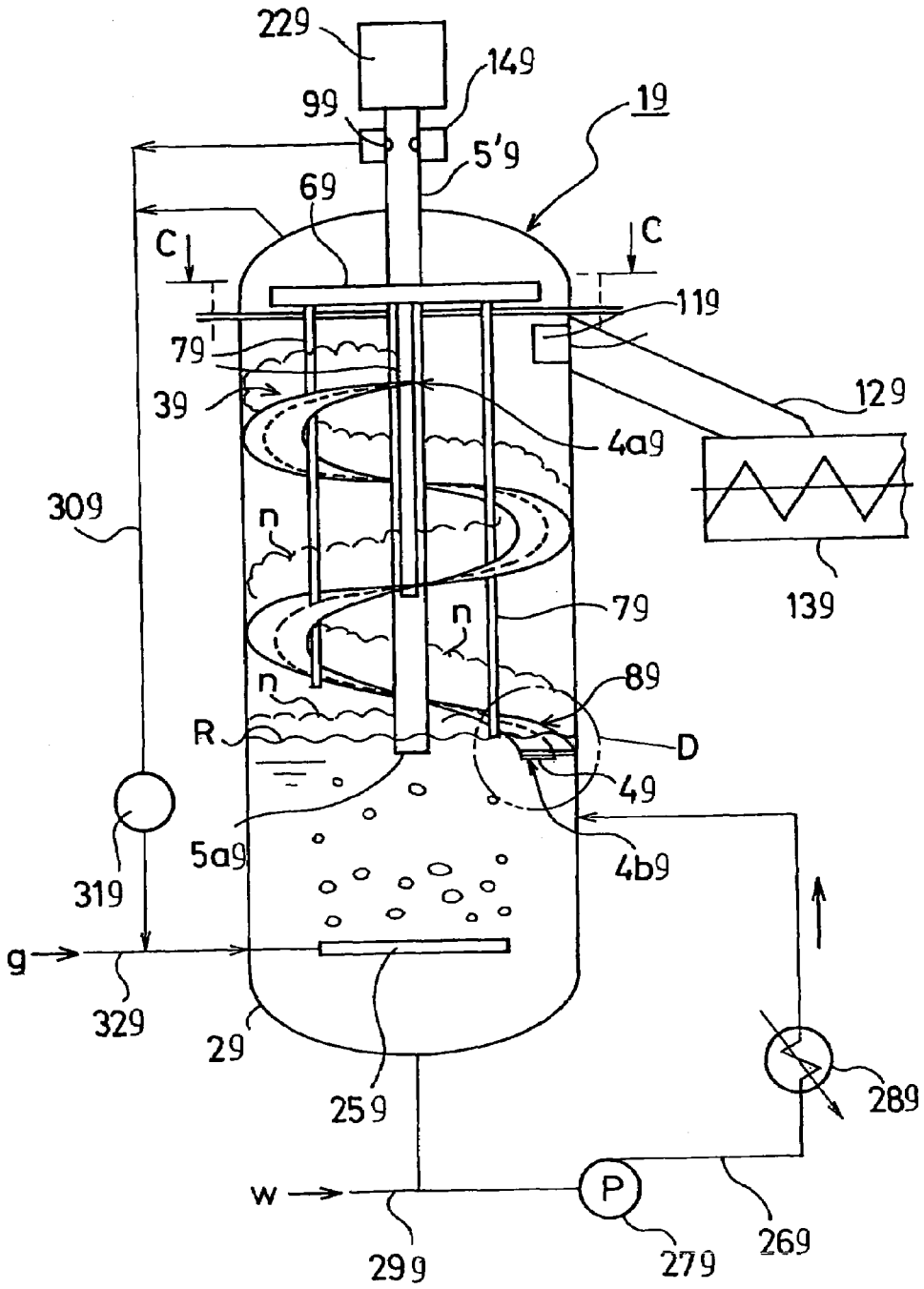
FIG. 35 is a schematic block diagram of an eleventh embodiment of the gas hydrate production apparatus according to the present invention.

Next, an eleventh embodiment will be described. Note that the same parts as those in the tenth embodiment are denoted by the same reference symbols, and the specific description will be omitted. In FIG. 35, reference symbol 1g denotes the gas hydrate formation apparatus, and the gas-hydrate scraping means 3g is rotatably disposed in a longitudinally long pressure-tolerable container 2g. Note that, in order to prevent adherence of a gas hydrate, fine grooves in a longitudinal direction should be provided across the perimeter of the inner wall surface of the pressure-tolerable container 2g. The gas-hydrate scraping means 3g includes: a degassing pipe 5'g that also serves as a rotation shaft; the top plate 6g fixed to the degassing pipe 5'g; the multiple columns 7g disposed below the top plate 6g so that the columns 7g can be positioned on a concentric circle (unillustrated) with the degassing pipe 5'g as a shaft center; and the ribbon-form scraping blade 4g spirally-attached outside these columns 7g.

Figure 37:
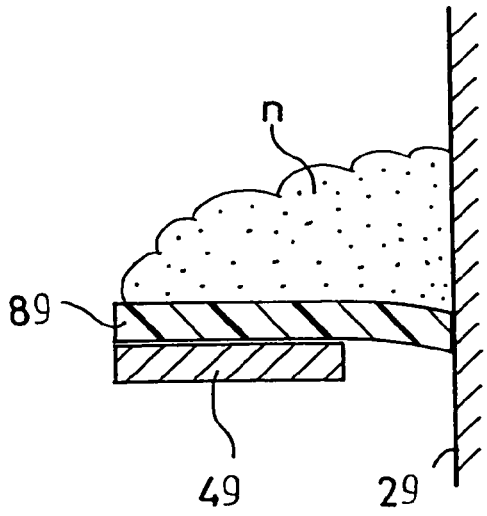
FIG. 37 is an enlarged cross-sectional view of a section D of FIG. 35.

The flexible ribbon-form spatulate body 8g made of rubber, soft synthetic resins, or the like, is mounted on the ribbon-form scraping blade 4g, thereby sealing the gap between the scraping blade 4g and the pressure-tolerable container 2g (see FIG. 37). By roughening the upper surface of the spatulate body 8g, the sliding and falling of a gas hydrate can be further prevented. The tip end part (lower edge part) 4bg of the ribbon-form scraping blade 4g is positioned near a liquid surface R of gas-hydrate forming water, and the rear end part (upper edge part) 4ag thereof is positioned near the upper edge of the pressure-tolerable container 2g.

Figure 36:
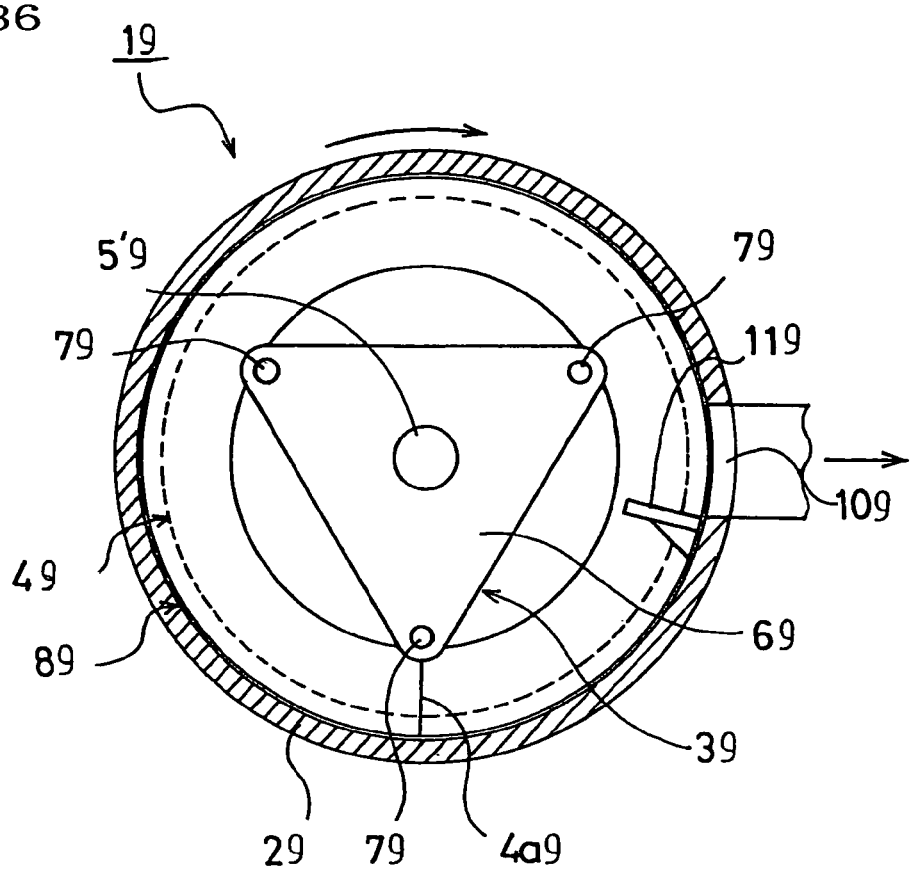
FIG. 36 is a cross-sectional view taken along C-C of FIG. 35.

Furthermore, the flat-plate gas-hydrate turning part 11g that faces the upper edge part 4ag of the ribbon-form scraping blade 4g is provided inside the pressure-tolerable container 2g (see FIG. 36). The gas-hydrate turning part 11g protrudes in the pressure-tolerable container 2g toward the center of the pressure-tolerable container 2g. Moreover, a gas-hydrate expelling opening 10g is provided to the side surface of the pressure-tolerable container 2g, corresponding to the gas-hydrate turning part 11g.

Specifically, the gas-hydrate turning part 11g is positioned, in a rotation direction of the scraping blade 4g, at a rear end part of the gas-hydrate expelling opening 10g, and smoothly expels a gas hydrate on the scraping blade 4g. A screw conveyor 13g is substantially horizontally provided outside this gas-hydrate expelling opening 10g with an inclined duct 12g in between.

The degassing pipe 5'g that also serves as the rotation shaft is provided so that a lower edge part 5ag thereof can be positioned just over a liquid surface. A raw gas that exists among gas-hydrate particles floating on the liquid surface R is discharged outside the pressure-tolerable container 2g through the degassing pipe 5'g. Moreover, the degassing pipe 5'g that also serves as the rotation shaft is driven by the electric motor 22g. Furthermore, this degassing pipe 5'g is provided with a hole 9g to remove a raw gas. A hollow container 14g to prevent gas leakage is provided outside the degassing pipe 5'g.

The pressure-tolerable container 2g includes the sparger 25g therein. Moreover, water w in the pressure-tolerable container 2g is circulated by the pump 27g provided to the circulation path 26g, and cooled to a predetermined temperature by the cooling unit 28g. A shortage of water w is covered by the replenishing pipe 29g. In the meanwhile, a raw gas g in the pressure-tolerable container 2g is circulated by the blower 31g provided to the circulation path 30g, but is released as an bubble form from the sparger 25*g* into water w. A shortage of a raw gas g is covered by the replenishing pipe 32*g*.

Next, an operation of the above gas hydrate formation apparatus will be described. When a raw gas g of a predetermined pressure in an bubble form is released from the sparger 25*g* into a low-temperature water w injected in the pressure-tolerable container 2*g*, the raw gas g reacts with the water w to thereby form a gas hydrate n that is an ice-like solid substance.

Since being lighter than the water w in terms of a specific weight, this gas hydrate n floats and forms a gas hydrate layer on a liquid surface R. Accordingly, when the spirally formed scraping means 3*g* is rotated, the layered gas hydrate n is continuously scooped by the tip end part 4*bg* of the ribbon-form scraping blade 4*g*. At this point, the water w contained in the gas hydrate n flows down along the ribbon-form scraping blade 4*g*. Thus, a gas hydrate having a low water content is obtained.

The gas hydrate n mounted on the ribbon-form scraping blade 4*g* is in a semi-cylindrical-like form, and is continuously pushed upward along the ribbon-form scraping blade 4*g* by later-coming gas hydrates n. Then, when the gas hydrate n reaches the upper edge part 4*ag* of the ribbon-form scraping blade 4*g*, the gas hydrate n is guided to the gas-hydrate turning part 11*g* protruding in the pressure-tolerable container 2*g*, and expelled into the duct 12*g* through the gas-hydrate expelling opening 10*g*. The gas hydrate n expelled into the duct 12*g* is conveyed to the subsequent step by the screw conveyor 13*g*.

Meanwhile, the degassing pipe 5'*g* discharges, outside the pressure-tolerable container 2*g*, a raw gas that exists among particles of the gas hydrate n floating on the liquid surface R. Accordingly, a smaller amount of the raw gas exists among the particles of the gas hydrate n, and thereby a gas-hydrate density can be increased.

Figure 38:
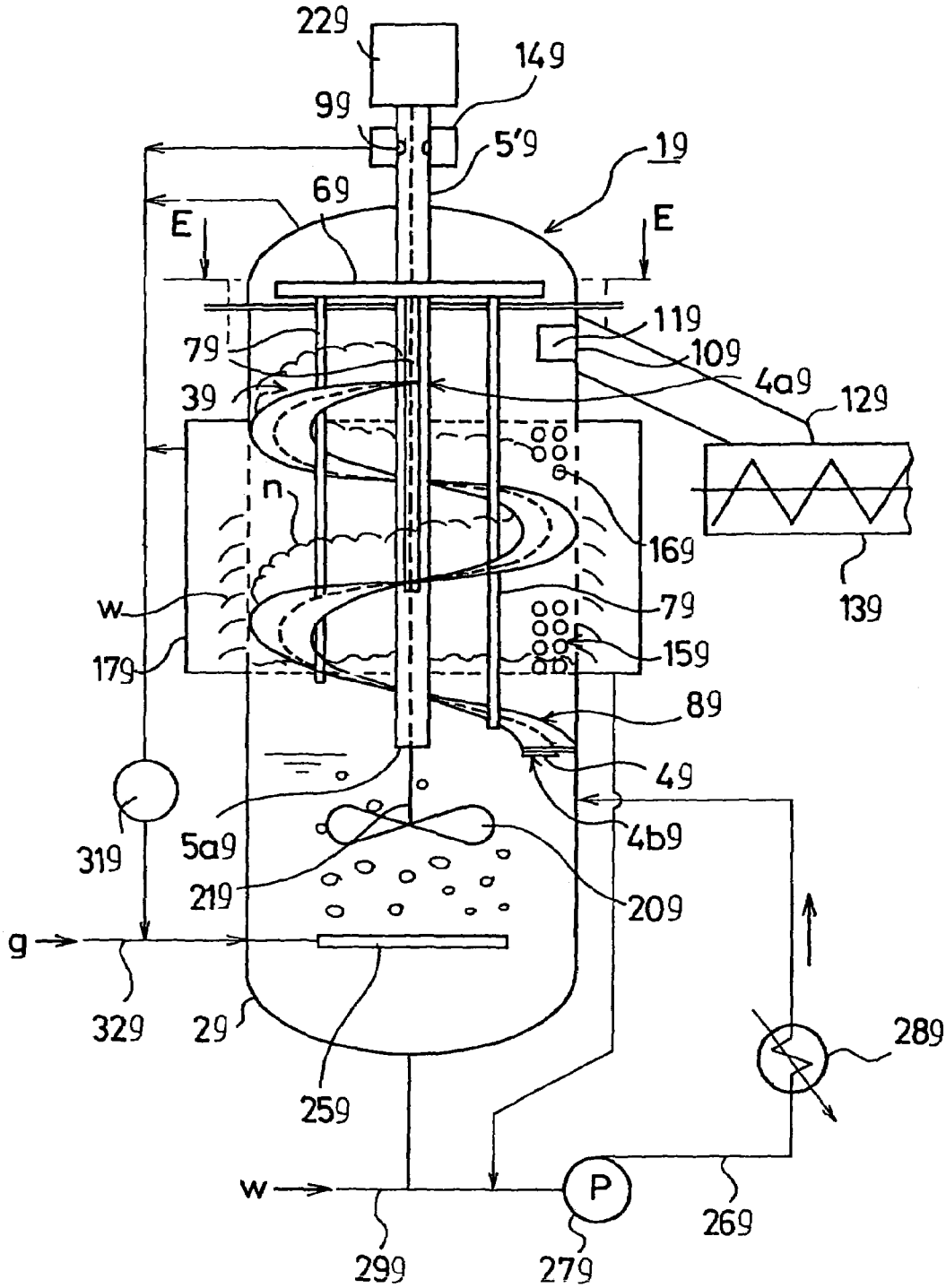
FIG. 38 is a schematic block diagram of a twelfth embodiment of the gas hydrate production apparatus according to the present invention.

Next, a twelfth embodiment will be described. Here, the same components as those in the eleventh embodiment are denoted by the same reference symbols, and the specific description will be omitted. The different points from the eleventh embodiment are the following three: a dewatering part 15*g* is disposed outside the pressure-tolerable container 2*g*; a stirrer 20*g* is disposed within the pressure-tolerable container 2*g*; and the fine grooves 18*g* are provided in the inner surface of the pressure-tolerable container 2*g* (see FIG. 38 and FIG. 39).

Figure 39:
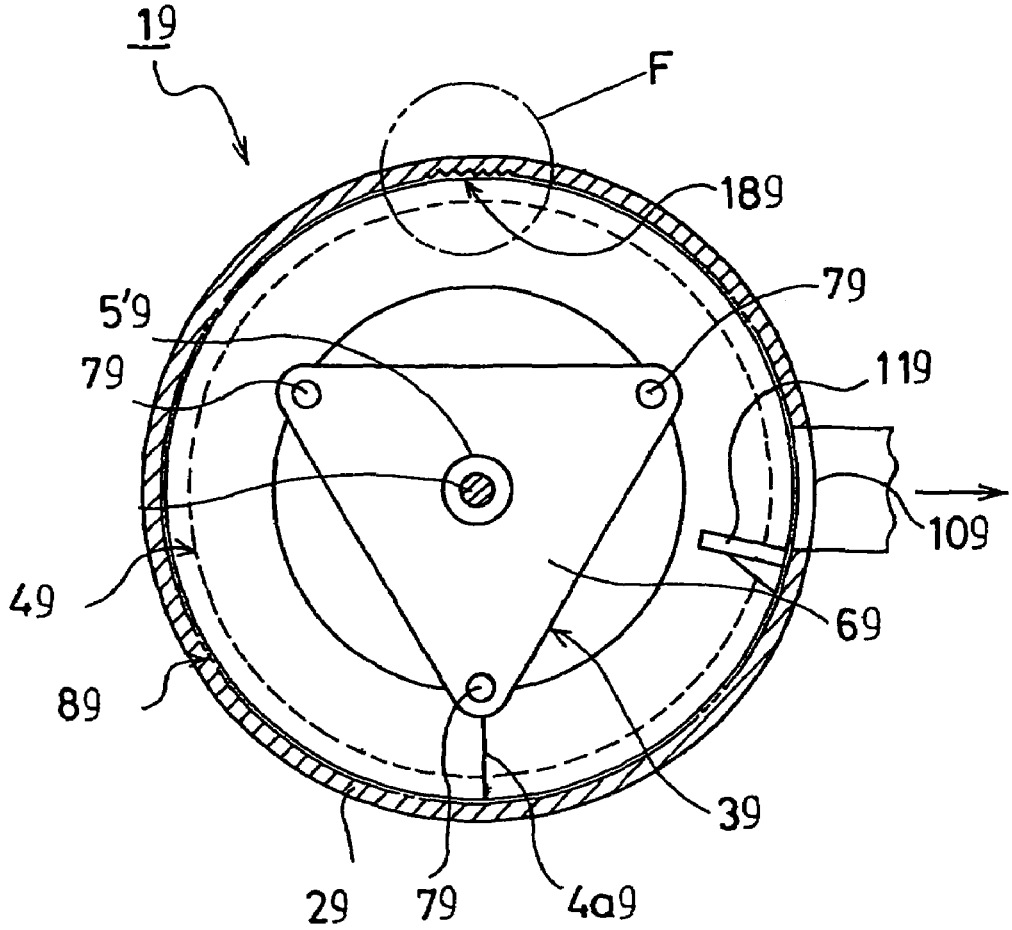
FIG. 39 is a cross-sectional view taken along E-E of FIG. 38.
Figure 40:
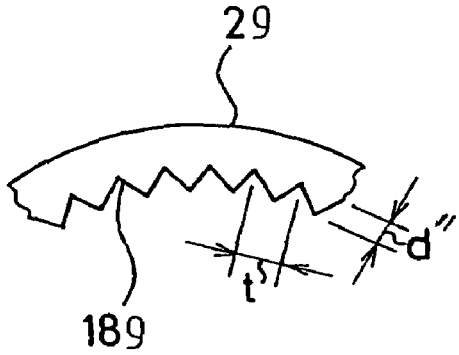
FIG. 40 is an enlarged view of a section F of FIG. 39.

Specifically, the dewatering part 15*g* is disposed to an intermediate portion of the side surface of the pressure-tolerable container 2*g*, and water accompanying a gas hydrate is removed from this dewatering part 15*g* as well. The dewatering part 15*g* is formed of, for example, a cylindrical body made of a metal mesh or a cylindrical body provided with innumerable minute holes 16*g* on a side surface thereof. A cylindrical removed-water collecting part 17*g* is provided outside the dewatering part 15*g*, and a raw gas and water are collected. Furthermore, as shown in FIG. 39, the fine grooves 18*g* in a longitudinal direction are continuously provided all over the perimeter of the inner wall surface of the pressure-tolerable container 2*g* to avoid adherence of a gas hydrate. The groove width t of this V-shaped fine groove 18*g* is desirably in a range of, for example, 0.5 mm to 5 mm. Moreover, the groove depth d" is desirably in a range of, for example, 0.2 mm to 5 mm. Additionally, the V-shaped fine grooves 18*g* may be provided sparsely while maintaining their predetermined intervals.

Furthermore, the pressure-tolerable container 2*g* includes the stirrer 20*g* therein. A rotation shaft 21*g* of this stirrer 20*g* is provided in the hollow degassing pipe 5*g*. The rotation shaft 21*g* of the stirrer 20*g* and degassing pipe 5*g* that also serves as the rotation shaft of the scraping means 3*g* are driven by the electric motor 22*g*. Their number of rotation is changed by an unillustrated transmission.

In this manner, the stirrer 20*g* is provided in the pressure-tolerable container 2*g* to stir inside the pressure-tolerable container 2*g*. Thereby, the reaction between a raw gas and water can be accelerated. The already explained pressure-tolerable container 2*g* or inner container 2*bg* has uniform diameter across its entire length. Nevertheless, when the pressure-tolerable container 2*g*, the inner container 2*bg* and the scraping means 3*g* are tapered such that their diameters are gradually made thinner toward the top, the pushing force of a gas hydrate n against the inner surface of the pressure-tolerable container 2*g* or the inner container 2*bg* is increased. Thereby, it becomes easy to conduct dewatering.

10) Thirteenth Embodiment

Figure 41:
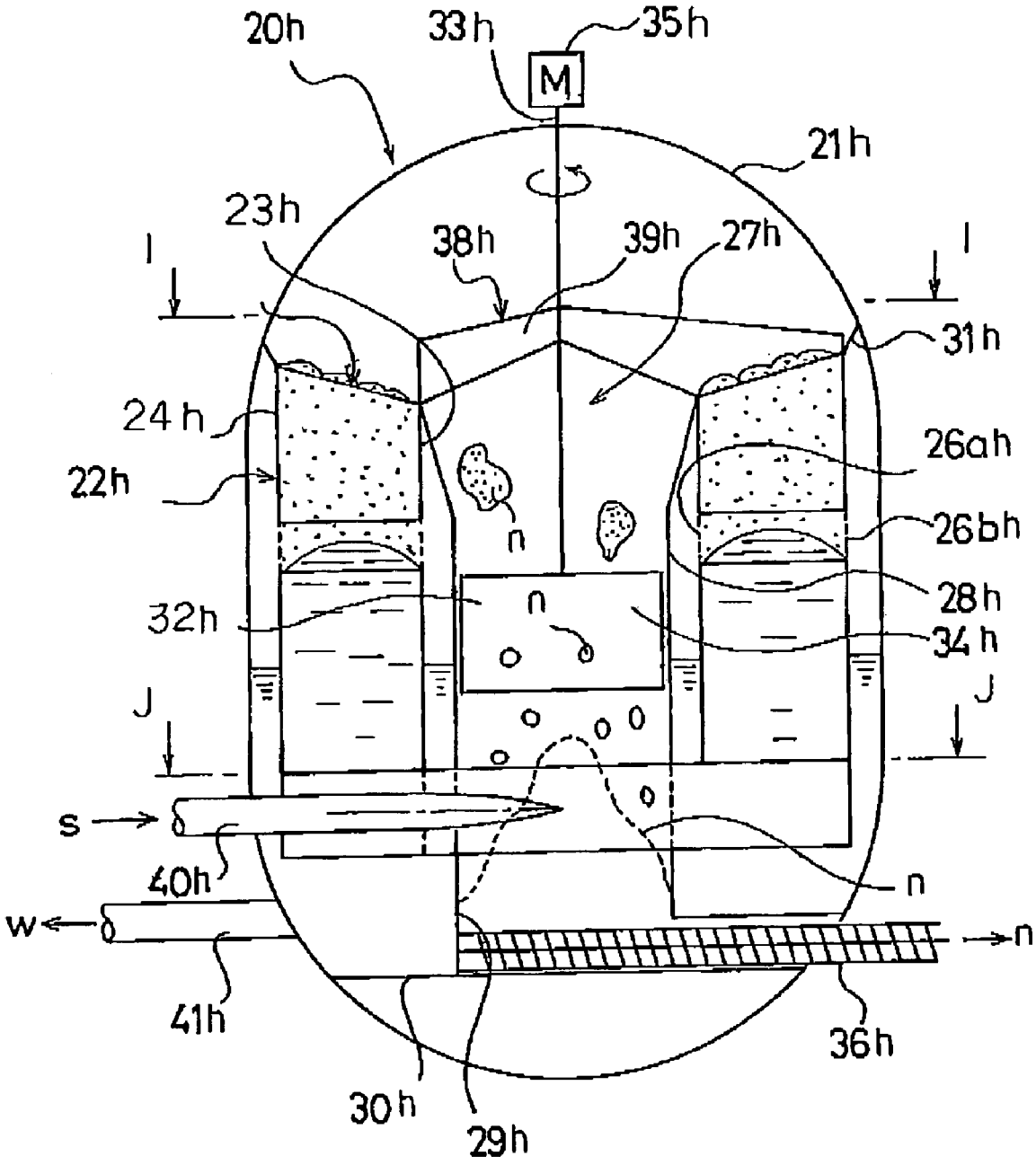
FIG. 41 is a cross-sectional view of a gravitational-dewatering type dewatering unit according to the present invention.
Figure 42:
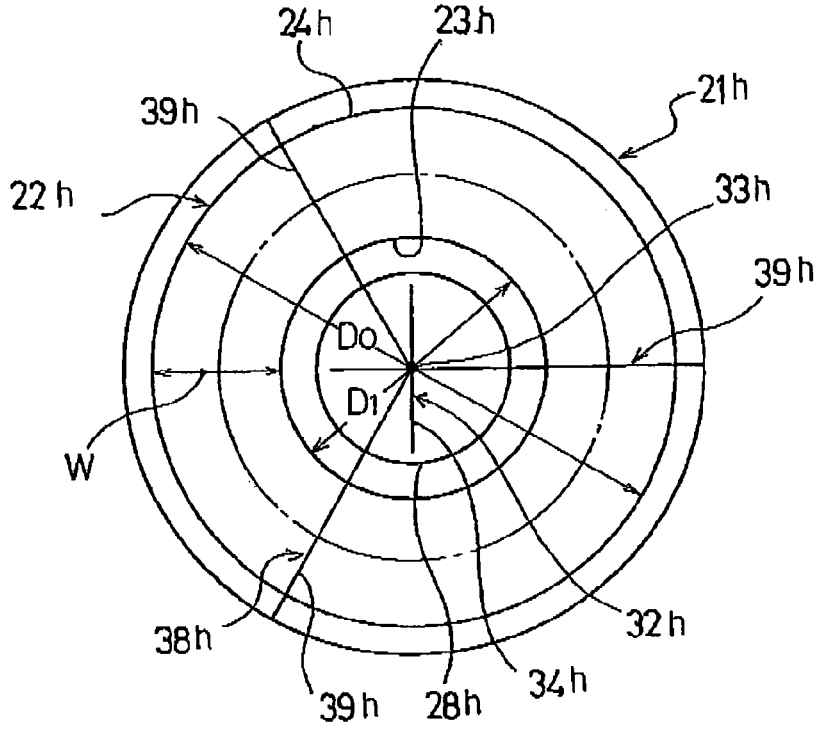
FIG. 42 is a cross-sectional view taken along the line I-I of FIG. 41.
Figure 43:
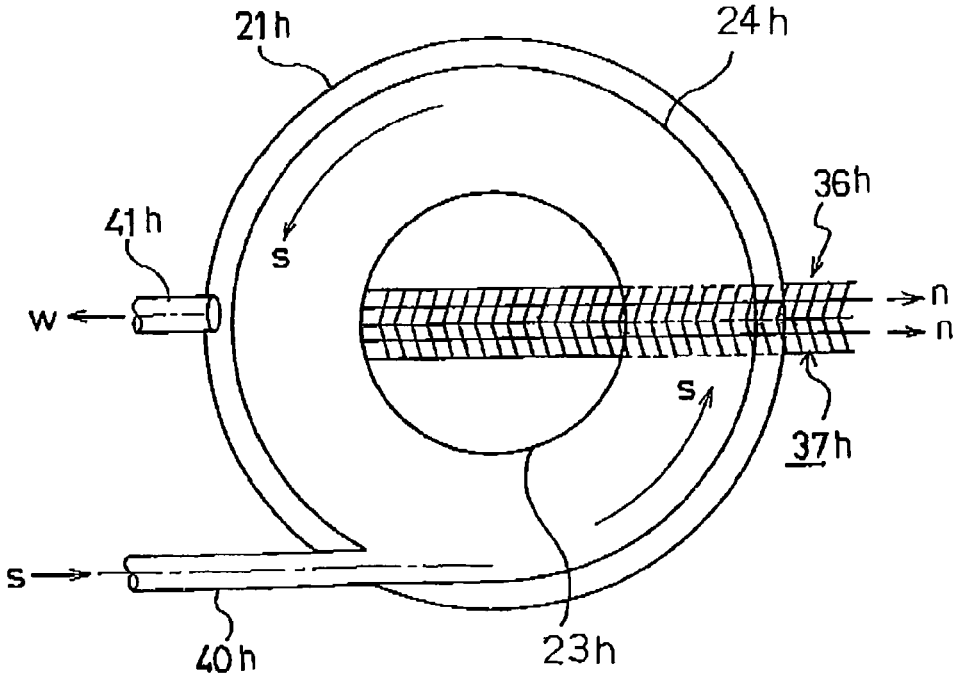
FIG. 43 is a cross-sectional view taken along the line J-J of FIG. 41.

In FIG. 41, reference numeral 20*h* denote a gravitational-dewatering type dewatering unit that has a dewatering tower 22*h* built in a pressure-tolerable container (may also be referred to as a pressure-tolerable shell) 21*h*. This dewatering tower 22*h*, as shown in FIG. 42, has a double cylindrical structure formed of: an inner cylinder 23*h* with a diameter D1 and an outer cylinder 24*h* with a diameter D0 larger than the diameter D1. Note that the upper edge of the inner cylinder 23*h* is slightly lower than the upper edge of the outer cylinder 24*h*, and an upper-edge opening part 25*h* of the dewatering tower 22*h* is in an inverted truncated conical form.

Moreover, the dewatering tower 22*h*, as shown in FIG. 41, is provided with filtration bodies 26*ah* and 26*bh* for removing water at a site of a predetermined height. In other words, the inner cylinder 23*h* is provided with the circular filtration body 26*ah* for removing liquid at the site of the predetermined height, the filtration body 26*ah* being formed of a metal mesh, porous sintered plate, or the like. Meanwhile, the outer cylinder 24*h* is provided with the filtration body 26*bh* for removing liquid at the site whose height is the same as that of the filtration body 26*ah*, the filtration body 26*bh* being formed in the same method as that of the filtration body 26*ah*. A cylindrical gas-hydrate input part 28*h* is provided in a cavity 27*h* in the center of the dewatering tower 22*h*, and a drainage tank 29*h* is formed between the gas-hydrate input part 28*h* and the pressure-tolerable container 2*h*. This drainage tank 29*h* has a circular bottom plate 30*h*. Moreover, the gap between the outer cylinder 24*h* of the dewatering tower and the pressure-tolerable container 21*h* is sealed with a circular shield plate 31*h*.

Furthermore, the dewatering tower 22*h* is provided with a crushing unit 32*h* for crushing a gas hydrate in the gas-hydrate input part 28*h*. This crushing unit 32*h* is formed of multiple flat blades 34*h* radially provided to a lower edge part of a vertical rotation shaft 33*h* that penetrates the upper part of the pressure-tolerable container 21*h* (see FIG. 42). The form of this crushing unit 32*h* is not limited to the flat blade, and may be in, for example, a rod body form. It is only necessary to be capable of crushing a mass of gas hydrate finely. Additionally, the rotation shaft 33*h* is rotated by a motor 35*h*.

In addition, a gas-hydrate discharging unit 36*h* is provided below the cylindrical gas-hydrate input part 28*h*. This gas-hydrate discharging unit 36*h* is formed by disposing multiple (for example, two) screw feeders 37*h* in parallel. Note that, as long as a dewatered gas hydrate can be discharged smoothly, the gas-hydrate discharging unit 36*h* may be formed of other than the screw feeders. Moreover, a scraper 38*h* is disposed above the dewatering tower 22*h*. This scraper 38*h* is formed by disposing three spatulas or blades 39*h* radially from the rotation shaft 33*h* (see FIG. 42). Nevertheless, as long as a dewatered gas hydrate can be scraped off from the dewatering tower 22*h*, the scraper 38*h* may be formed of other than the spatulas or blades.

Furthermore, a slurry-supplying pipe 40*h* is provided to a lower portion of the dewatering tower 22*h*, in a tangent direction of the dewatering tower 22*h*. A gas hydrate slurry supplied from the slurry-supplying pipe 40*h* to the lower portion of the dewatering tower 22*h* is caused to revolve in the dewatering tower 22*h*. Furthermore, a drainage pipe 41*h* is provided to the drainage tank 29*h*, and returns dewatered unreacted water (may also referred to as brine) w to an unillustrated generator. Moreover, the pressure-tolerable container 21*h* is provided with a piping tube (unillustrated) to return unreacted natural gas g in the pressure-tolerable container 21*h* to an unillustrated first regenerator. Now, the diameter of the outer cylinder 24*h* is denoted by $D_0$; the diameter of the inner cylinder 23 is denoted by $D_1$; and the cross-sectional area of the dewatering tower 22*h* is denoted by A. Then, the diameter $D_1$ of the inner cylinder 23*h* is expressed as follows. Specifically, $$D_1=2\sqrt{((D_0/2)^2-(A/\pi))}$$

Accordingly, suppose, for example, a plant of 2.4 T/D, and concurrently suppose that: the diameter $D_0$ of the outer cylinder 24*h* is 14.04 (m); the cross-sectional area A of the dewatering tower 22*h* is 116.11 ($m^2$) which is the same as the cross-sectional area of the conventional cylindrical dewatering tower. Thus, the diameter D1 of the inner cylinder 23*h* becomes 7.02 (m), and an interval W ($=(D_0-D_1)/2$) between the two inner and outer cylinders of the dewatering tower 22*h* is approximately 3.5 (m).

Next, an operation of this dewatering unit will be described. As shown in FIG. 41, when a gas hydrate slurry s is supplied from the slurry-supplying pipe 40*h* to the dewatering tower 22*h* having the double cylindrical structure, this gas hydrate slurry s elevates from the bottom to the top between the inner cylinder 23*h* and the outer cylinder 24*h*, while revolving in the dewatering tower 22*h* as shown in FIG. 42. When the gas hydrate slurry s reaches the positions of the circular filtration body 26*ah* provided to the inner cylinder 23*h* of the dewatering tower 22*h* and of the circular filtration body 26*bh* provided to the outer cylinder 24*h*, unreacted water w contained in the gas hydrate slurry s is discharged outside the tower through the filtration bodies 26*ah* and 26*bh*.

Specifically, the unreacted water w discharged from the filtration body 26*ah* that is provided to the inner cylinder 23*h*, flows down along the wall surface of the inner cylinder 23*h* to the drainage tank 29*h*. The unreacted water discharged from the filtration body 26*bh* that is provided to the outer cylinder 24*h*, flows down along the wall surface of the outer cylinder 24*h* to the drainage tank 29*h*. The gas hydrates n which are dewatered in passing through the filtration bodies 26*ah*, 26*bh* of the dewatering tower 22*h*, and which have a water content of approximately 40% to 50%, are sequentially pushed upward. Then, when reaching the upper opening part 25*h* of the dewatering tower 22*h*, the gas hydrate n is scraped off by the scraper 38*h*, and falls into the cylindrical gas-hydrate input part 28*h* provided in the center of the dewatering tower 22*h*. The mass of gas hydrate n scraped off into the gas-hydrate input part 28*h* is finely crushed by the crushing unit 32*h* provided in the gas-hydrate input part 28*h*, and falls to a lower portion of the gas-hydrate input part 28*h*. The gas hydrate n fallen to the lower portion of the gas-hydrate input part 28*h* is conveyed to the subsequent step, for example a second generator, by the biaxial screw feeder 37*h*. Meanwhile, the unreacted water w flowed down to the drainage tank 29*h* is returned to the unillustrated first generator via the drainage pipe 41*h*. Moreover, the natural gas g in the upper space of the pressure-tolerable container 21*h* is returned to the first generator via the piping tube (unillustrated).

11) Fourteenth and Fifteenth Embodiments

Figure 45:
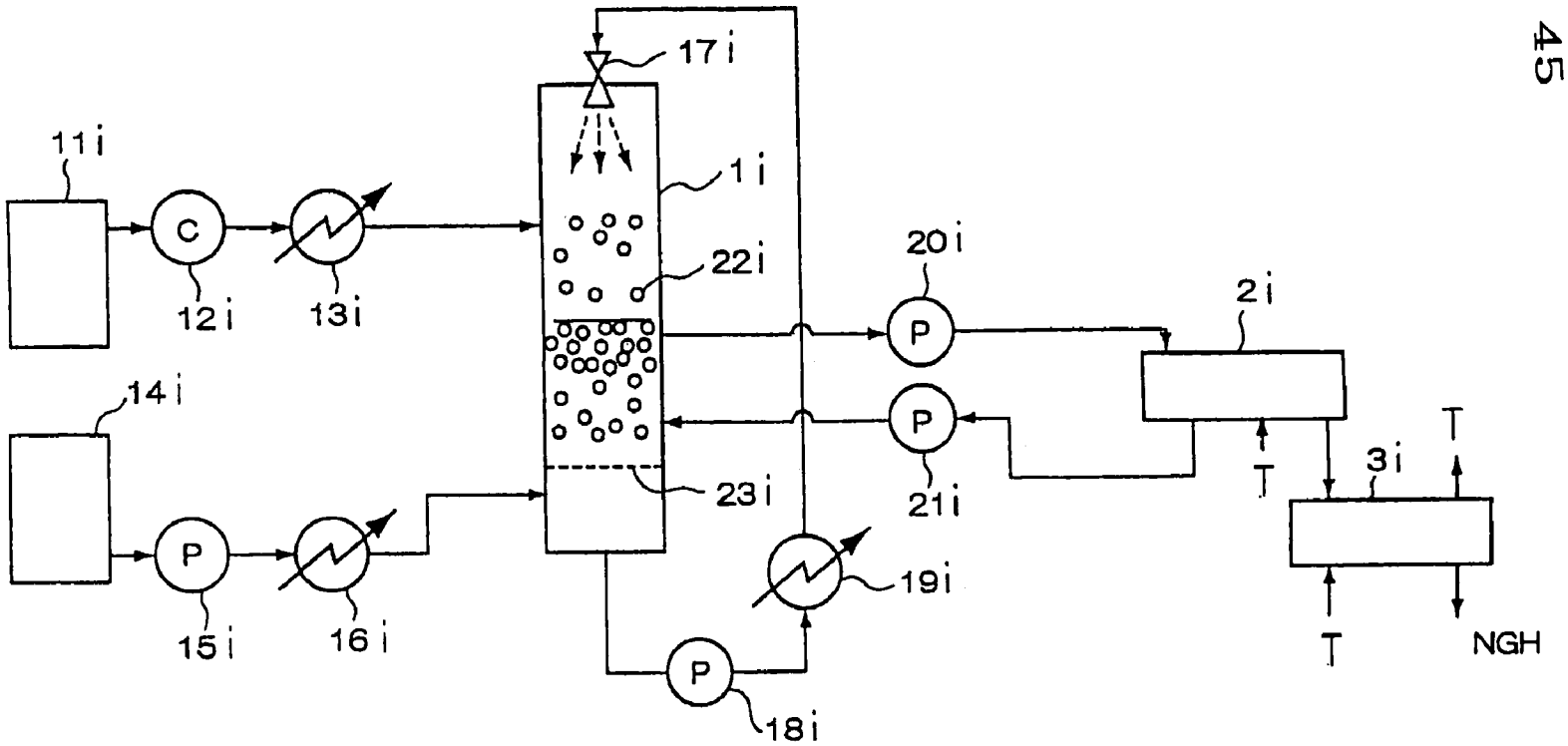
FIG. 45 is a block diagram for showing an embodiment of a hydrate production plant in which the present invention is employed.

An embodiment shown in FIG. 45 is a plant for producing a natural gas hydrate (hereinafter, abbreviated as NGH); however, the present invention is not limited to the natural gas, and can be employed for producing a hydrate of other raw gases, for example, methane gas and carbonic acid gas. As shown in the same drawing, the hydrate production plant of this embodiment is provided with: a hydrate slurry production apparatus including a generator 1*i* that forms a NGH slurry; a physical dewatering unit 2*i* that removes, with physical means or the like, water from the NGH slurry formed by the generator 1*i*; and a hydration dewatering unit 3*i* that causes natural gas to react with the water adhered to the NGH dewatered by the physical dewatering unit 2*i* to thereby increase the concentration of NGH to the product level. Any of these generator 1*i*, physical dewatering unit 2*i* and hydration dewatering unit 3*i* is maintained at predetermined high pressure (for example, 3 MPa to 10 MPa) and low temperature (for example, 1° C. to 5° C.). The generator 1*i* is formed of a cylindrical container. A top part of the container is continuously supplied with natural gas that is a cooled raw gas from a NG (natural gas) tank 11*i* via a compressor 12*i* and a cooling unit 13*i*. Meanwhile, a bottom part of the generator 1*i* is continuously supplied with cooled water from a water tank 14*i* via a pump 15*i* and a cooling unit 16*i*. A coolant is circulated to the cooling units 13*i*, 16*i* from an unillustrated freezer to thereby cool the natural gas and water supplied to the generator 1*i* to a predetermined temperature. A spray nozzle 17*i* for water is provided at the top part of the generator 1*i*. Water extracted by a water-circulation pump 18*i* that communicates with the bottom part of the generator 1*i*, is cooled by a cooling unit 19*i*, and circulated and supplied to the spray nozzle 17*i*. A coolant is circulated to the cooling unit 19*i* from an unillustrated freezer to thereby cool the water supplied to the spray nozzle 17*i* to a predetermined temperature (for example, 1° C.).

The NGH slurry formed by the generator 1*i* is continuously extracted from a middle portion of the generator 1*i* by a slurry-transfer pump 20*i*. As necessary, the NGH slurry is concentrated with an unillustrated concentrator by separating a part of the water therefrom, and then supplied to the physical dewatering unit 2*i* related to an aspect of the present invention for dewatering. The water separated from the NGH by the physical dewatering unit 2*i* is returned to the generator 1*i* by a pump 21*i*.

In the meanwhile, the NGH dewatered by the physical dewatering unit 2*i* is supplied to the hydration dewatering unit 3*i*. The water adhered to the NGH is reacted with a raw gas supplied in another way, and thereby a NGH is formed. In this manner, the concentration of NGH is sufficiently increased. As the hydration dewatering unit 3*i*, for example, biaxial screw dewatering unit described in Patent Document 3 can be employed. Nevertheless, in this embodiment, adopted is the configuration of a fluidized-bed type hydration dewatering unit 3*i* that will be described later.

Next, an operation of the gas hydrate production plant will be described. As described above, the inside of the generator 1*i* is maintained at a high pressure (for example, 3 MPa to 10 MPa) by the pressures of supplying natural gas and water, and also maintained to a cool temperature (for example, 1° C. to 5° C.) by the cooling units 13*i*, 16*i*. When sufficiently cooled water is sprayed into the generator 1*i* from the spray nozzle 17*i* at the top part, the water reacts with natural gas at a gas-phase part in the generator 1*i* to form a NGH particulate matter 22*i* that is a hydration product. The product, then, falls to a liquid-phase part. The water containing the NGH of the liquid-phase part is extracted from the bottom part by the water-circulation pump 18*i*, and again sprayed from the spray nozzle 171 in the generator 1*i*, after passing through the cooling unit 19*i*. Note that, in order to suppress the water extracted by the water-circulation pump 18*i* from being mixed with a NGH, a filter 23*i* made of a porous plate or the like is provided to the bottom part of the generator 1*i*. Moreover, since the NGH formation reaction in the generator 1*i* releases heat, the circulating water is cooled by the cooling unit 19*i* closely to a temperature at which the circulating water is frozen, in order to maintain the temperature in the generator 1*i* to the preset temperature. In this condition, the water is circulated to the spray nozzle 17*i*.

In this manner, by circulating and spraying water, NGHs are continuously formed. The formed NGH is lighter than water in terms of a specific weight. Thus, the NGH concentration near the water surface of the liquid-phase part is the highest. This extracted NGH slurry is generally low in concentration (for example, 0.5 weight % to 5 weight %). Accordingly, the NGH slurry is concentrated by a concentrator, and then dewatered by the physical dewatering unit 2*i* related to an aspect of the present invention.

Meanwhile, the NGH dewatered by the physical dewatering unit 2*i* is supplied to the hydration dewatering unit 3*i*. The water adhered to the NGH is reacted with a raw gas supplied in another way, and thereby a NGH is formed. In this manner, the concentration of NGH is sufficiently increased.

Figure 47:
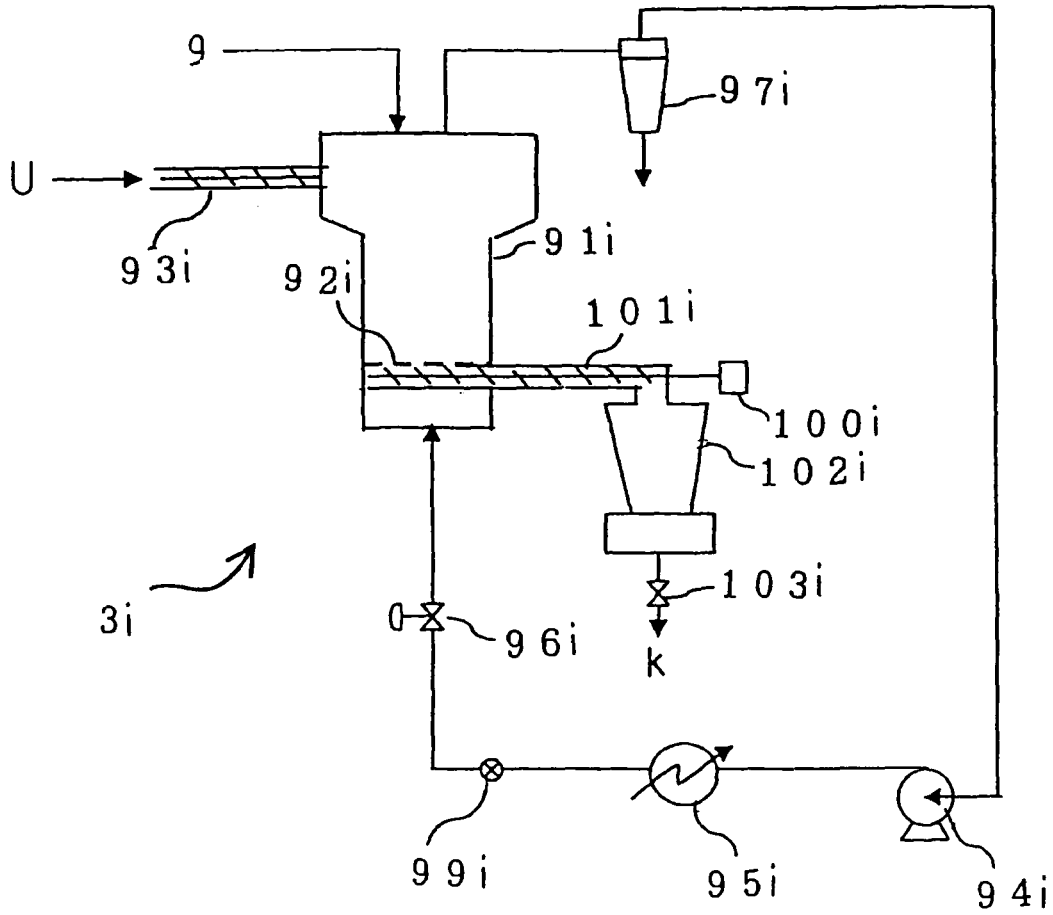
FIG. 47 is a block diagram for showing an embodiment of a fluid-bed type hydration dewatering unit of the hydrate production plant in which the present invention is employed.

Here, the specific configuration of the fluid-bed type hydration dewatering unit 3*i* of this embodiment will be described. As shown in FIG. 47, a fluidized-bed-reaction tower 91*i* is formed into a vertical cylindrical form, and natural gas that is a raw gas is supplied to the top part of the tower. Additionally, an air-diffusion unit such as air-diffusion nozzle and a dispersion plate, herein a porous plate 92*i*, is provided at a certain height position from the bottom part of the tower. After being conveyed by a screw conveyor 93*i*, a NGH of low concentration (for example, 45 weight % to 55 weight %) is inputted into an upper portion of the porous plate 92*i*. Moreover, natural gas that is a raw gas is blown as a fluidized gas between the bottom part and the porous plate 92*i* from a circulating-gas blower 94*i* via a cooling unit 95*i* and a flow-amount controlling valve 96*i*. The top part of the fluidized-bed-reaction tower 91*i* communicates with a suction end of the circulating-gas blower 94*i* via a cyclone 97*i*. Thereby, the natural gas that is the fluidized gas is circulated into fluidized-bed-reaction tower 91*i*. Furthermore, a thermometer 99*i* is provided on the downstream side of the cooling unit 95*i*. Although unillustrated, a flow amount of coolant of the cooling unit 95*i* is controlled so that the detection temperature of the thermometer 99*i* can be maintained at a preset temperature. These circulating-gas blower 94*i*, cooling unit 95*i*, cyclone 97*i*, and the like, form a raw-gas circulating unit.

Meanwhile, one end of a screw conveyor 101*i* that is driven by a motor 100*i*, is inserted to a lower side of the porous plate 92*i*. An opening is formed at the site of the porous plate 92*i* where the screw conveyor 101*i* is inserted, and an opening is formed in a casing of the screw conveyor 101*i* so as to face with the opening in the porous plate 92*i*. Thereby, a NGH of high concentration near the porous plate 92*i*, the high concentration being due to a fluidized-bed reaction, is conveyed by a screw conveyor 101*i*. The other end of the screw conveyor 101*i* communicates with the upper part of a hopper 102*i* that stores a NGH product. Moreover, although unillustrated, the load of the screw conveyor 101*i* is detected in accordance with a current of the motor 100*i*, or the like. In order to make the detected value be within a setting range, a circulating-gas amount is adjusted by controlling the flow-amount controlling valve 96*i*. In this manner, the concentration of the NGH product can be maintained at a desired value.

Note that, instead of, or in addition to, adjusting the circulating-gas amount, or in addition to adjusting the circulating-gas amount, by controlling at least one of a conveying amount of the screw conveyor 101*i* and a flow amount of coolant of the cooling unit 95*i*, the concentration of the NGH product may be controlled at a predetermined value. Furthermore, the fluidized-bed-reaction tower 91*i* in the drawing has a large diameter part in the upper part there, the part being termed a freeboard. However, the fluidized-bed-reaction tower 91*i* is not limited only to this form, and may have the uniform diameter entirely.

In the above-described configuration, when natural gas is jetted through the porous plate 92*i* to a NGH layer inputted and formed in the fluidized-bed-reaction tower 91*i*, a NGH fluidized-bed is formed on the upper part of the porous plate 92*i*. In this fluidized-bed, water adhered to the NGH and cooled natural gas are actively reacted with each other to thereby form a NGH. The NGH concentration can be increased to, for example, 90 weight % or more. The particulate NGH obtained by increasing the ratio of forming NGH as described above is conveyed by the screw conveyor 101*i* to the hopper 102*i* to be stored therein temporarily. The particulate NGH stored in the hopper 102*i* is cut off, as appropriate, with a discharging valve 103*i*, and thus processed as a NGH product, or conveyed to a NGH-pellet production apparatus or the like for further processing. Note that, since the inside of the hopper 102*i* is high in pressure (for example, 3 MPa to 10 Mpa), generally a depressurizing unit is provided on the downstream side of the discharging valve 103*i*, although unillustrated here.

Meanwhile, among the raw gas that forms a fluidized-bed in the fluidized-bed-reaction tower 91*i*, a raw gas that does not contribute to the hydration reaction is sucked from the top part of the tower via the cyclone 97*i* by the circulating-gas blower 94*i*. The raw gas sucked by the circulating-gas blower 94*i* is cooled by the cooling unit 95*i*, and returned to the lower side of the porous plate 92*i* of fluidized-bed-reaction tower 91*i* via the flow-amount controlling valve 96*i*. This cooling unit 95*i* cools the raw gas elevated due to the hydration reaction heat of the fluidized-bed. Thus, the temperature of the fluidized-bed-reaction tower 91*i* is maintained at a low temperature (for example, 1° C. to 5° C.) suitable for NGH formation to promote the reaction.

Figure 44:
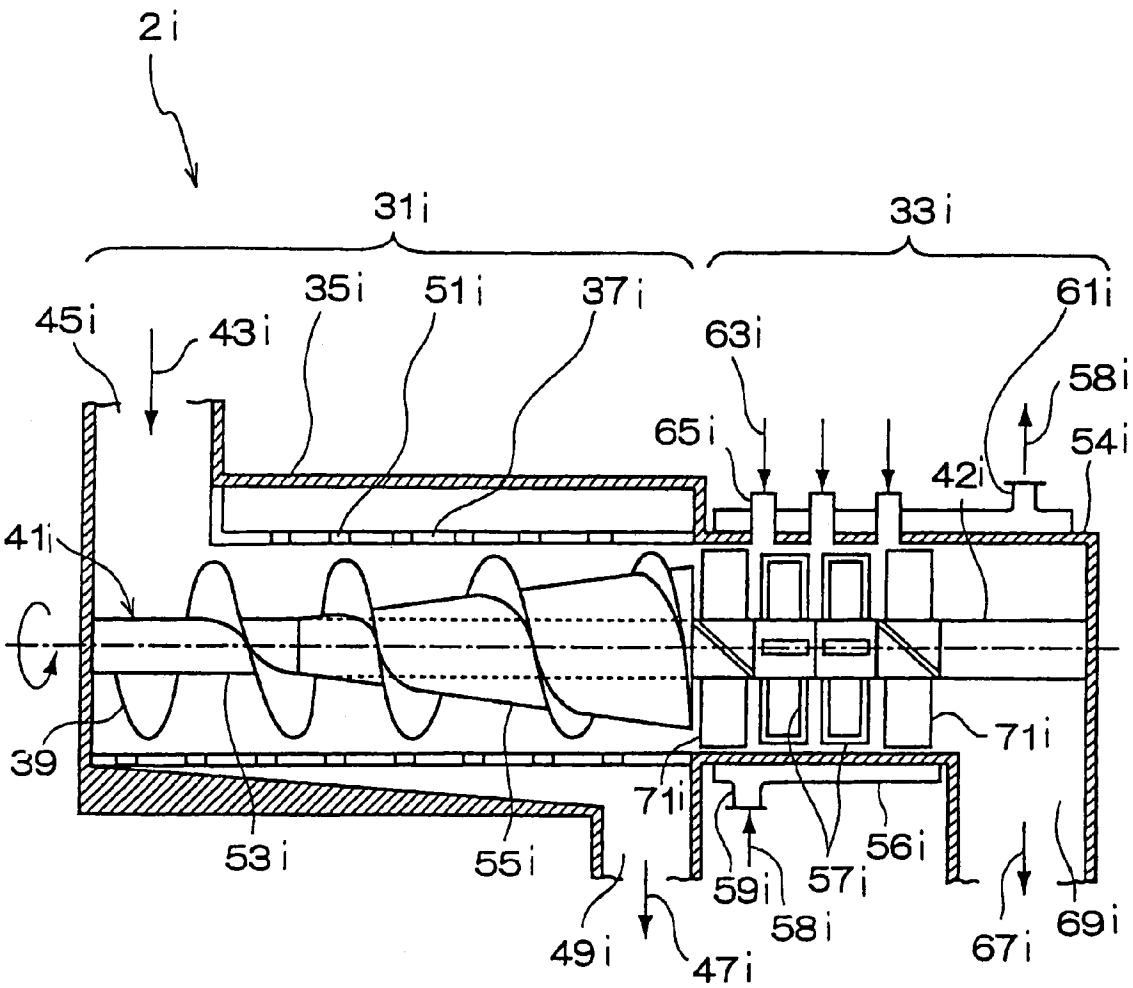
FIG. 44 is a cross-sectional view for showing an embodiment of a physical dewatering unit according to the present invention.

Next, a specific configuration of an embodiment of the physical dewatering unit 2*i* related to an aspect of the present invention will be described with reference to FIG. 44.

The physical dewatering unit 2*i* of this embodiment, as shown in the drawing, includes: a physical-dewatering area 31*i*; and a hydration-dewatering area 33*i*. The physical-dewatering area 31*i* is provided with: a cylindrical high-pressure shell 35*i*; a cylindrical dewatering screen 37*i* disposed in the high-pressure shell 35*i*; and a rotation shaft 41*i* which is disposed in a space within the dewatering screen 37*i*, and which includes a screw blade 39*i*.

An upper end part of the high-pressure shell 35*i* is provided with a supplying inlet 45*i* from which a NGH slurry 43*i* is taken in. Meanwhile, a lower part of the opposite end thereto is provided with a discharging outlet 49*i* from which a water 47*i* is discharged, the water 47*i* being separated from the NGH slurry 43*i*. Moreover, the lower part, on the inner side, of the high-pressure shell 35*i* is formed to be inclined toward the discharging outlet 49*i* so that the separated water 47*i* can flow to the discharging outlet 49*i*. Holes 51*i* through which the water 47*i* separated from the NGH slurry 43*i* flows, are formed all over the perimeter of the dewatering screen 37*i*. In this respect, it is not always necessary that the holes 51*i* be formed all over the perimeter. It is only necessary that the holes 51*i* be formed at least in the lower part of the dewatering screen 37*i*. Moreover, fundamentally, the size of the hole 51*i* is set so that only water, but not a gas hydrate, can pass therethrough; nevertheless, a part of gas hydrate may flow therethrough. Additionally, the hole 51*i* may be formed in a slit form, for example.

The rotation shaft 41*i* is formed of: a straight part 53*i* that extends straightly; and a taper part 55*i* whose diameter is expanding in an axial direction radially, the straight part 53*i* and the taper part 55*i* being connected to each other in a conveying direction. The rotation shaft 41*i* is rotatably connected to an unillustrated driving unit. The screw blade 39*i* is formed spirally along the rotation 41*i*, and the screw blade 39*i* is disposed in the vicinity of the inner peripheral surface of the dewatering screen 37*i*.

On the other hand, the hydration-dewatering area 33*i* is provided with: a cylindrical container 54*i*; a cooling jacket 56*i* attached to an outer periphery of the container 54*i*; and a rotation shaft 42*i* which is disposed in a space within the container 54*i*, and which has a gate-form stirring blade 57*i*.

One end of the container 54*i* is connected to an edge part of the dewatering screen 37*i*, and this connection part is covered with the high-pressure shell 35*i* and thus formed. Specifically, the container 54*i* is formed integrally therewith by extending the high-pressure shell 35*i* in an axial direction. A lower part of the other end of the container 54*i* is provided with a discharging outlet 69*i* from which a dewatered NGH 67*i* is discharged.

The cooling jacket 56*i* is attached on the perimeter of the entire outer periphery of the container 54*i*. At a lower part thereof, an introducing inlet 59*i* is formed to take in a cooling medium 58*i*. At an upper portion, a discharging outlet 61*i* is formed to discharge the cooling medium 58*i*. Moreover, at the outer periphery of the container 54*i*, multiple gas-supplying pipes 65*i* are disposed to take natural gas 63*i* as a raw gas into the container 54*i*.

The rotation shaft 42*i* is connected to one end of the taper part 55*i* of the rotation shaft 41*i* which shares the shaft line with the rotation shaft 42*i*. The rotation shaft 42*i* is driven to rotate with the rotation shaft 41*i*. The multiple gate-form stirring blades 57*i* are provided around the rotation shaft 42*i* so that each of two leg parts may be aligned in an axial direction of the rotation shaft 42*i*, and the multiple blades 57*i* are provided in the axial direction. On inlet and outlet sides of the hydration-dewatering area 33*i*, multiple flat-plate sending blades 71*i* are attached around the shaft, while inclining from the axial direction of the rotation shaft 42*i*. Note that one end of the rotation shaft 41*i* and the end, on the opposite side, of the rotation shaft 42*i* are pivotally supported by two edge surfaces of the high-pressure shell 35*i* and the container 54*i*, respectively.

Next, an operation of the physical dewatering unit 2*i* configured in the above manner will be described. Firstly, the NGH slurry 43*i* extracted from the generator 1*i* by the slurry-transfer pump 20*i* is introduced into the dewatering screen 37*i* through the supplying inlet 45*i*. The NGH slurry 43*i* introduced into the dewatering screen 37*i* is conveyed in the axial direction through the groove space of the screw blade 39*i* by rotating the rotation shaft 41*i*. In this process, the NGH slurry 43*i* is gradually compressed, and the water is separated therefrom. This separated water 47*i* flows outside through the holes 51*i* in the dewatering screen 37*i*, and is discharged from the discharging outlet 49*i*. In this way, the water can be removed to some extent while the NGH slurry 43*i* passes through the physical-dewatering area 31*i*. However, water is still adhered to, for example, the NGH particle surface.

Thus, in this embodiment, the hydration-dewatering area 33*i* is provided to the subsequent stage of the physical-dewatering area 31*i* to remove the water adhered to the NGH by hydration reaction. Specifically, the NGH introduced from the physical-dewatering area 31*i* into the container 54*i* is conveyed while being stirred in the container 54*i*, for example, by rotating the stirring blade 57*i*. Simultaneously, the NGH is exposed to an atmosphere of the natural gas 63*i* that is introduced into the container 54*i* from the gas-supplying pipe 65*i*. Thereby, the water adhered to the NGH comes into contact with and reacts with the natural gas 63*i* to conduct hydration dewatering.

Note that, although heat is released in the hydration reaction, the heat is recovered from the outer periphery of the container 54*i* through the cooling jacket 56*i*. Thus, the inside of the container 54*i* is maintained in a temperature range suited for the hydration reaction. In addition, the natural gas 63*i* supplied into the container 54*i* is forced to be circulated by a pump or the like, and thus unreacted natural gas 63*i* is always supplied into the container 54*i*. Thereby, a high reaction rate of the hydration reaction in the container 54*i* can be maintained.

As described above, in the physical dewatering unit 2, the NGH slurry after the physical dewatering, is continuously subjected to the hydration dewatering. Thus, in comparison with the conventional physical dewatering, a high dewatering rate can be obtained. Therefore, for example, after the NGH slurry is brought to the later stage, hydration dewatering can be conducted in the fluidized-bed without any trouble, allowing a wider option for hydration dewatering, and also the concentration of NGH that is a final product, can be maintained to be high. Moreover, by conducting hydration dewatering on the NGH having a high dewatering rate, the load at hydration dewatering, namely, the load to heat recovery equipment or the like, can be lowered, and thus economical advantage is obtained.

Moreover, in this embodiment, the amassed gas hydrate that is discharged in the physical dewatering step is disintegrated due to the stirring effect of the stirring blade 57*i*. Thereby, the hydration dewatering efficiency in the subsequent step of the fluidized-bed can be increased.

Furthermore, in this embodiment, the physical-dewatering area 31*i* and the hydration-dewatering area 33*i* are accommodated in the single container, and continuously processed. Thus, obtained effects are that the configuration of the system is simplified, and that the setting area can be reduced.

Figure 46:
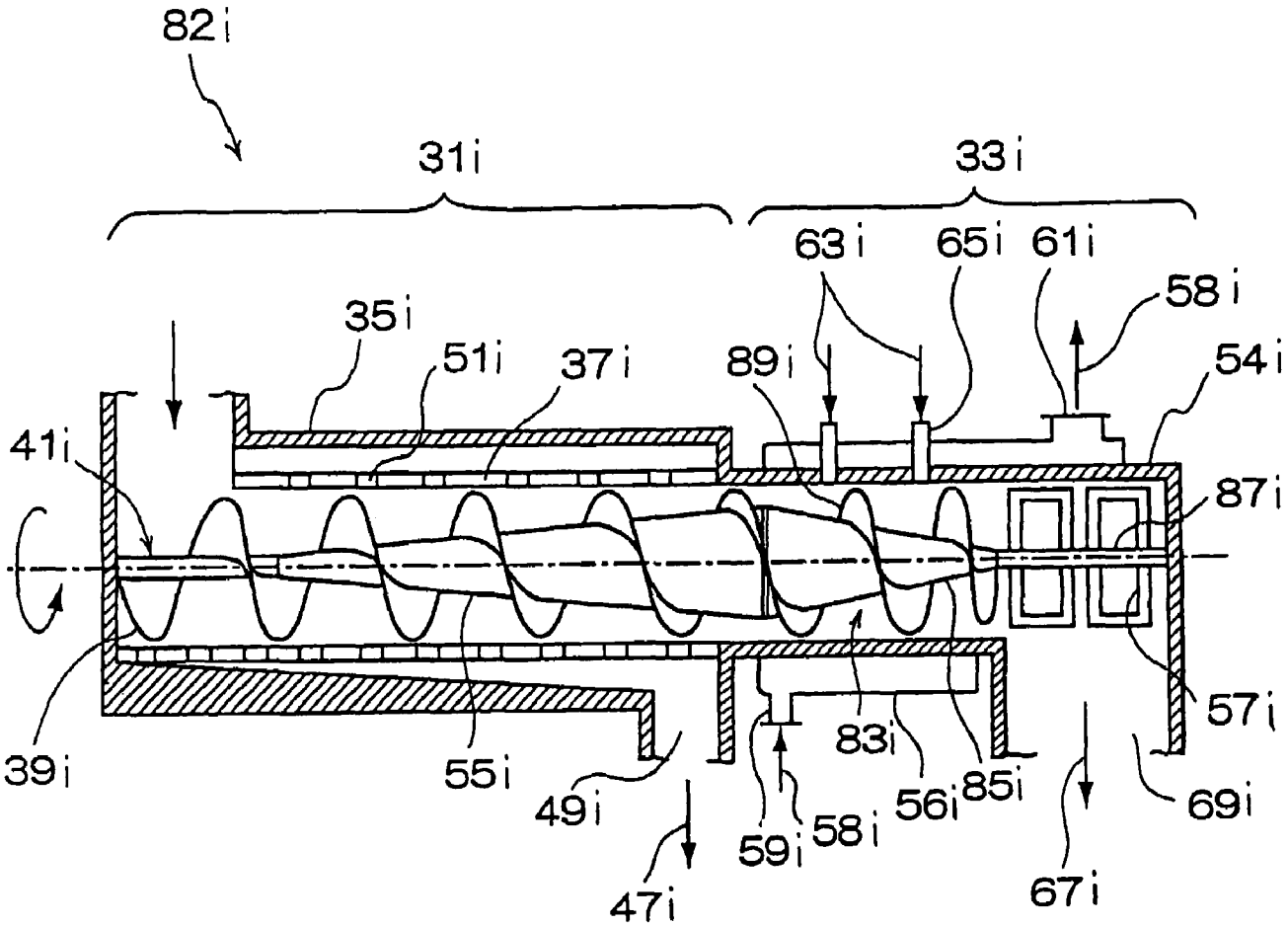
FIG. 46 is a cross-sectional view for showing another embodiment of the physical dewatering unit according to the present invention.

Next, another embodiment of the physical dewatering unit related to an aspect of the present invention will be described with use of FIG. 46. Note that, the same constituents as those in the above embodiment are denoted by the same reference symbols, and the description will be omitted.

A physical dewatering unit 82*i* of this embodiment is different from that of the above embodiment in that, in the hydration-dewatering area 33*i*, a NGH is stirred and conveyed with a screw. Specifically, a rotation shaft 83*i* of this embodiment is connected to one end of the taper part 55*i* on the shaft line of the rotation 41*i*. The rotation shaft 83*i* is formed of: a taper part 85*i* whose diameter is reduced in an axial direction; and a straight part 87*i* that extends straightly, the taper part 85*i* and the straight part 87*i* being connected to each other in a conveying direction. A screw blade 89*i* is formed spirally in an axial direction on the outer periphery of the taper part 85*i*, and the screw blade 89*i* is disposed in the vicinity of the inner peripheral surface of the container 54*i*. Moreover, the stirring blade 57*i* is formed on the outer periphery of the straight part 87*i*.

According to this embodiment, the same effects as those of the above embodiment can be obtained, and a high dewatering rate can be obtained in comparison with a case of conventional physical dewatering.

Note that, in this embodiment, the different type of stirring means in the hydration-dewatering area 33*i* has been described. However, as long as a NGH is continuously stirred in an environment where a raw gas is supplied, the stirring means is not limited to this. Note that, in the drawings, reference symbol T denotes a raw-gas inlet; reference symbol T' denotes a raw-gas discharging outlet; and reference symbol U denotes a low concentration NGH.

What is claimed is:

1. A gas-hydrate dewatering unit for introducing a gas hydrate formed by reacting a gas with water into a dewatering tower together with unreacted water, for elevating the gas hydrate upward from the bottom of the dewatering tower, and for causing the unreacted water to flow, during the elevation, outside the dewatering tower through a filtration part provided to a side wall surface of the tower, the gas-hydrate dewatering unit characterized by comprising:

a pressure-tolerable container;

a dewatering tower having a double cylindrical structure comprising an inner cylinder and an outer cylinder concentrically arranged outside the inner cylinder and having a diameter larger than a diameter of the inner cylinder, the dewatering tower being built in the pressure-tolerable container, a first circular filtration body being provided in a side wall surface of the inner cylinder and a second circular filtration body being provided in a side wall surface of the outer cylinder, respectively, said filtration bodies being arranged to cause the unreacted water to flow out of the dewatering tower through the filtration bodies;

a cylindrical gas-hydrate input part provided in a cavity in the center of the dewatering tower;

a drainage tank formed between the gas-hydrate input part and the pressure-tolerable container;

a crushing unit for crushing a gas hydrate provided in the gas-hydrate input part;

a gas-hydrate discharging unit provided below the gas-hydrate input part;

a scraper formed by a plurality of blades extending radially from a rotation shaft and rotatably provided above the dewatering tower;

a slurry-supplying pipe provided to a lower portion of the dewatering tower; and a drainage pipe is provided to the drainage tank.

2. A gas-hydrate dewatering unit comprising:

a outer cylinder;

a cylindrical dewatering screen provided inside the outer cylinder;

a cylindrical container extending to one end of the dewatering screen;

a rotation shaft inserted into the dewatering screen and the cylindrical container;

a screw blade provided to an outer periphery of the rotation shaft in the dewatering screen;

a blade provided to an outer periphery of the rotation shaft in the cylindrical container;

a gas-hydrate-slurry supplying inlet inserted into the other end of the dewatering screen;

a water-discharging outlet provided to the outer cylinder;

a gas-supplying inlet through which a raw gas of a gas hydrate is supplied into the cylindrical container;

a gas-hydrate-discharging outlet provided to the other end of the cylindrical container; and a flow path through which a cooling medium to cool the gas hydrate and the raw gas in the cylindrical container, flows back.

* * * * *